US007359666B2

(12) United States Patent
Takashi et al.

(10) Patent No.: US 7,359,666 B2
(45) Date of Patent: Apr. 15, 2008

(54) FIXING APPARATUS WITH A PRESSING MEMBER AND TRANSFER FIXING MEMBER

(75) Inventors: Fujita Takashi, Ohta-ku (JP); Kikuchi Hisashi, Kawasaki (JP); Kurotaka Shigeo, Sagamihara (JP); Baba Toshihiko, Funabashi (JP); Echigo Katsuhiro, Asaka (JP); Nakafuji Atsushi, Ohta-ku (JP); Ikenoue Hirokazu, Inagi (JP); Someya Yukimichi, Saitama (JP); Kunii Hiroyuki, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 11/339,485

(22) Filed: Jan. 26, 2006

(65) Prior Publication Data

US 2006/0120776 A1 Jun. 8, 2006

Related U.S. Application Data

(62) Division of application No. 10/612,926, filed on Jul. 7, 2003, now Pat. No. 7,031,648.

(30) Foreign Application Priority Data

| | | |
|---|---|---|
| Jul. 4, 2002 | (JP) | 2002-196040 |
| Aug. 28, 2002 | (JP) | 2002-249282 |
| May 30, 2003 | (JP) | 2003-154828 |

(51) Int. Cl.
*G03G 15/20* (2006.01)
*G03G 15/16* (2006.01)

(52) U.S. Cl. ..... 399/329; 399/307

(58) Field of Classification Search ..... 399/307, 399/328, 329
See application file for complete search history.

(56) References Cited

U.S. PATENT DOCUMENTS

| | | | | |
|---|---|---|---|---|
| 5,309,210 | A * | 5/1994 | Yamamoto et al. | 399/329 |
| 5,351,114 | A | 9/1994 | Matsuno | |
| 5,410,392 | A | 4/1995 | Landa | |
| 5,778,294 | A * | 7/1998 | Hiraoka et al. | 399/329 |
| 5,832,353 | A * | 11/1998 | Sano | 399/329 |
| 5,873,020 | A * | 2/1999 | Matsuura et al. | 399/329 |
| 5,890,047 | A * | 3/1999 | Moser | 399/329 |
| 6,141,524 | A | 10/2000 | Berkes et al. | |
| 6,324,366 | B1 * | 11/2001 | Funayama et al. | 399/329 X |

(Continued)

OTHER PUBLICATIONS

U.S. Appl. No. 11/669,817, filed Jan. 31, 2007, Suzuki, et al.

(Continued)

*Primary Examiner*—Sandra L. Brase
(74) *Attorney, Agent, or Firm*—Oblon, Spivak, McClelland, Maier & Neustadt, P.C.

(57) ABSTRACT

For an image forming apparatus, a transfer fixing apparatus and a transfer fixing method fix a toner image onto a record medium. The fixing apparatus and the image forming apparatus have a structure to reduce adverse heat influences impacting on an intermediate transfer member, and can further reduce vibrations generated to the intermediate transfer member and to a recording medium onto which a visualized image is transferred from the intermediate transfer member. Further, a heating value and a heat distribution in the fixing apparatus can be controlled to be optimized.

15 Claims, 55 Drawing Sheets

U.S. PATENT DOCUMENTS 6,360,073 B1 * 3/2002 Eelen ..... 399/307 X
6,393,245 B1 5/2002 Jia et al.
6,498,911 B2 * 12/2002 Hiroki et al. ..... 399/329 X
6,501,935 B2 * 12/2002 Hirai et al. ..... 399/329
6,577,837 B2 * 6/2003 Iida et al. ..... 399/307
6,604,461 B1 * 8/2003 De Bock et al. ..... 399/307 X
6,650,860 B2 11/2003 Broddin et al.
6,745,002 B2 6/2004 Nakashima et al.
2002/0067936 A1 * 6/2002 Yasui et al. ..... 399/329

OTHER PUBLICATIONS

U.S. Appl. No. 11/521,494, filed Sep. 15, 2006, Takagaki et al.
U.S. Appl. No. 11/511,380, filed Aug. 29, 2006, Suzuki, et al.

* cited by examiner

FIXING APPARATUS WITH A PRESSING MEMBER AND TRANSFER FIXING MEMBER

CROSS-REFERENCE TO PRIORITY DOCUMENTS

The present document is a divisional of U.S. application Ser. No. 10/612,926 filed Jul. 7, 2003 now U.S. Pat. No. 7,031,648, and is based on and claims priority of JPAP 2002-196,040 filed Jul. 4, 2002, JPAP 2002-249,282, filed Aug. 28, 2002, and JPAP 2003-154,828 filed May 30, 2003, the entire contents of each of which are hereby incorporated herein by reference.

BACKGROUND OF THE INVENTION

1. Field of the Invention

The present invention relates to a fixing apparatus and a fixing method both of which fix a toner image onto a record medium. The present invention also relates to an image forming apparatus such as a copier, printer, facsimile, or other fixing apparatus, and an image forming method and a record medium recycling method.

2. Discussion of the Background

A background image forming apparatus such as a copier, a facsimile, or a printer fixes a toner image onto a record medium with heat, to make a copied or a recorded medium. The toner image is fixed onto the record medium, because the toner melts and softens and permeates into the record medium by heating the toner image and the record medium conveyed while being nipped.

FIG. 56 shows the structure in a background image forming apparatus. This apparatus includes image forming devices A, B, C, D forming toner images thereon, an intermediate transfer member E, first transfer members E1, E2, E3, E4 transferring the toner images to the intermediate transfer member E, a second transfer member F transferring a toner image onto the record medium by electrostatic power, a fixing apparatus including a heating fixing roller G1 with a heater and a pressing roller G2 forming a nip between the heating fixing roller G1 and the pressing roller 62.

FIG. 57 shows a structure disclosed in Japanese Published Unexamined Patent Application No. Hei 10-63121. The structure includes an intermediate transfer member 100, a driving roller 101 driving the intermediate transfer member 100, a heat source 102 in the driving roller 101, and a pressing roller 103 contacting and pressing against the intermediate transfer member 100, to form a nip between the intermediate transfer member 100 and the pressing roller 103. The structure also includes image forming devices 105 and first transfer members 106.

According to this structure, the toner image is heated before approaching the nip, then the heated toner image is transferred and fixed onto a record medium 104 in the nip by heat, but not by electrostatic power. Thereby, it is possible to heat the toner image longer.

However the structure published in JP 10-63121 does not solve problems associated with transferring and fixing the toner image onto a record medium after heating the toner image. Further this structure does not show effective application in such a case.

SUMMARY OF THE INVENTION

It is an object of the present invention to provide a novel fixing apparatus reducing adverse heating influences to an intermediate transfer member during an image transfer operation, to provide an image forming apparatus including the novel fixing apparatus, and to provide a novel image forming method to be implemented in the novel image forming apparatus.

It is another object of the present invention to provide a novel fixing apparatus reducing a shift of a toner image on a record medium by vibration of the record medium in the nip, to provide a novel image forming apparatus including the novel fixing apparatus, and to provide a novel image forming method to be implemented in the novel image forming apparatus.

It is another object of the present invention to provide a novel fixing apparatus optimizing a heating value and heating distribution to fix a toner image onto a record medium, to provide a novel image forming apparatus including the novel fixing apparatus, and to provide a novel image forming method to be implemented in the novel image forming apparatus.

It is another object of the present invention to provide a novel record medium recycling method.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
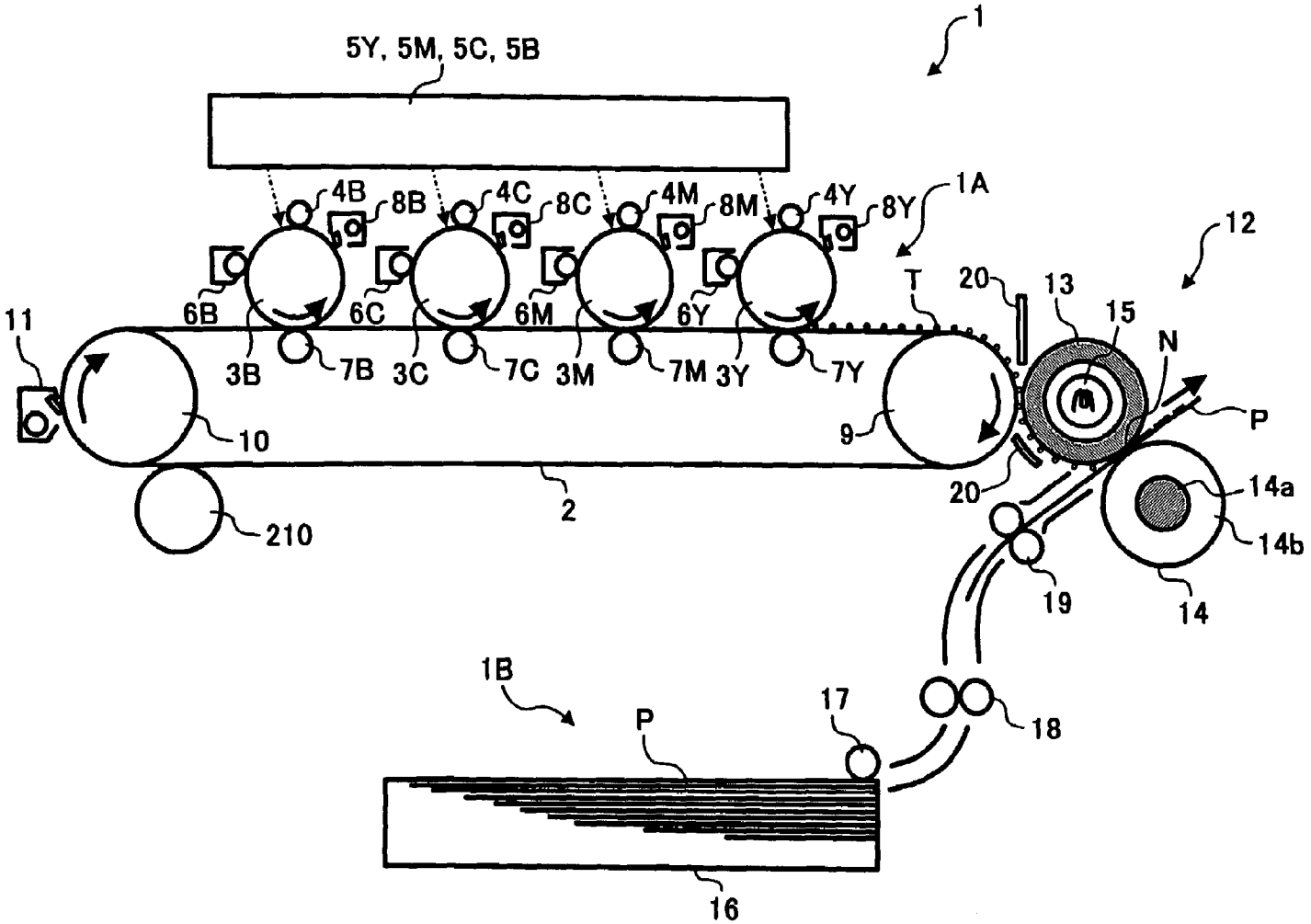
FIG. 1 is a schematic front view showing a color copier as an image forming apparatus according to a first embodiment of the present invention.

Hereinafter, the description will be made of embodiments of the present invention with reference to the drawings, wherein like reference numerals designate identical or corresponding parts through the several views.

FIG. 1 is a schematic front view showing a color copier 1, of a tandem type, as an example of an image forming apparatus according to the first embodiment of the present invention. The present invention is directed to other types of image forming apparatuses, as would be clearly understood by those of ordinary skill in the art. The color copier 1 includes an image forming unit 1A located in the middle of the apparatus, a sheet feeder unit 1B located under the image forming unit 1B, and an image scanning unit (not illustrated) located above the image forming unit 1A.

The image forming unit 1A includes an intermediate transfer belt 2 with a transfer surface extending horizontally as an intermediate transfer member, and image forming members 3Y, 3M, 3C, 3B along and above the transfer surface of the intermediate transfer belt 2 as toner image forming devices. The image forming members 3Y, 3M, 3C, 3B hold respective color toners of yellow, magenta, cyanogen, black, which we relate as complementary colors.

Each image forming member 3Y, 3M, 3C, 3B is composed of a roller each rotating in the same direction, which is counterclockwise. Around each forming member, there are arranged charging units 4Y, 4M, 4C, 4B, exposure units 5Y, 5M, 5C, 5B, developing units 6Y, 6M, 6C, 6B, first transfer units 7Y, 7M, 7C, 7B, and drum cleaning units 8Y, 8M, 8C, 8B. Each developing unit 6Y, 6M, 6C, 6B takes in one respective color toner.

Inside the intermediate transfer belt 2 are arranged a driving roller 9 and a following roller 10, and the intermediate transfer belt 2 is tensioned by these rollers 9, 10 to be rotated. The intermediate transfer belt 2 moves in the same direction at the portion thereof facing each image forming member 3Y, 3M, 3C, 3B. At the portion of the intermediate transfer belt 2 facing the following roller 10, a belt cleaning unit 11 is provided.

A fixing apparatus 12 is provided near the driving roller 9, which with intermediate transfer belt 2 operate as a transfer fixing apparatus. The fixing apparatus 12 includes a transfer fixing roller 13 as a transfer fixing member and a pressing roller 14 as a pressing member or an opposite member. The transfer fixing roller 13, which has toner images transferred thereon from the intermediate transfer belt 2, includes a metallic cylinder, such as aluminum, and a releasing layer on the surface thereof. In the transfer fixing roller 13 a halogen heater 15 is provided as a heating member for heating the toner image on the transfer fixing roller 13. The pressing roller 14, which forms a nip N between it and the transfer fixing roller 13, includes a metallic core 14*a* and an elastic layer 14*b*.

The sheet feeder unit 1B includes a sheet tray 16, a feeding roller 17, a pair of conveying rollers 18, and a pair of resist rollers 19. The sheet tray 16 holds plural record mediums. The feeding roller 17 separates the top most record medium from others in the sheet tray 16 and feeds the separated record medium. The pair of conveying roller 18 conveys the record medium toward the image forming unit 1A. The pair of resist rollers 19 temporarily stops the record medium, and sends the record medium to the nip N as the position of the record medium coincides with the position of the toner image in the nip N, after adjusting the position of the record medium.

The following is a description of an operation of the color copier 1. The image forming members 3Y, 3M, 3C, 3B each form a static potential image on their surfaces based on image information output from the image scanning unit, after having their surfaces charged by the charging units 4Y, 4M, 4C, 4B. The developing units 6Y, 6M, 6C, 6B make the static potential images into visible images as toner images. The first transfer units 7Y, 7M, 7C, 7B firstly transfer the toner images from each image forming member 3Y, 3M, 3C, 3B to the intermediate transfer belt 2, and thereby the toner image of each color is put upon on the surface of the intermediate transfer belt 2. After transferring the toner images, the drum cleaning units 8Y, 8M, 8C, 8B remove residual toner from the image forming members 3Y, 3M, 3C, 3B, and then a discharge lamp (not illustrated) initializes an electric potential on the image forming members 3Y, 3M, 3C, 3B. A bias supplying member (not illustrated) secondarily transfers the composite toner image from the intermediate transfer belt 2 to the transfer fixing roller 13 by electrostatic power caused by a bias supplied to the driving roller 9. The transfer fixing roller 13 and the pressing roller 14 press and fix the toner image onto the record medium P passing through the nip N.

The toner image preferably uses the WARDELL working sphericiry $\phi$ of more than 0.8. The sphericiry $\phi$=(a diameter of the circle whose area equals the projected area of the particle/a diameter of the circumscribed circle to the particle). These are easily calculated by the steps of gathering the toner image on the slide glass, magnifying the toner image 500 times by a microscope, and measuring 100 of the toner images. Thereby, it is possible to transfer the toner image from the intermediate transfer belt 2 to the transfer fixing roller 13 efficiently, as disclosed in Japanese Published Unexamined Patent Application No. Hei 9-2584747.

According to the embodiment described above, the toner image, which is transferred from the intermediate transfer belt 2 to the transfer fixing roller 13, is heated without the record medium, i.e. is heated before being transferred onto the record medium P, and is heated until being fixed on the record medium P. Thereby, the toner image can be sufficiently fixed onto the record medium P while being heated at a lower temperature when the record medium P is at the nip N, compared to heating the toner image only when being transferred to the record medium P. The results of experiments conducted by the present inventors show that with this operation the toner image fixed on the record medium is of a high enough quality when the heating temperature on the transfer fixing roller 13 is 110°~120° C.

Incidentally, the heat capacity to fix a monochrome image is generally about 1.5 times the heat capacity to fix a color image. Thereby, the record medium P may be excessively heated in the case of heating the toner image on the record medium P, and the toner image may excessively adhere to the record medium P in such a case. According to this embodiment described above, however, the record medium P is not excessively heated because the heating temperature at the time of transferring the toner image to the record medium P is reduced. Further, the toner image is not excessively adhered to the record medium P, because the toner image is heated independently of heating the record medium P, particularly in the case of the color toner image necessary for large energy.

Further, it is possible to reduce the influence of heat on the intermediate transfer belt 2, because the toner image is heated by the transfer fixing roller 13, not by the intermediate transfer belt 2. Thereby, a lifetime of the image forming members 3Y, 3M, 3C, 3B becomes longer, by reducing the heat influence to the image forming members 3Y, 3M, 3C, 3B through the intermediate transfer belt 2.

In this embodiment, the structure reduces the influence of heat on the intermediate transfer belt 2.

Furthermore, an insulating plate 20 is arranged between the intermediate transfer belt 2 and the transfer fixing roller 13, as a heat restraining member that restrains the heat from the transfer fixing roller 13 from impacting on the intermediate transfer belt 2. The insulating plate 20 includes a frame forming an opening, the toner image being transferred from the intermediate transfer belt 2 to the transfer fixing roller 13 through the opening. The insulating plate 20 can be fixed to a casing of the image forming apparatus or the fixing apparatus. The insulating plate 20 is preferably composed of a metallic plate with a relatively lower radiation rate, more preferably a pair of metallic plates nipping a very small gap or an insulator. Furthermore, the insulating plate 20 may include a micro heat pipe mainly used to cool a CPU in a notebook-type personal computer, and thereby the insulating plate 20 is kept at a low temperature.

Between the portion facing the transfer fixing roller 13 and the portion facing the most upstream image forming member 3B at the intermediate transfer belt 2, a cooling roller 210 is arranged as a cooling member dissipating heat from the intermediate transfer belt 2. The cooling roller 210, which is composed of a material with a higher heat conductivity, rotates while contacting the intermediate transfer belt 2.

Figure 2:
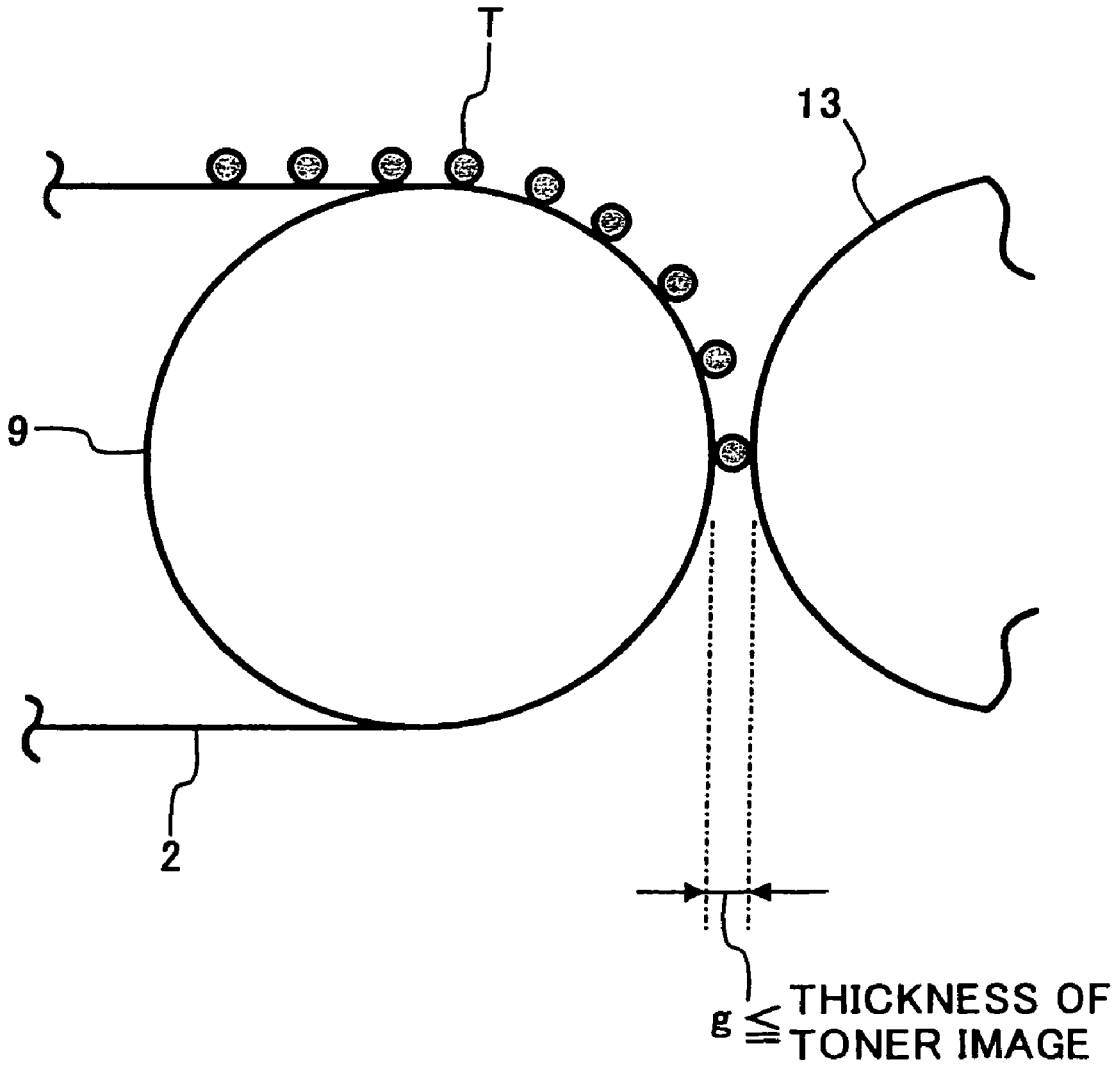
FIG. 2 is a view showing a distance between an intermediate transfer roller and a transfer fixing roller in the image forming apparatus in the first embodiment.

FIG. 2 is a view showing a distance between the intermediate transfer belt 2 and the transfer fixing roller 13 in the image forming apparatus. The intermediate transfer belt 2 is separated from the transfer fixing roller 13 by a thickness g of the toner image. Thereby, the toner is transferred from the intermediate transfer belt 2 to the transfer fixing roller 13 while contacting the fixing roller, but the intermediate transfer belt 2 and transfer fixing roller do not contact each other in the area without the toner. Therefore, it is possible to further reduce the influence of heat on the intermediate transfer belt 2.

Figure 3:
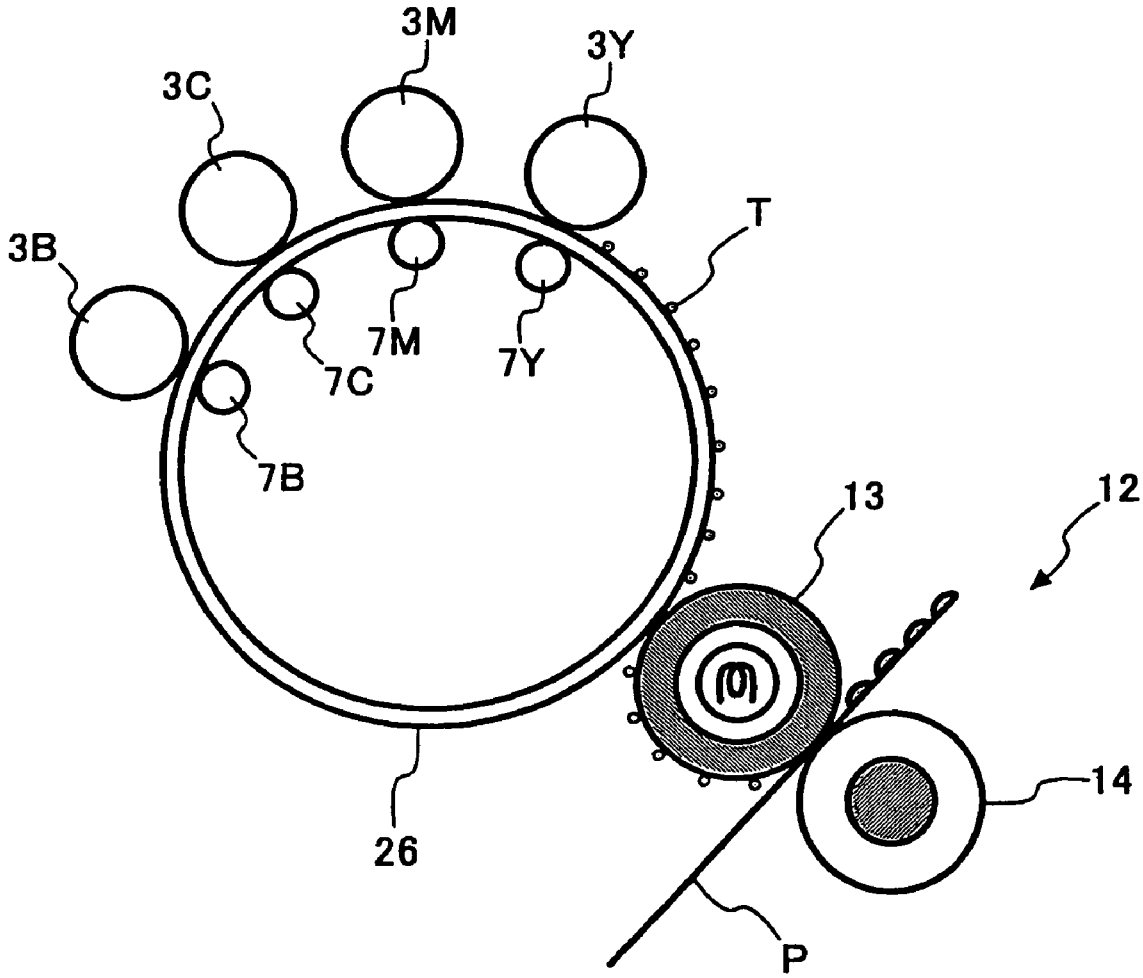
FIG. 3 is a schematic front view showing a modification of the first embodiment.

FIG. 3 is a schematic front view showing a modification of this embodiment. In this modification, the intermediate transfer belt 2 is exchanged for an intermediate transfer member 26 formed of a cylinder. It is common in such an embodiment for an intermediate transfer belt 2 to be exchangeable for such an intermediate transfer member 26.

According to the first embodiment described above, the toner image is fixed on the record medium P while a heating temperature is lowered. Thereby, it is possible to shorten the time to warm up the transfer fixing roller 13, and it is possible to realize energy conservation in the image forming apparatus. Further, it is possible to reduce the influence of heat on the intermediate transfer belt 2 and the image forming members 3Y, 3M, 3C, 3B. Thereby, a lifetime of the intermediate transfer belt 2 and the image forming members 3Y, 3M, 3C, 3B is lengthened.

Figure 4:
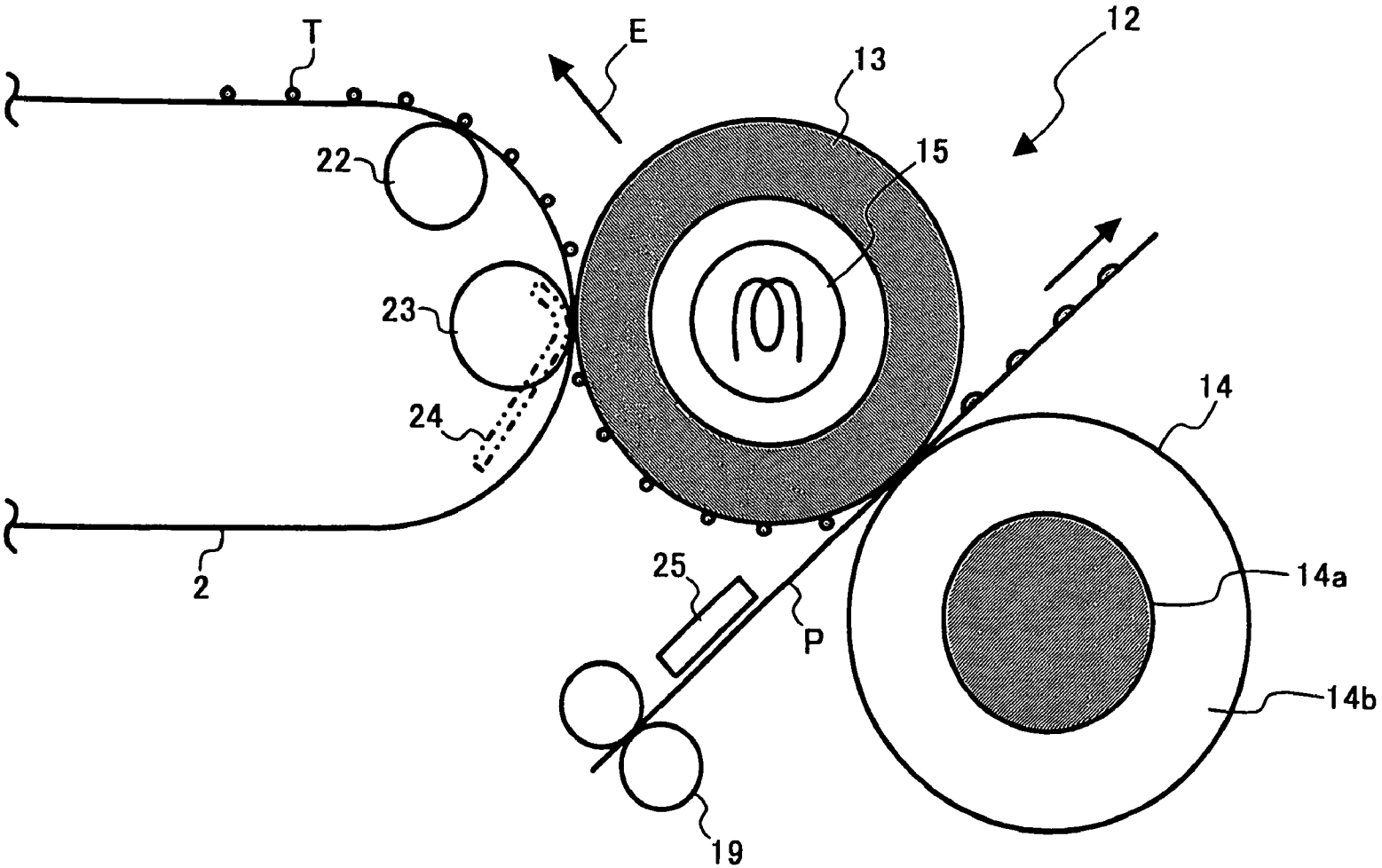
FIG. 4 is a schematic front view showing a second embodiment of the present invention.

FIG. 4 is a schematic front view showing a second embodiment. In this embodiment, at a portion inside the intermediate transfer belt 2 facing the transfer fixing roller 13 are arranged a pair of bias rollers 22, 23 as a bias supplying member. The pair of bias rollers 22, 23 support the intermediate transfer belt 2 and supply bias onto the intermediate transfer belt 2. The pair of the bias rollers 22, 23 are formed by an elastic conductor material. Between the pair of resist rollers 19 and the nip N in the direction of the conveying record medium, a heater 25 is provided as a record medium heating member. The heater 25 heats the record medium P before it reaches the nip N. The transfer fixing roller 13, the halogen heater 15, and the heater 25 are individually exchangeable.

In this embodiment, it is possible to better control the interaction between the toner image and the record medium P, because the record medium P is independently heated by the heater 25, and thereby heating of the toner image can be reduced as even more heat is taken by the record medium. Thereby, it is possible to control minutely the fixing and adhering conditions of the toner image on the record medium P.

Further a heating control member (not illustrated) is provided, which can continuously or gradually changes the heating value both of the halogen heater 15 and the heater 25. The heating control member also can continuously or gradually change the ratio between the heating value of the halogen heater 15 and of the heater 25. The heating control member can change the heating value based on the record medium, e.g. whether an OHP or not, a thermal capacity of the record medium, an amount of toner, a thickness of the toner image, a kind of toner image, etc. The heating control member can also change the above mentioned ratio based on a kind of the record medium, a thermal capacity of the record medium, an amount of the toner, a thickness of the toner image, a kind of toner image, etc. Thereby, it is possible to control more minutely the fixing and adhering conditions of the toner image on the record medium P.

The bias roller 22 supplies the bias of an opposite polarity as the toner image. This bias prevents an electric field between the intermediate transfer belt 2 and the transfer fixing roller 13, and generates an electric field to adhere the toner image onto the intermediate transfer belt 2. Thereby, the toner on the intermediate transfer belt 2 is prevented from scattering before approaching the nip between the intermediate transfer belt 2 and the transfer fixing roller 13. To obtain the same effect, the bias roller 22 may ground the intermediate transfer belt 2.

The bias roller 23 supplies the bias of a same polarity as the toner image. This bias gives an electrostatic repellent to the toner image on the intermediate transfer belt 2.

Thereby, the toner on the intermediate transfer belt 2 is transferred and adhered onto the transfer fixing roller 13 by the electrostatic power in the nip between the intermediate transfer belt 2 and the transfer fixing roller 13. To obtain the same effect, the bias roller 23 may be exchanged for a bias board spring 24. Further, the bias roller 23 or the bias board spring 24 is preferably arranged as close, but not contacting, to not short out, to the bias roller 22. The most suitable gap is about 1 mm. Thereby, it is possible to develop a high quality toner image transferred onto the transfer fixing roller 13.

In this embodiment, the intermediate transfer belt 2 is separated from the transfer fixing roller 13 by a thickness of the toner image. Thereby, it is further possible to reduce the influence of heat on the intermediate transfer belt 2. That also prevents reducing the quality of transferring the toner image caused by making the distance between the intermediate transfer belt 2 and the transfer fixing roller 13 too long, because the toner on the intermediate transfer belt 2 is transferred and adhered onto the transfer fixing roller 13 by electrostatic power.

Figure 5:
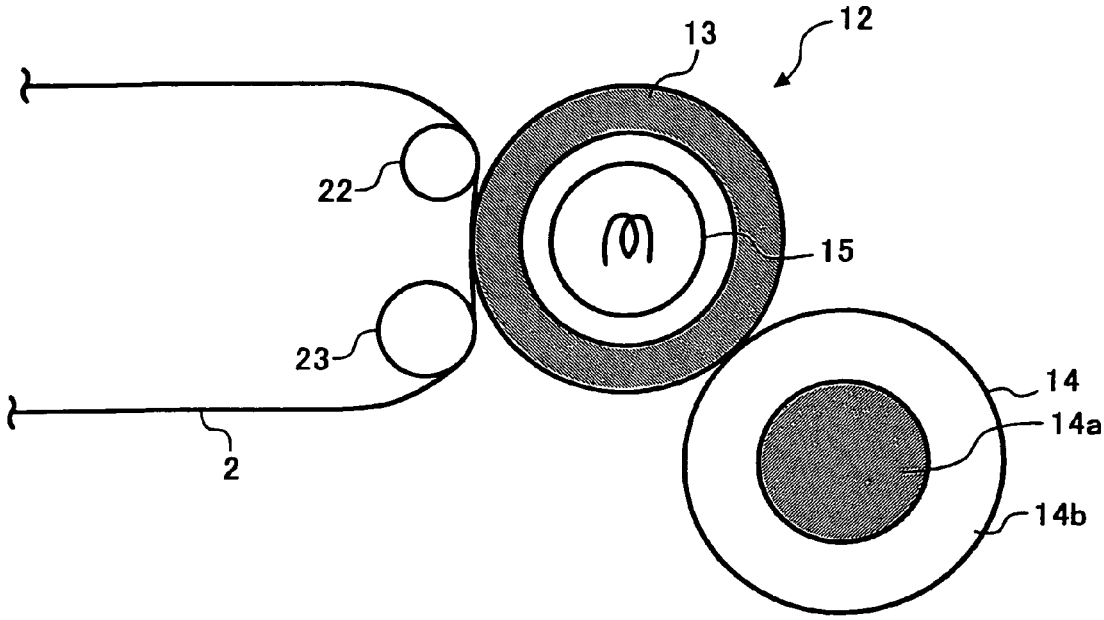
FIG. 5 is a schematic front view showing a modification of the second embodiment.

FIG. 5 is a schematic front view showing a modification of this embodiment. In this modification, the bias roller 23 is arranged downstream of a nip between the intermediate transfer belt 2 and the transfer fixing roller 13 in the direction of rotation of the intermediate transfer belt 2. Therefore, the strength of the bias gradually changes along the direction of rotation of the intermediate transfer belt 2. Thereby, it is possible to develop a high quality toner image transferred onto the transfer fixing roller 13.

Figure 6:
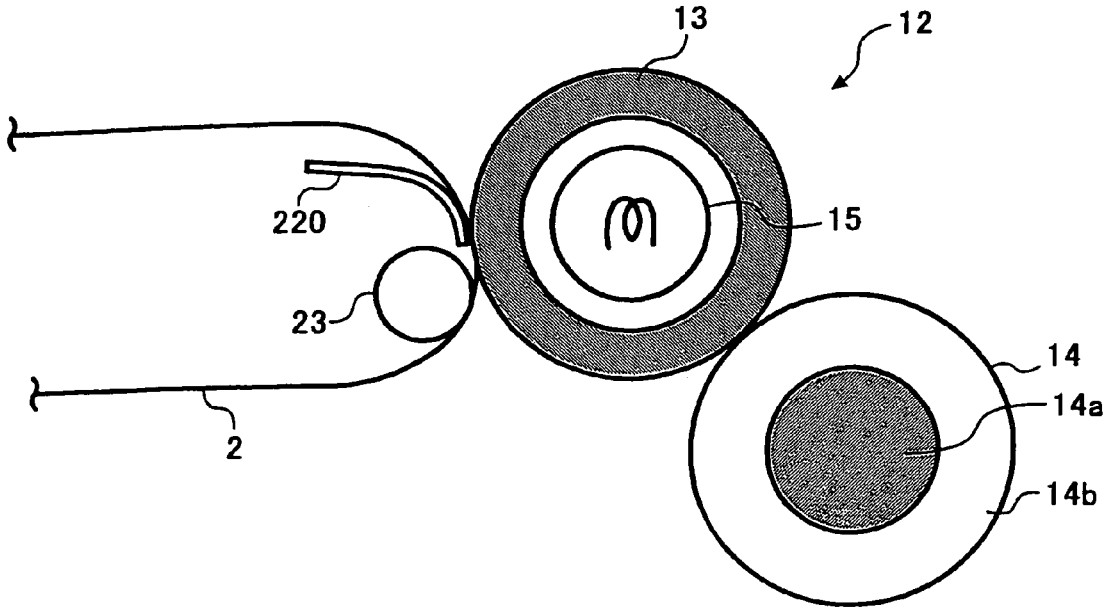
FIG. 6 is a schematic front view showing a second modification of the second embodiment.

FIG. 6 is a schematic front view showing a second modification of this embodiment. In this modification, the bias roller 22 is exchanged for a bias board spring 220, also supplied with a bias of an opposite polarity to the toner image. Therefore, it is possible to develop a high quality toner image transferred onto the transfer fixing roller 13.

Figure 7:
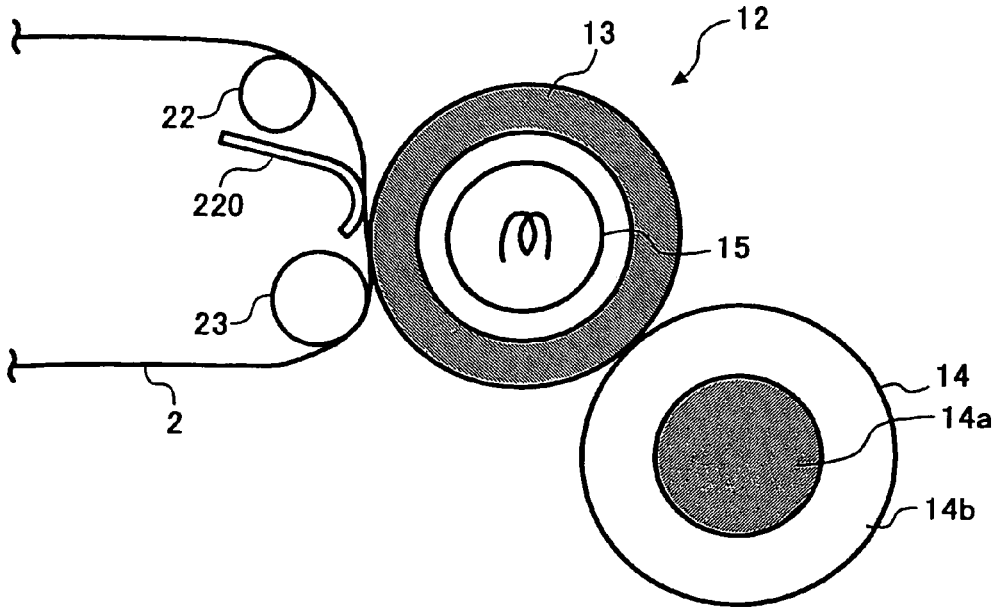
FIG. 7 is a schematic front view showing a third modification of the second embodiment.

FIG. 7 shows a further modification utilizing both the bias roller 22 and bias board spring 220.

Figure 8:
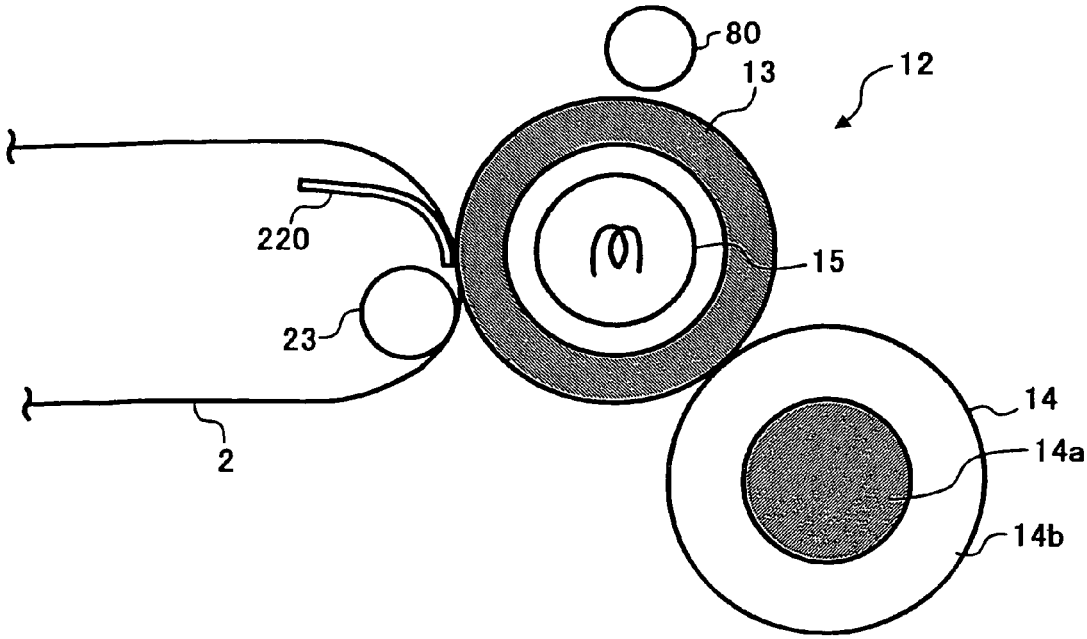
FIG. 8 is a schematic front view showing a fourth modification of the second embodiment.

FIG. 8 is a schematic front view showing a fourth modification of this embodiment. In this modification, a bias roller 80 is provided close and separated from the transfer fixing roller 13. The bias roller 80 is electrified by bias multiplexing AC and DC whose polarity is opposite to the toner image. The transfer fixing roller 13 includes a conductor layer near the surface thereof, and then the transfer fixing roller 13 is electrified to eliminate the electrification by the bias roller 80. Thereby, it is possible to stabilize the electric potential on the surface of the transfer fixing roller 13, to stabilize the toner image fixing on the record medium P, and offset is prevented.

According to the second embodiment described above, it is possible to reduce the influence of heat to the intermediate transfer belt 2 and the image forming members 3Y, 3M, 3C, 3B. Further, there is no reduction of the quality of transferring the toner image caused by making the distance between the intermediate transfer belt 2 and the transfer fixing roller 13 too long. In addition, it is possible to be consistent with reducing the influence of heat and maintaining the quality of transferring the toner image. Furthermore, it is possible to control the conditions of the interface between the toner image and the record medium. Thereby, it is possible to control minutely the fixing and adhering conditions of the toner image on the record medium.

Figure 9:
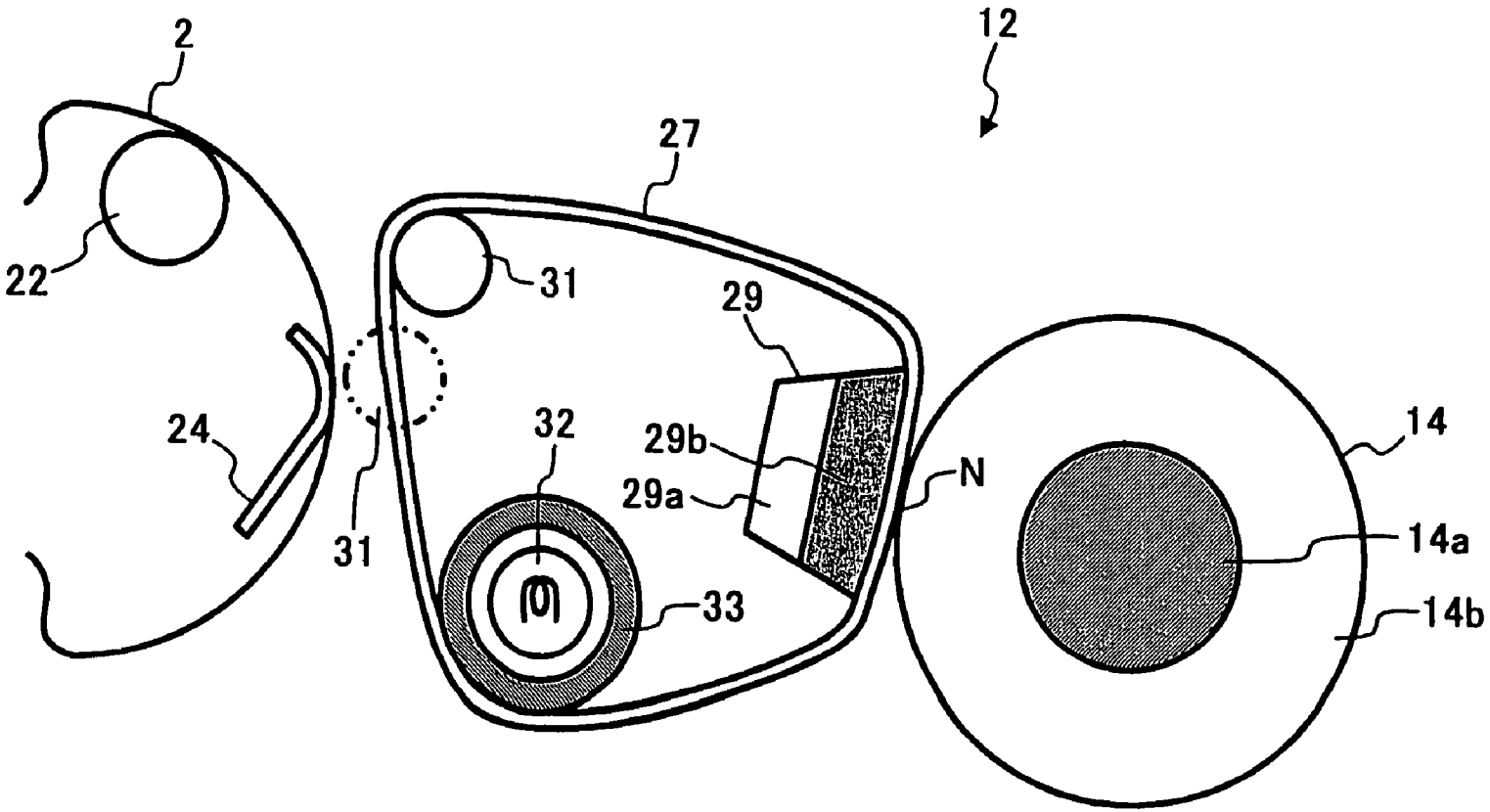
FIG. 9 is a schematic front view showing a third embodiment of the present invention.

FIG. 9 is a schematic front view showing a third embodiment. In this embodiment a transfer fixing member 27, which is formed as a belt or a sheet, is flexible. The transfer fixing member 27 is supported by a supporting member 29, a supporting roller 31, and a heating roller 33. The supporting member 29 includes a metallic base 29*a* and an elastic layer 29*b*. The supporting roller 31 includes a halogen heater 32 as a heating member. The transfer fixing member 27 rotates by the pressing roller 14 rotating. In this embodiment, it is possible to heat the toner image longer because the toner image is heated on the fixing member 27.

Figure 10:
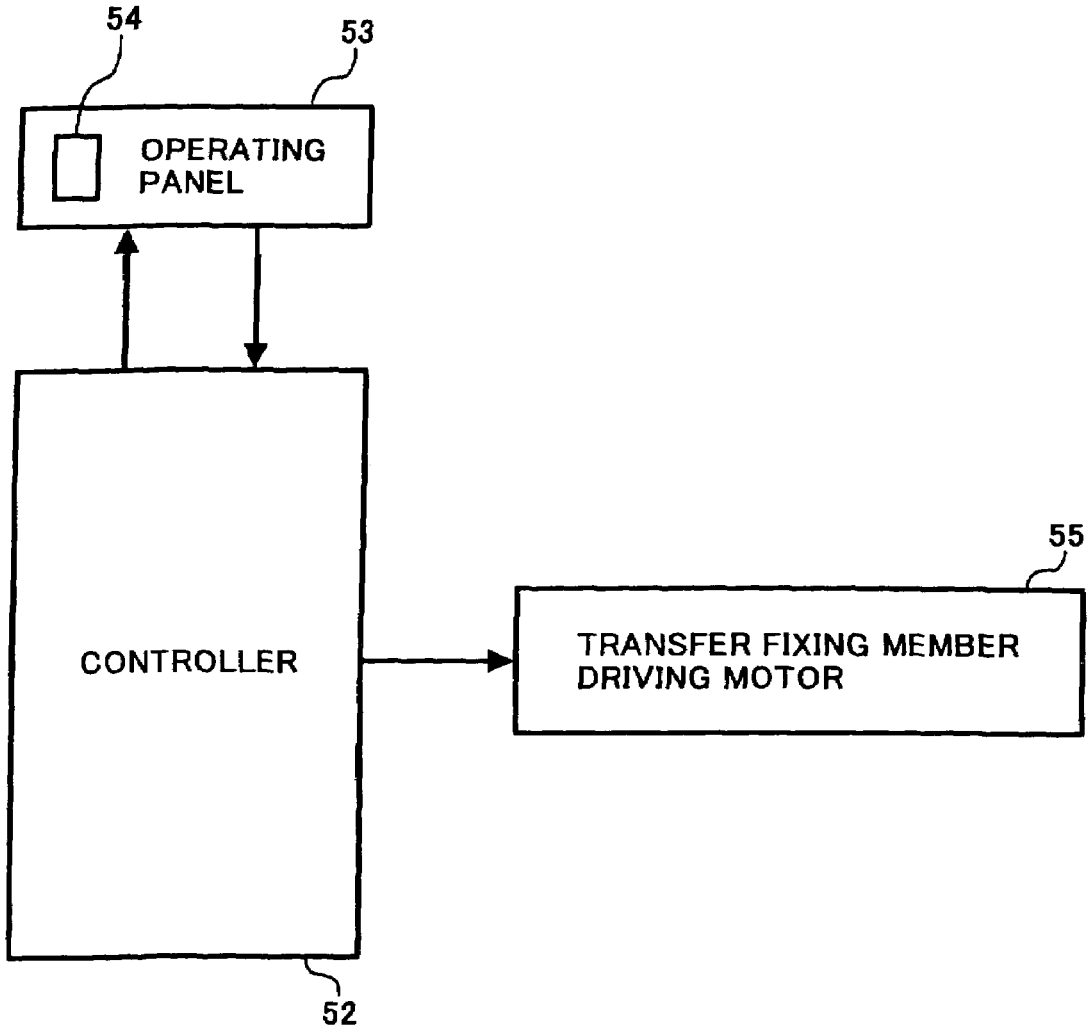
FIG. 10 is a control block view showing a third embodiment and a seventeenth embodiment of the present invention.

FIG. 10 is a control block view showing this third embodiment. The intermediate transfer belt 2 includes a controller 52, an operating panel 53 including a switch 54, and a transfer fixing member driving motor 55 as a distance changing member. The operating panel 53 outputs a signal according to operating the switch 54 to the controller 52, and inputs a signal from the controller 52. The controller 52 inputs the signal from the operating panel 53, and outputs signals according to the signal from the operating panel 53 to the operating panel 53 and the transfer fixing member driving motor 55. In this embodiment, the transfer fixing member driving motor 55 changes the distance or the contacting pressure between the intermediate transfer belt 2 and the transfer fixing member 27, by changing the position of the supporting roller 31 between the solid line position and the two-dot chain line position in FIG. 9.

The controller 52 drives the transfer fixing member driving motor 55 except while the toner image is being transferred from the intermediate transfer belt 2 onto the transfer fixing member 27. Thereby, the supporting roller 31 is moved from the solid line position and the two-dot chain line position in FIG. 9. The controller 52 may make the transfer fixing member driving motor 55 move the supporting roller 31 as the contacting pressure between the intermediate transfer belt 2 and the transfer fixing member 27 decreases while the intermediate transfer belt 2 contacts the transfer fixing member 27. Therefore, it is possible to reduce the influence of heat to the intermediate transfer belt 2 and the image forming members 3Y, 3M, 3C, 3B. Further, it is possible to prevent melted toner from anchoring onto the intermediate transfer belt 2 when a paper jam occurs.

Figure 11A:
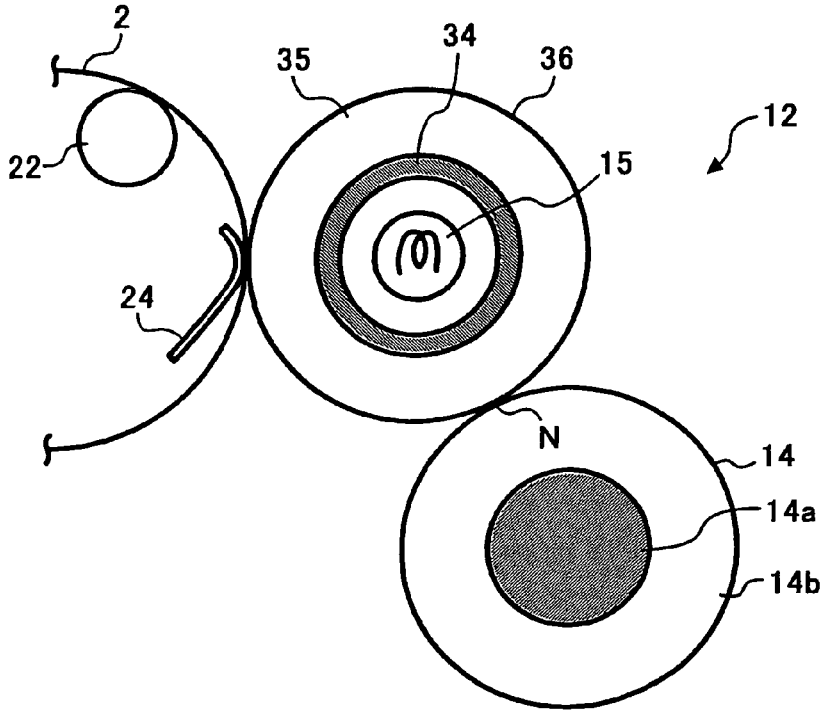
FIGS. 11A and 11B are schematic front views showing a modification of the third embodiment.
Figure 11B:
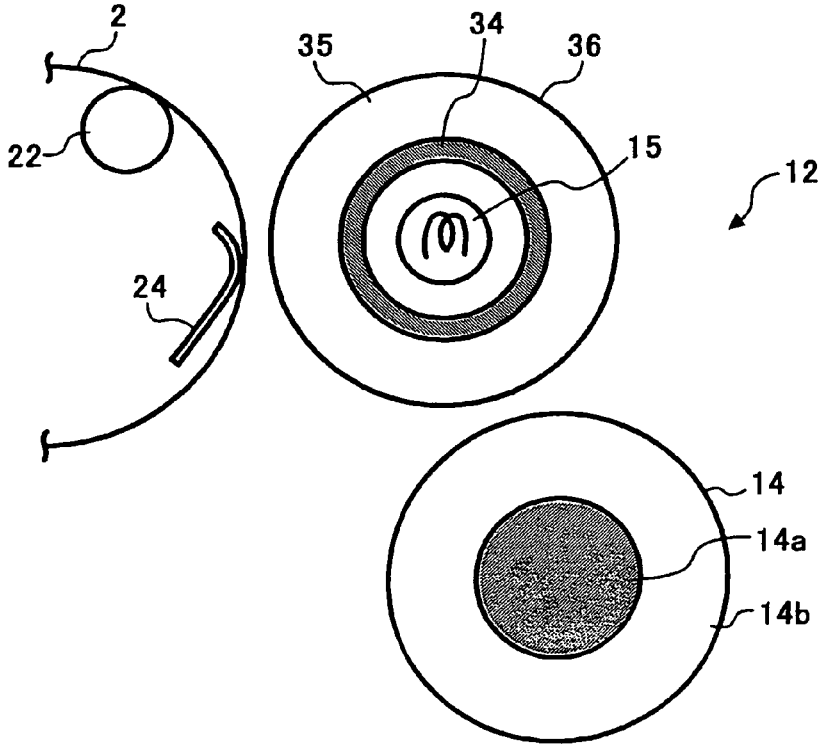

FIGS. 11A and 11B are schematic front views showing a modification of the third embodiment. In this modification the transfer fixing member 27 is exchanged for a transfer fixing roller 36 including the halogen heater 15, a metallic core 34, and an elastic layer 35. The transfer fixing member driving motor 55 also lengthens the distance between the pressing roller 14 and the transfer fixing roller 36, while lengthening the distance between the intermediate transfer belt 2 and the transfer fixing roller 36. The transfer fixing member driving motor 55 may also decrease the contacting pressure between the pressing roller 14 and the transfer fixing roller 36, while decreasing the contacting pressure between the intermediate transfer belt 2 and the transfer fixing roller 36.

Figure 12A:
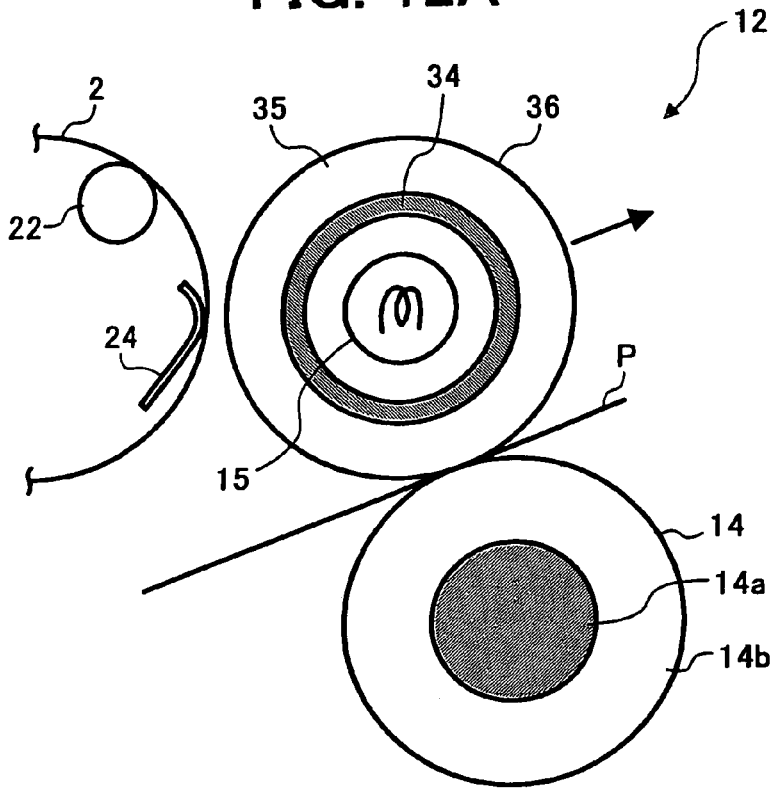
FIGS. 12A and 12B are schematic front views showing a second modification of the third embodiment.
Figure 12B:
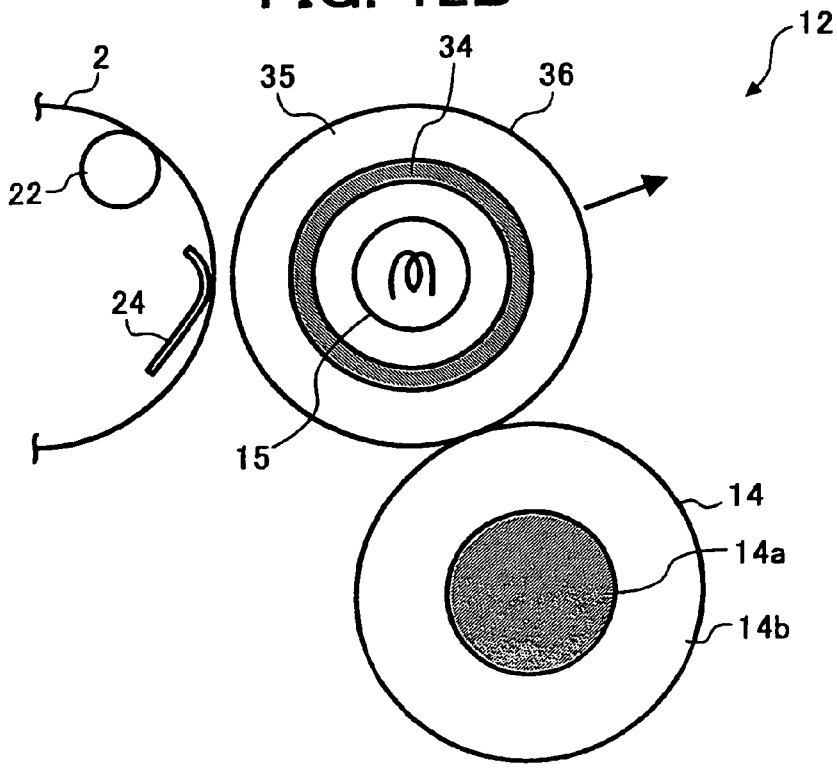

FIGS. 12A and 12B are schematic front views showing a second modification of the third embodiment. FIG. 12A shows that the toner image is not being transferred from the intermediate transfer belt 2 to the transfer fixing member 27, when the intermediate transfer belt 2 and the transfer fixing member 27 are driven because there is a record medium P in the nip N between the transfer fixing roller 36 and the pressing roller 14. FIG. 12B shows that the toner image is not being transferred from the intermediate transfer belt 2 to the transfer fixing member 27, when the intermediate transfer belt 2 and the transfer fixing member 27 are driven because the next record medium approaches the nip N between the transfer fixing roller 36 and the pressing roller 14. In this modification, the transfer fixing member driving motor 55 lengthens the distance or decreases the contacting pressure between the pressing roller 14 and the transfer fixing roller 36, while the toner image is not being transferred from the intermediate transfer belt 2 to the transfer fixing member 27 when the intermediate transfer belt 2 and the transfer fixing member 27 are driven.

According to the third embodiment described above, it is possible to reduce the influence of heat to the intermediate transfer belt 2 and the forming members 3Y, 3M, 3C, 3B.

Figure 13:
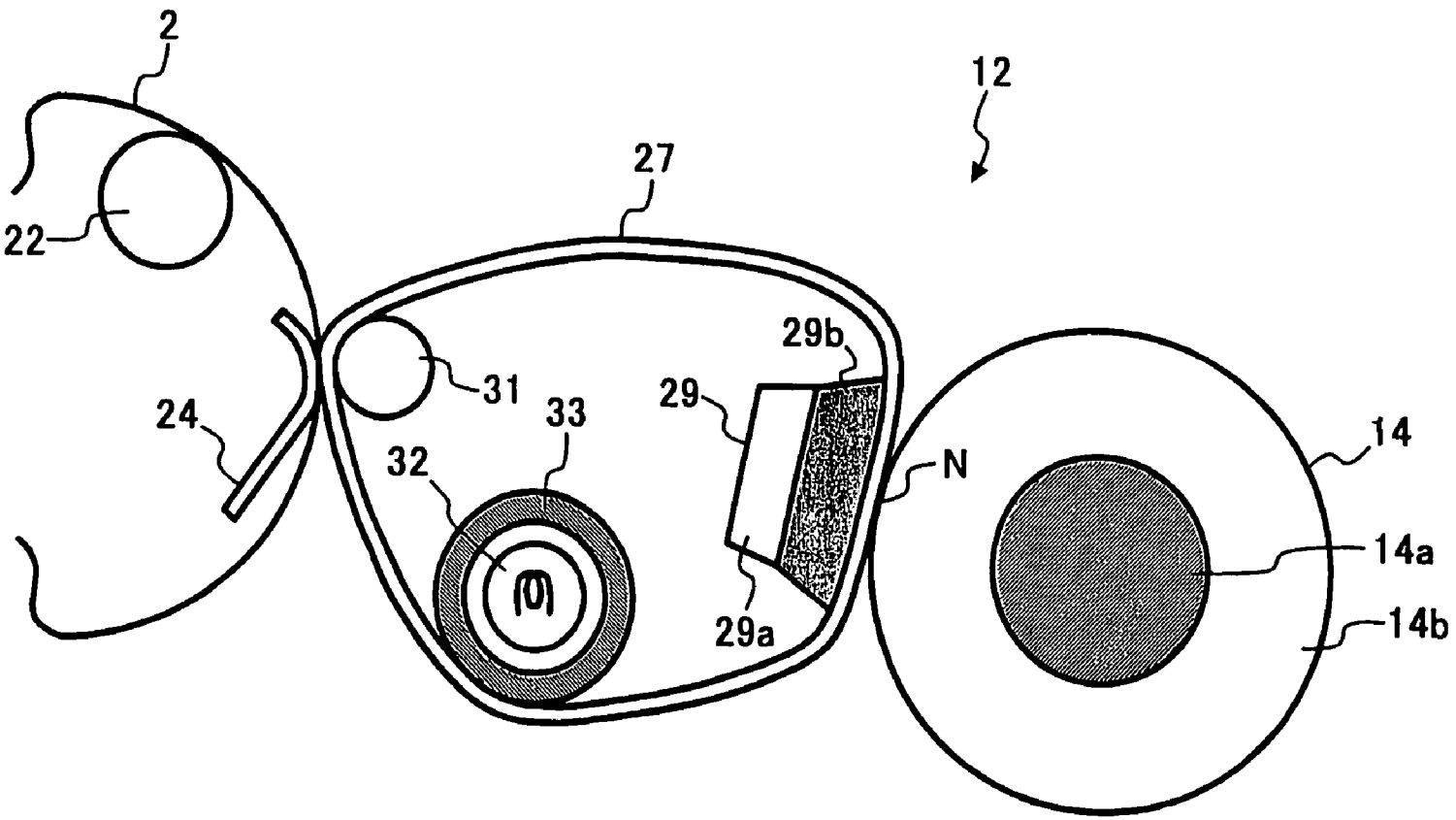
FIG. 13 is a schematic front view showing a fourth embodiment of the present invention.

FIG. 13 is a schematic front view showing a fourth embodiment. In this embodiment the heating roller 33 with the halogen heater 32 are arranged at a position such that the position on the transfer fixing member 27 with the highest temperature is away from the portion where the toner image is transferred onto the transfer fixing roller 13. Thereby, it is possible to reduce the influence of heat to the intermediate transfer belt 2 and the image forming members 3Y, 3M, 3C, 3B. Further, it is possible to efficiently heat the toner image.

Figure 14:
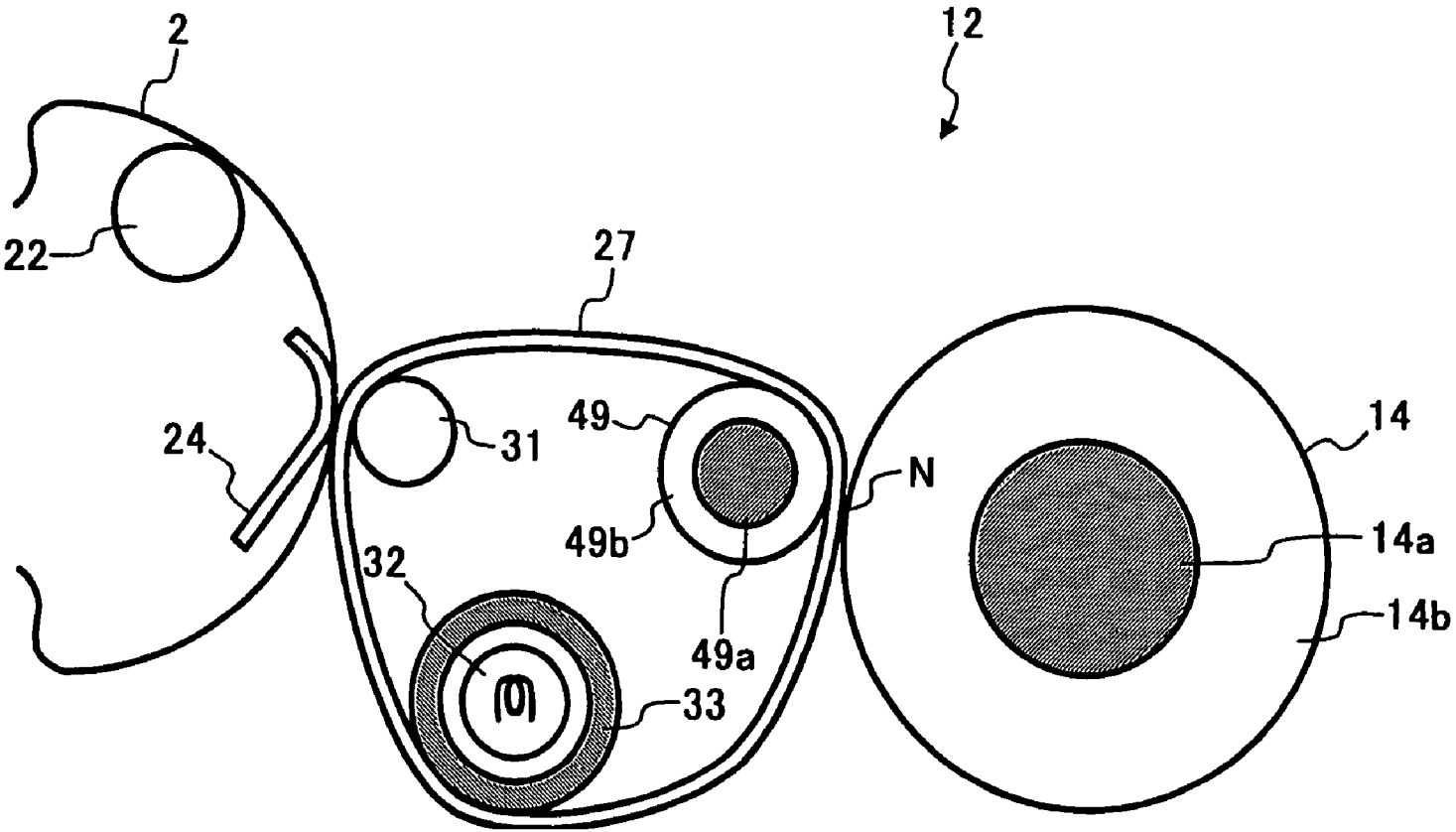
FIG. 14 is a schematic front view showing a modification of the fourth embodiment.

FIG. 14 is a schematic front view showing a modification of this embodiment, in which the supporting member 29 is exchanged for a supporting roller 49 with a metallic core 49*a* and an elastic layer 49*b*.

According to this embodiment, it is possible to reduce the influence of heat to the intermediate transfer belt 2 and the image forming members 3Y, 3M, 3C, 3B. Further, it is possible to efficiently heat the toner image.

Figure 15:
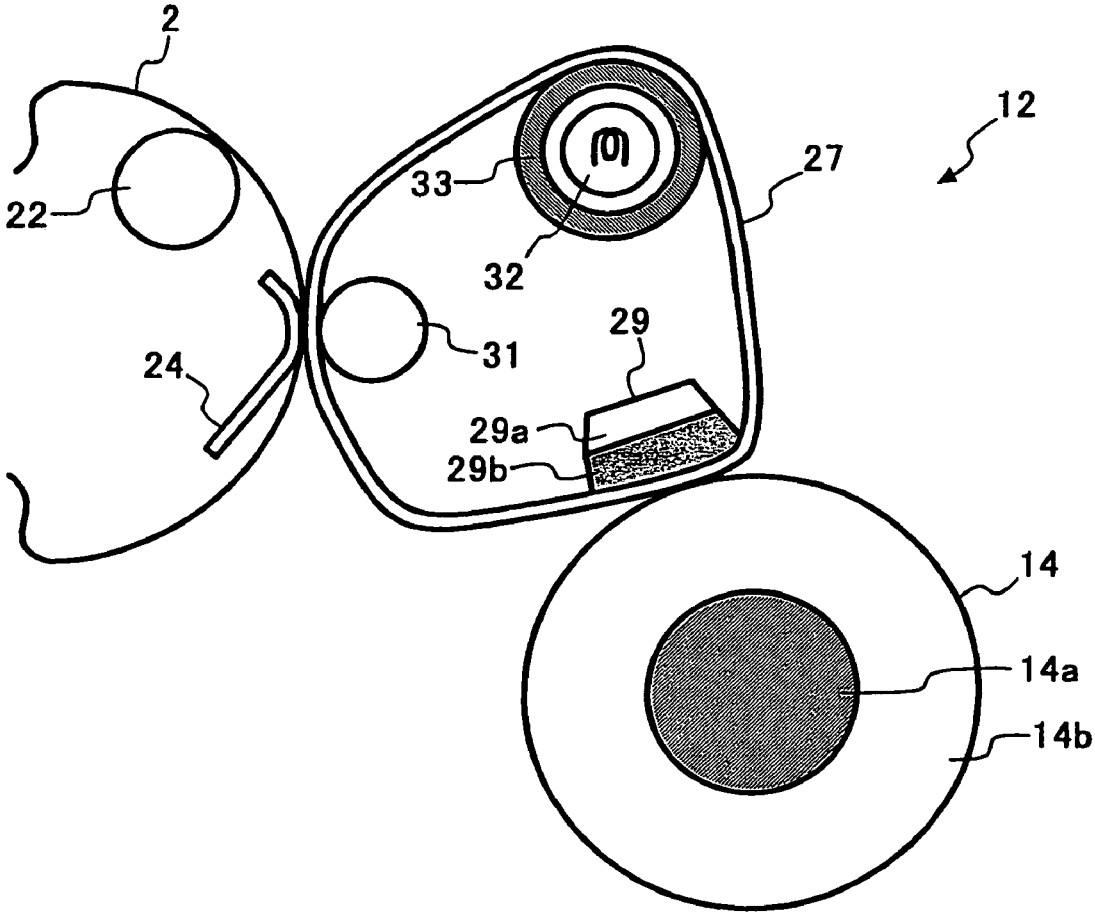
FIG. 15 is a schematic front view showing a fifth embodiment of the present invention.

FIG. 15 is a schematic front view showing a fifth embodiment. In this embodiment, vibration caused by the record medium approaching into the nip N is prevented from being transmitted to the nip between the intermediate transfer belt 2 and the transfer fixing member 27, because the transfer fixing member 27 itself and the elastic layer 29*b* absorb the vibration by being deformed. Thereby, reduction of image quality of transferring the toner image caused by the record medium approaching into the nip N is prevented, particularly in a case of transferring a color toner image that is easily influenced by vibration.

Figure 16:
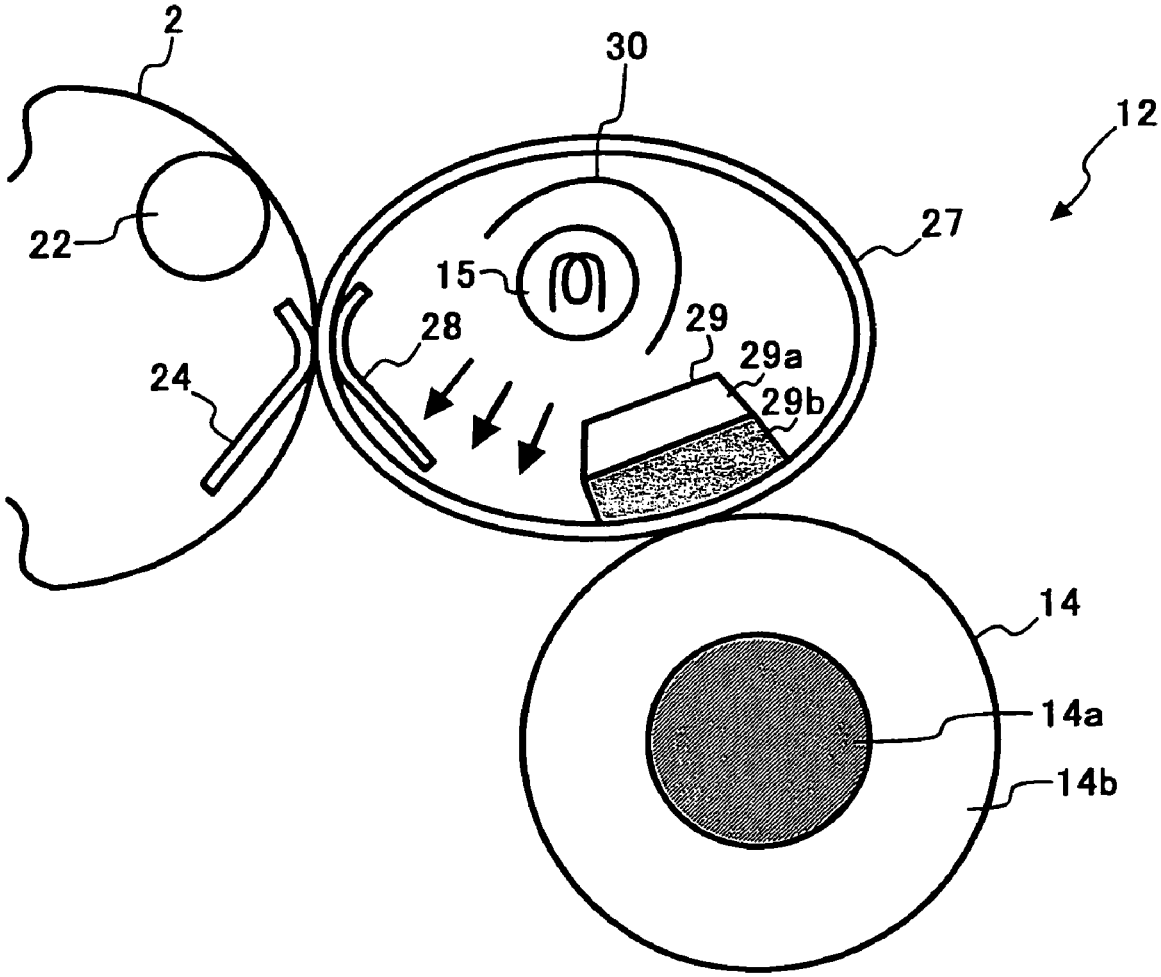
FIG. 16 is a schematic front view showing a modification of the fifth embodiment.

FIG. 16 is a schematic front view showing a modification of this embodiment in which inside the transfer fixing member 27 are provided a board spring 28, which supports the portion forming the nip between the intermediate transfer belt 2 and the transfer fixing member 27, and a reflector 30 reflecting the heat by the halogen heater 15. In this modification, reduction of image quality of transferring the toner image caused by the record medium approaching into the nip N is prevented.

Figure 17:
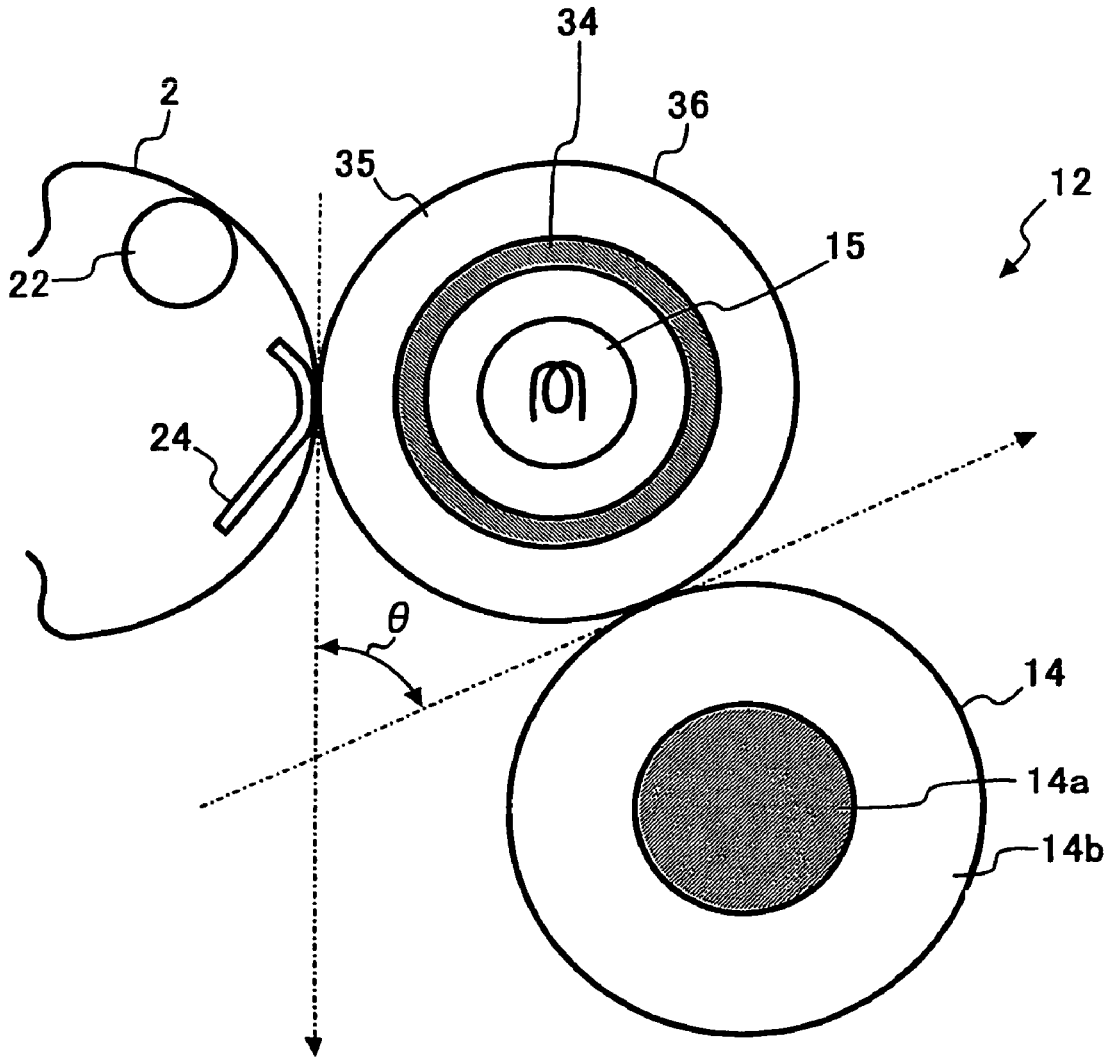
FIG. 17 is a schematic front view showing a second modification of the fifth embodiment.

FIG. 17 is a schematic front view showing a second modification of this embodiment in which a rubber or a foamed material is used for the material of the elastic layer 35. The maximum thickness of the elastic layer 35 is decided by a thickness with which the bias on the surface of the transfer fixing roller 36 is still generated. In this modification, reduction of image quality of transferring the toner image caused by the record medium approaching into the nip N is prevented.

In the fifth embodiments described above, the toner image can be formed by a resolution of more than 600 dpi, which is easily influenced by vibration, and a total thickness of the elastic layer in the transfer fixing member and the pressing member is more than a thickness of the record medium. In FIG. 17, the total thickness of the elastic layer 35 and the elastic layer 14*b* can be more than the thickness of the record medium. The total thickness of the elastic layer in the transfer fixing member and the pressing member is preferably more than twice the thickness of the record medium. Thereby, reduction of image quality of transferring the toner image caused by the record medium approaching into the nip N, in particularly a case of the toner image formed by a resolution more than 600 dpi, is prevented.

The following is a detailed description regarding the effect described above. Human beings can recognize the difference of an image more than 10 cycle/mm frequency (254 dpi, 100 μm pitch) based on MTF characteristic (the VTF) "Basic and application of electric photography technology." p.717-718, Electric Photography Society, 1988.6.15. Thereby, differences of an image of more than 100 μm is a problem.

Further, when a smaller image such as a photograph is formed in the image forming apparatus with a resolution of 600 dpi, a dot interval is 42.3 μm. In this case, human being cannot clearly recognize overlapping of each other dot, but can feel uncomfortable while seeing the image. Incidentally, in the case of a resolution of 1200 dpi, a dot interval is 21.2 μm. In this case, human being can not recognize overlapping of each other dot, because this interval is smaller than a fifth of 100 μm based on the VTF.

A thickness of the record medium used in the electric photograph is actually 60~100 μm. The difference of the image caused by the thickness of the record medium is maximized to equal the thickness of the record medium, when the direction in which the record medium approaches the nip N is a right angle to the common tangent to the intermediate transfer member and the transfer fixing member. Meanwhile an elastic layer, whose rubber hardness is between 5 and 90, is easily compressed to about 30% of a thickness thereof.

Based on these parameters, in the case that the thickness of the elastic layer is twice 60 μm, the maximum difference of the image=60−(60*0.3)=42 μm. In the case that the thickness of the elastic layer is twice 60 μm, the maximum difference of the image=60−(120*0.3)=24 μm. In the case that the thickness of the elastic layer is twice 100 μm, the maximum difference of the image=100−(200*0.3)=40 μm.

These parameters give rise to the following expression. The difference of the image=(a thickness of the record medium−the total thickness of the elastic layer)*|sin θ|<42.3 μm (preferable)<100 μm (necessary). θ is an angle between the direction in which the record medium approaches into the nip N and the common tangent to the intermediate transfer member and the transfer fixing member.

In this embodiment described above, reduction of image quality of transferring the toner image caused by the record medium approaching the nip N is prevented, especially in a case of the toner image formed at a resolution of more than 600 dpi.

Furthermore, in the second modification of this embodiment in FIG. 17, the transfer fixing roller 36 is driven by the driving source (not illustrated), but is not driven by the pressing roller 14. The pressing roller 14 is driven by a driving source or by the transfer fixing roller 36. Thereby, a substantial increase of the driving radius of the pressing roller 14 caused by the record medium being a part on the pressing roller 14 is prevented, when the record medium reaches the nip N, compared with the case that the transfer fixing roller 36 is driven by the pressing roller 14. Therefore, a change of a line speed on the surface of the transfer fixing roller 36 caused by a substantial increase of the driving radius of the pressing roller 14 is prevented. Then, reduction of image quality of transferring the toner image caused by the change of the line speed on the surface of the transfer fixing roller 36 is prevented.

The following is a detailed description regarding the effect described above. The difference of the image is maximized in the case that there is no elastic layer in the pressing roller 14. In this case, the difference of the image=the line speed of the transfer fixing roller 36*(a thickness of the record medium/the radius of the pressing roller 14 in the nip N)*transferring time in the nip between the intermediate transfer belt 2 and the transfer fixing roller 36=the transferring width in the nip between the intermediate transfer belt 2 and the transfer fixing roller 36*(a thickness of the record medium/the radius of the pressing roller 14 in the nip N)<42.3 μm (preferable)<100 μm (necessary).

In a case that the transferring width in the nip is less than 10 mm, the radius of the pressing roller 14 in the nip N is 20 mm, and a thickness of the record medium is 0.1 mm, the difference is less than 50 μm. In a case that the transferring width in the nip is less than 5 mm, the radius of the pressing roller 14 in the nip N is 20 mm, and a thickness of the record medium is 0.1 mm, the difference is less than 25 μm. Thereby, it is better to prevent the difference of the image when the transferring width in the nip is shorter. Further, it is better to prevent the influence of heat to the intermediate transfer belt 2 when the transferring width in the nip is shorter. In addition, in a case that a thickness of the record medium is about 0.1 mm, the following expression can satisfy the difference of the image to be less than 42.3 μm as a dot pitch in the image forming apparatus with a resolution of 600 dpi; the difference of the image=(the transferring width in the nip between the intermediate transfer belt 2 and the transfer fixing roller 36/the radius of the pressing roller 14 in the nip N)<=0.423.

According to the fifth embodiment described above, reduction of image quality of transferring the toner image caused by the record medium approaching into nip N is prevented, especially in a case of the toner image formed at a resolution more than 600 dpi.

Figure 18:
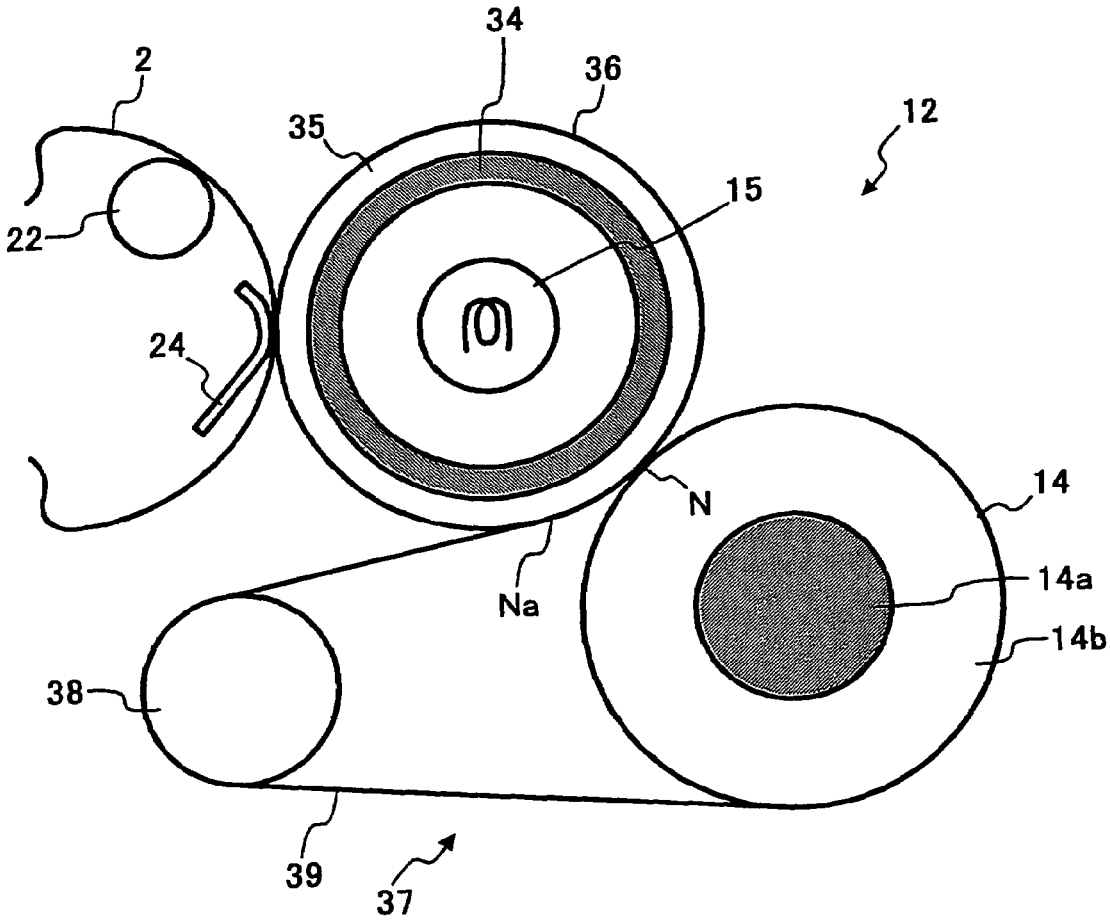
FIG. 18 is a schematic front view showing a sixth embodiment of the present invention.

FIG. 18 is a schematic front view showing a sixth embodiment. The embodiment includes a pressing member 37 including the pressing roller 14, a supporting roller 38, and a pressing belt 39 supported by the pressing roller 14 and the supporting roller 38. The transfer fixing roller 36 and the pressing belt 39 form an upstream nip Na and a downstream nip N in the direction in which the record medium is passing. The upstream nip Na is pressed by the tension of the pressing belt 39; the downstream nip N is pressed by the pressure of the pressing roller 14. The pressure of the pressing roller 14 and the tension of the pressing belt 39 are set up so the pressure at the upstream nip Na is weaker than the pressure at the downstream nip N.

In this embodiment, the record medium is pressed in the upstream nip Na with a weaker pressing, before pressed in the downstream nip N with a stronger pressing. Thereby, the record medium can smoothly approach the downstream nip N, and vibrations caused by the record medium approaching the nip are reduced. In addition the vibration is further reduced because of the same reason as in the fifth embodiment based on the elastic layer 35 in the transfer fixing roller 36. Therefore, reduction of image quality of transferring the toner image caused by the record medium approaching the nip N is prevented, especially in case of a thick record medium.

Further, the width of the nip Na can be less than 5 mm. Thereby, a rumple that arises on the thin record medium caused by the weaker pressure in the nip Na is prevented. Thereby, reduction of image quality of transferring the toner image caused by the rumple on the record medium is prevented, especially in a case of a thin record medium.

Figure 19:
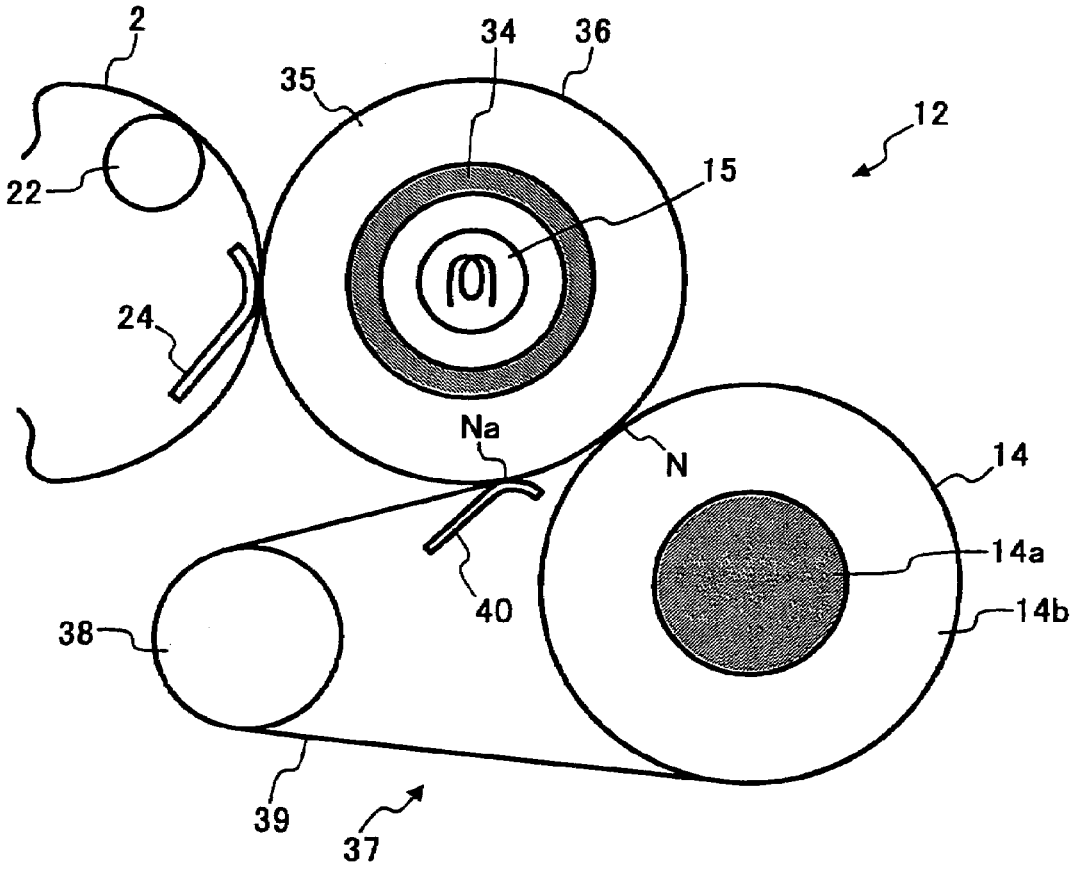
FIG. 19 is a schematic front view showing a modification of the sixth embodiment.

FIG. 19 is a schematic front view showing a modification of this embodiment in which inside the pressing belt 39 a board spring 40 is provided at the upstream nip Na. In this modification it is easy to regulate the pressure in the nip Na by regulating the pressure of the board spring 40.

Figure 20:
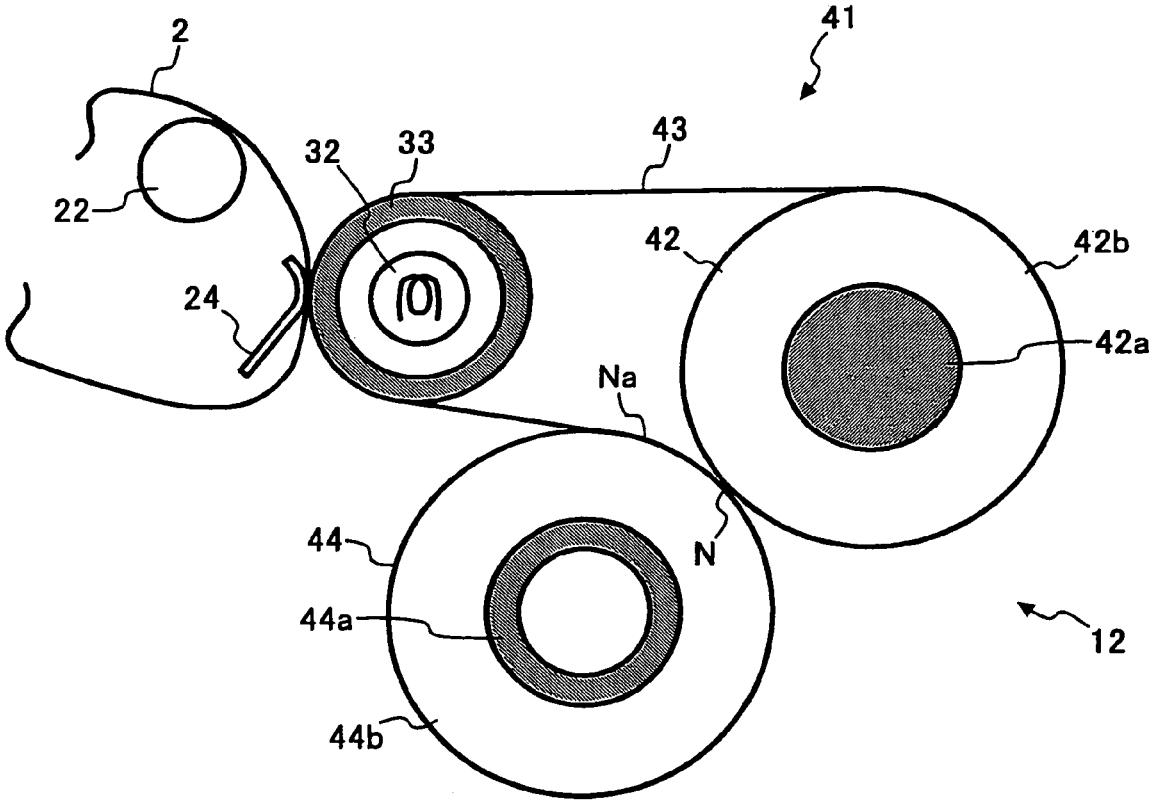
FIG. 20 is a schematic front view showing a second modification of the sixth embodiment.

FIG. 20 is a schematic front view showing a second modification of this embodiment in which a transfer fixing member 41 includes the heating roller 33, a supporting roller 42 including a metallic core 42*a* and an elastic layer 42*b*, and a transfer fixing belt 43 supported by the heating roller 33 and the supporting roller 42. A pressing roller 44 includes a metallic core 44*a* and an elastic layer 44*b*. The transfer fixing belt 43 and the pressing roller 44 form an upstream nip Na and a downstream nip N in the direction in which the record medium is passing. The upstream nip Na is pressed by the tension of the transfer fixing belt 43, and the downstream nip N is pressed by the pressure of the pressing roller 44. The pressure of the pressing roller 44 and the tension of the transfer fixing belt 43 are set up so that the pressure at the upstream nip Na is weaker than the pressure at the downstream nip N. Therefore, reduction of image quality of transferring the toner image caused by the record medium approaching the nip N is prevented.

Figure 21:
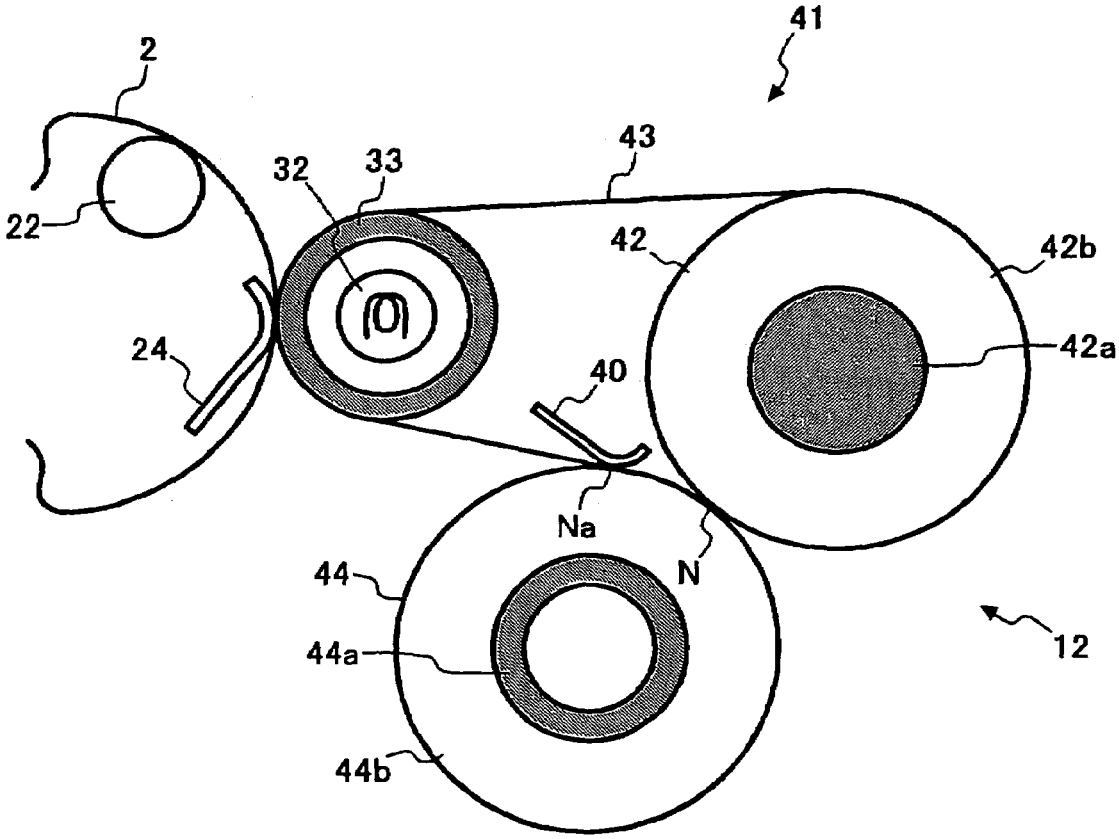
FIG. 21 is a schematic front view showing a third modification of the sixth embodiment.

FIG. 21 is a schematic front view showing a third modification of this embodiment in which inside the transfer fixing belt 43 a board spring 40 is provided that presses the upstream nip Na. In this modification it is easy to regulate the pressure in the nip Na by regulating the pressure of the board spring 40.

Figure 22:
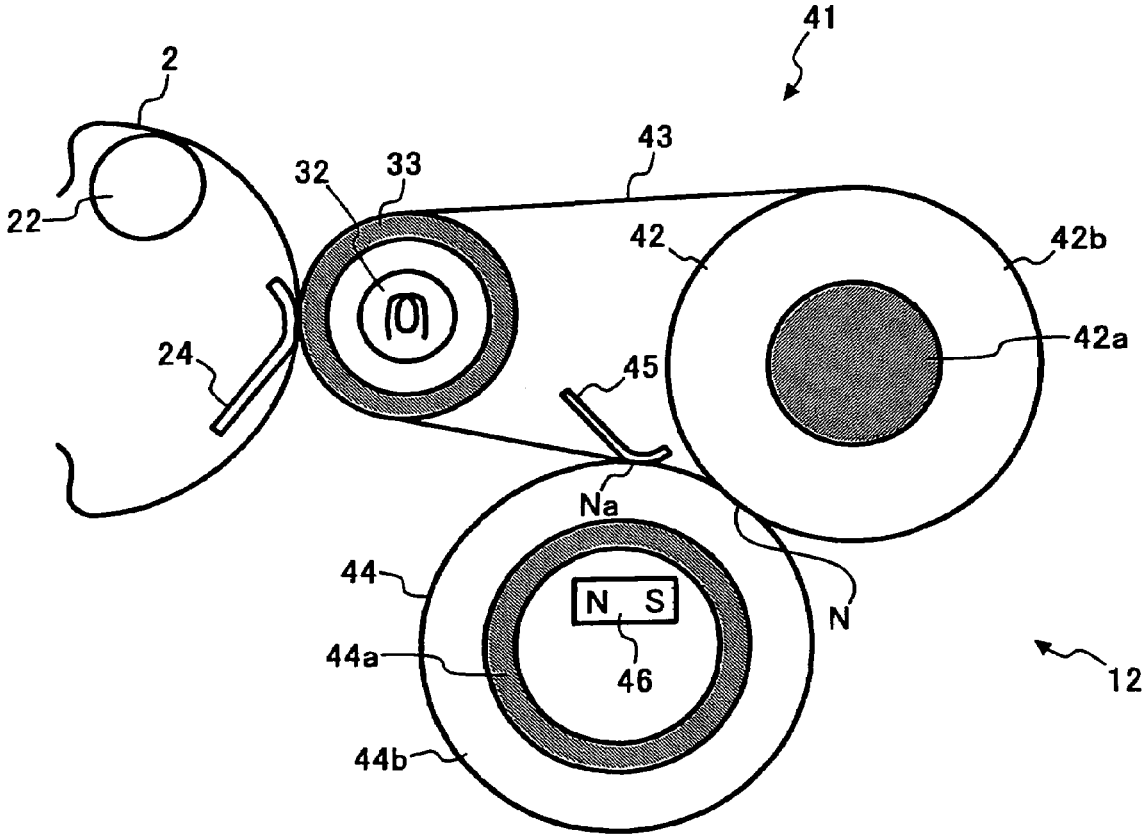
FIG. 22 is a schematic front view showing a fourth modification of the sixth embodiment.

FIG. 22 is a schematic front view showing a fourth modification of this embodiment, in which a magnetic body 45 is provided inside the transfer fixing belt 43, and the pressing roller 44 includes a magnet 46. The magnetic body 45 presses the upstream nip Na by the magnetism of the magnet 46. In this modification it is easy to regulate the pressure in the nip Na by regulating the magnetism of the magnet 46.

According to the sixth embodiment described above, reduction of image quality of transferring the toner image caused by the record medium approaching the nip N is prevented.

Figure 23:
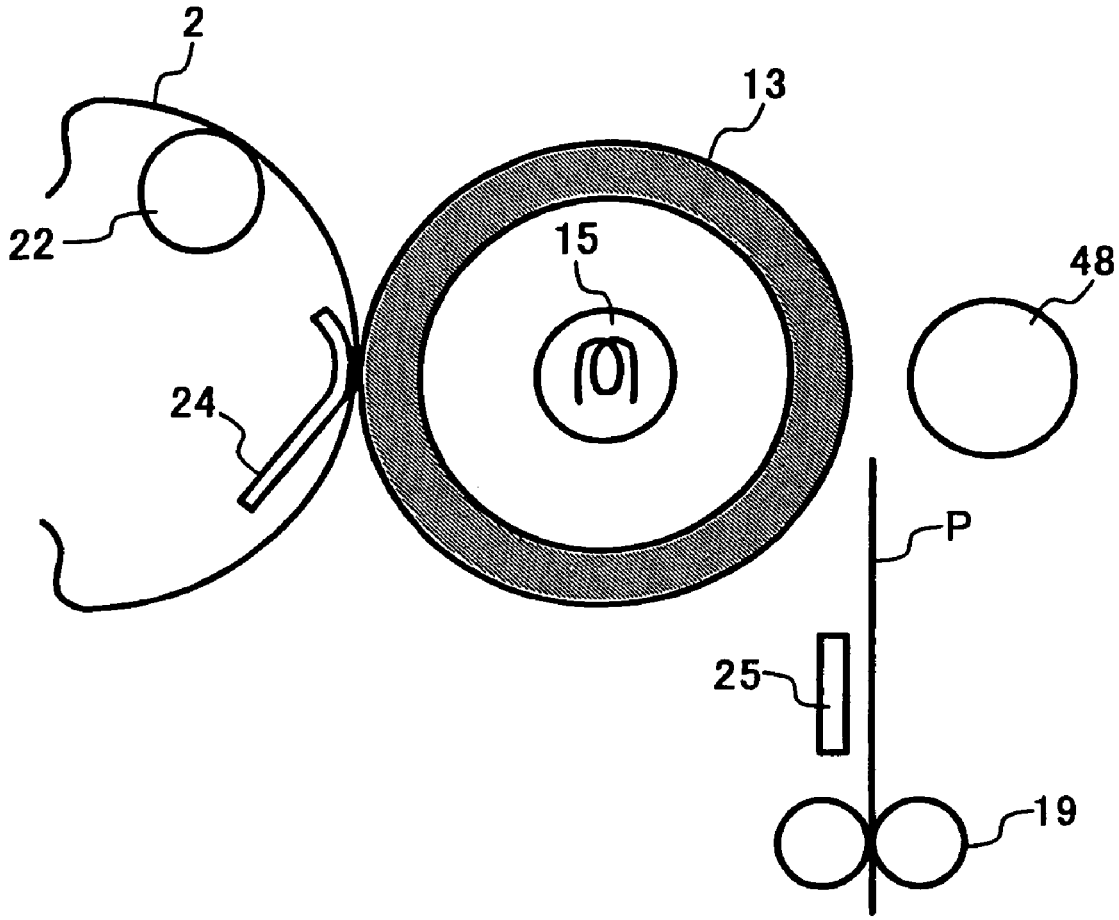
FIG. 23 is a schematic front view showing a seventh embodiment of the present invention.

FIG. 23 is a schematic front view showing a seventh embodiment. In this embodiment, a bias roller 48 as an opposite member 12 is provided separated from the transfer fixing roller 13 by at least a thickness of the record medium. The bias roller 48, which is supplied a bias by an adhesive power supplying member (not illustrated), supplies electrostatic adhesive power to the record medium P. Thereby, the toner image on the transfer fixing roller 13 is transferred and fixed onto the record medium P by the electrostatic adhesive power. Therefore, reduction of image quality of transferring the toner image caused by the record medium approaching into the nip N is prevented, because there is no vibration when the record medium reaches the nip N.

In this embodiment further, the heater 25 heats the record medium P before reaching the nip N. That prevents the toner image transferred onto the record medium from losing too much heat by the record medium. Thereby, the toner image is certainly fixed on the record medium. Further, it is possible to control minutely the fixing and adhering conditions of the toner image on the record medium P.

Figure 24:
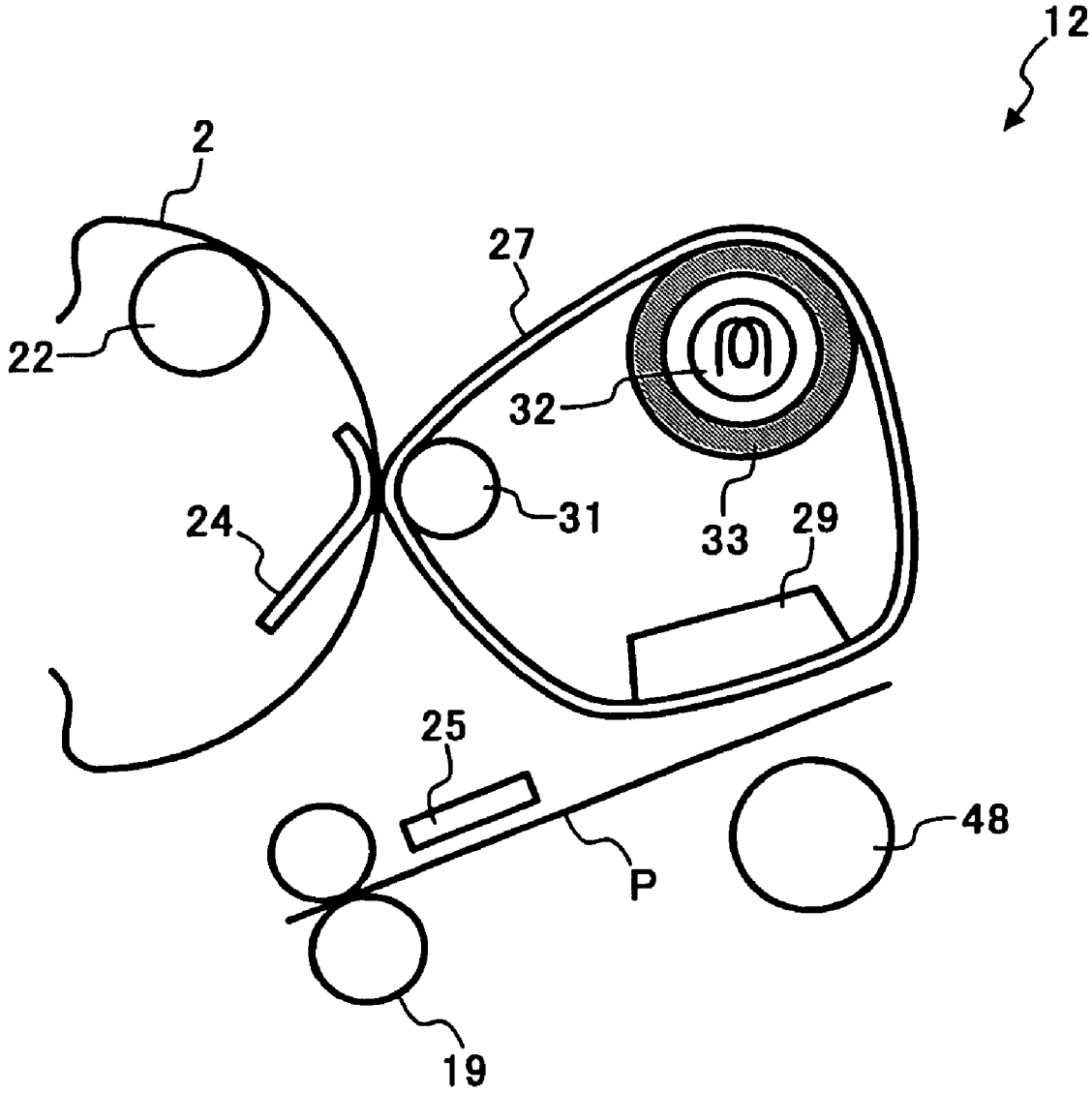
FIG. 24 is a schematic front view showing a modification of the seventh embodiment.

FIG. 24 is a schematic front view showing a modification of the seventh embodiment, using the flexible transfer fixing member 27 as in the earlier described modifications. The effect of this modification is the same as in the embodiment in FIG. 23.

According to the seventh embodiment described above, reduction of image quality of transferring the toner image caused by the record medium approaching the nip N is prevented. Further, it is possible to control minutely the fixing and adhering conditions of the toner image on the record medium.

Figure 25:
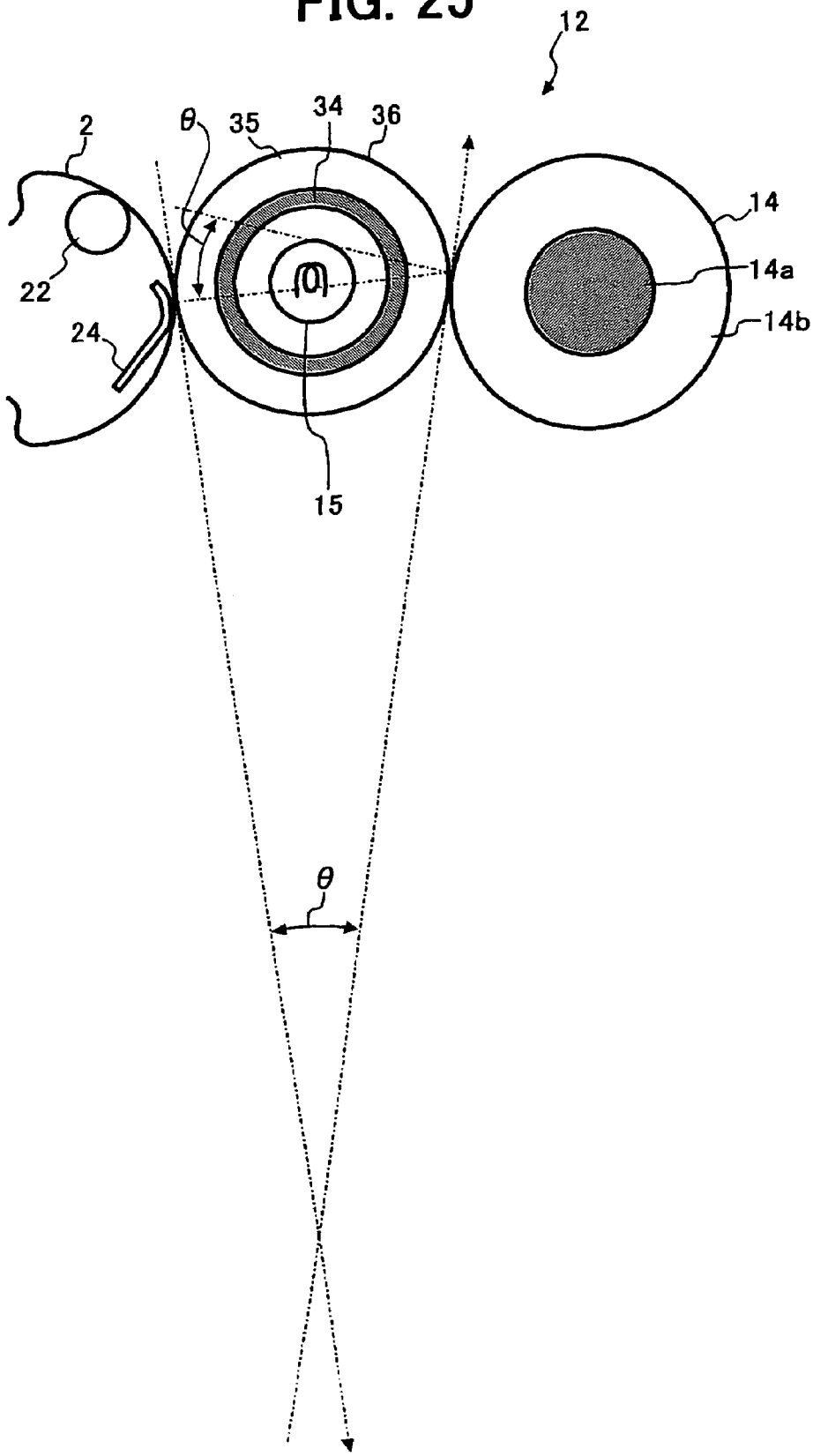
FIG. 25 is a schematic front view showing an eighth embodiment of the present invention.

FIG. 25 is a schematic front view showing an eighth embodiment. In this embodiment, the direction in which the record medium approaches the nip N is substantially parallel to the common tangent to the intermediate transfer belt 2 and the transfer fixing roller 36. According to the description in the fifth embodiment, the difference of the image=(a thickness of the record medium−the total thickness of the elastic layer)*|sin θ|<42.3 μm (preferable). In a case of the total thickness of the elastic layer=0, the thickness of the record medium=60 to 100 μm, θ satisfying this expression is within ±45° or ±25°. Thereby, substantially parallel means within ±45°, or ±25° in a case of a thicker record medium. In this embodiment, reduction of image quality of transferring the toner image caused by the record medium approaching the nip N is prevented.

Figure 26:
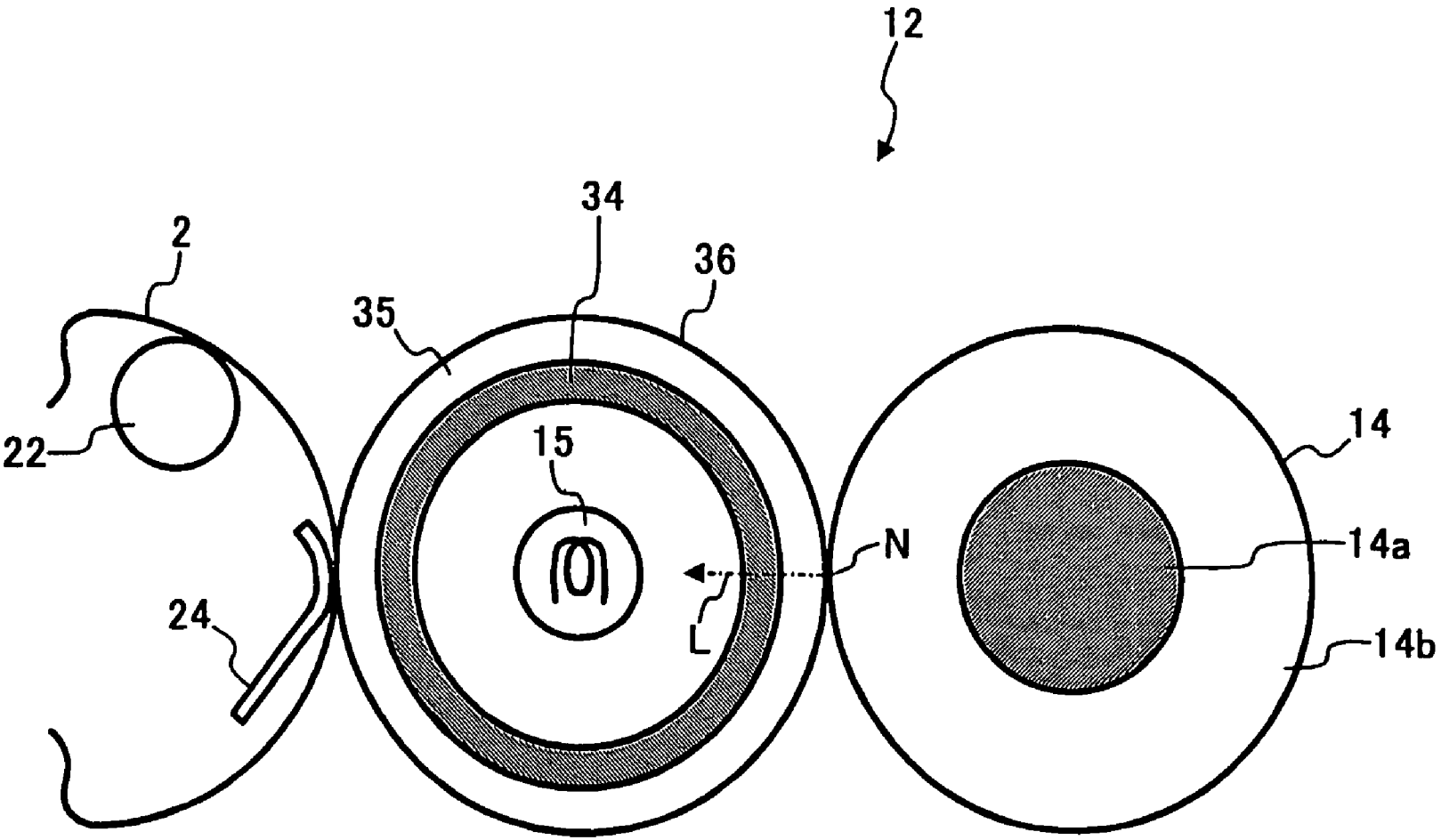
FIG. 26 is a schematic front view showing a modification of the eighth embodiment.

FIG. 26 is a schematic front view showing a modification of this embodiment. In this modification, the direction in which the record medium approaches the nip N is parallel to the common tangent to the intermediate transfer belt 2 and the transfer fixing roller 36. Thereby, it is more certain that reduction of image quality of transferring the toner image caused by the record medium approaching the nip N is prevented, because the vibration direction L does not affect the difference of the toner image transferred. Further, in this modification, the toner image on the transfer fixing roller 36 is heated longer. Thereby, it is possible to make the transfer fixing roller 36 smaller.

According to the eighth embodiment described above, reduction of image quality of transferring the toner image caused by the record medium approaching into the nip N is prevented.

Figure 27:
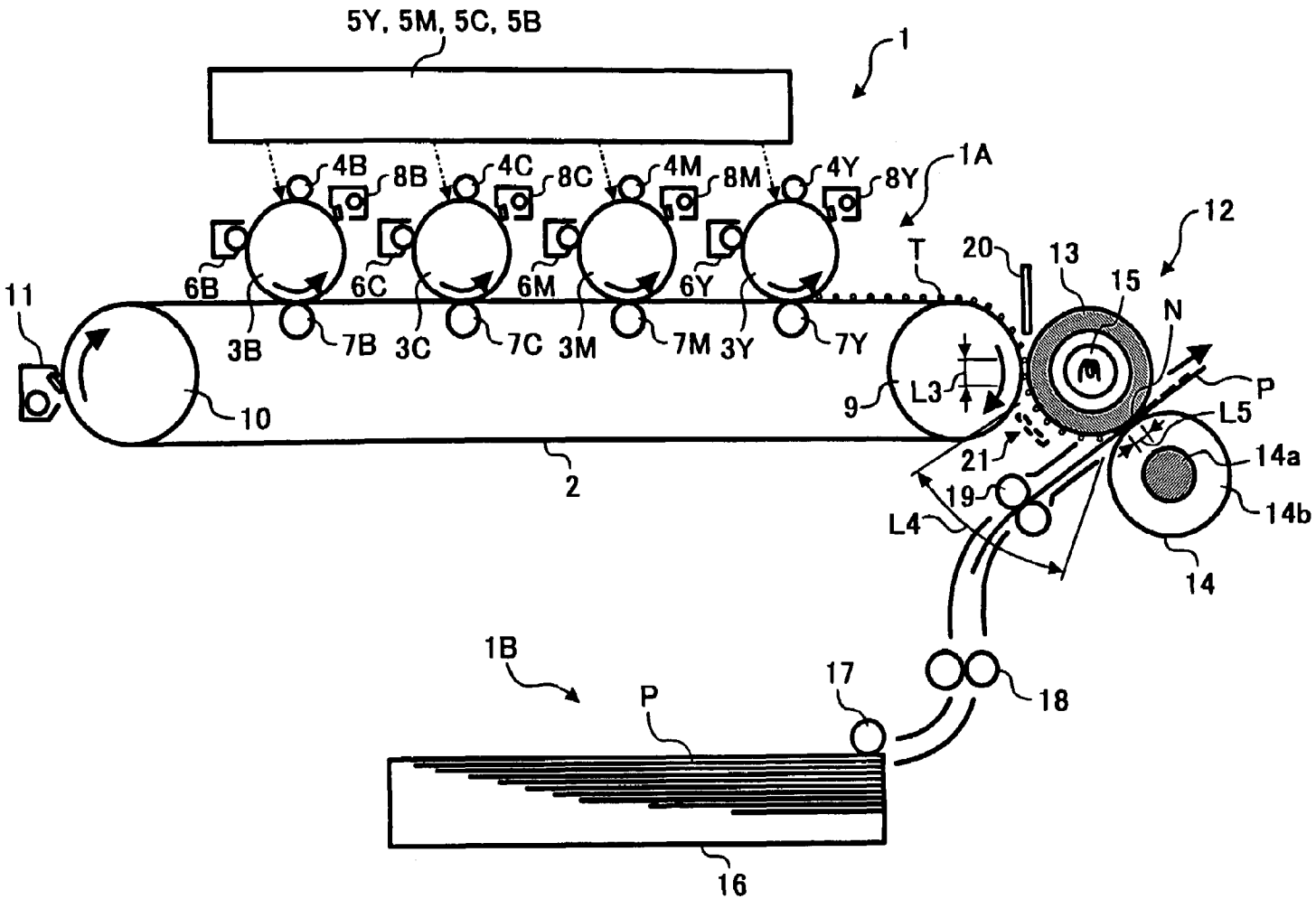
FIG. 27 is a schematic front view showing a ninth embodiment of the present invention.

FIG. 27 is a schematic front view showing a ninth embodiment. In this embodiment, outside the transfer fixing roller 13, an outer heating member 21 is arranged to heat the toner image on the transfer fixing roller 13 from the surface side of the toner image. The surface side of the toner image on the transfer fixing roller 13 is the side with the toner image fixed on the record medium. The halogen heater 15 as an inner heating member heats the toner image on the transfer fixing roller 13 from the surface side of the transfer fixing roller 13.

According to the structure described above, it is possible to heat the surface of the toner image on the transfer fixing member not based on the thickness of the toner image. Further, it is possible to control the interface between the toner image and the record medium, because the toner image on the transfer fixing roller 13 is heated from outside. Thereby, it is possible to control minutely the fixing and adhering conditions of the toner image on the record medium. Further, that prevents the toner image from being excessively heated from the transfer fixing roller 13 to prevent melting the outside of the toner image on the transfer fixing roller 13. Thereby, a luster of the toner image fixed on the record medium is prevented from being damaged by excessive heating.

Further in this embodiment, it is possible to control both the luster and the adhesion degree of the toner image on the record medium, because the toner image on the transfer fixing roller 13 is heated from both the side of the transfer fixing roller 13 and outside. In other words, it is possible to control the temperature gradation along the thickness direction of the toner image.

In this embodiment, the outer heating member 21 is formed as a metallic heating board with a relatively lower radiation rate. The transfer fixing roller 13 is preferably formed transparently. Thereby, the outer heating member 21 can effectively reflect the heat that the transfer fixing roller 13 transmits to the outside. Therefore, it is possible to effectively use the heat by the halogen heater 15 to heat the toner image from the outside.

Figure 56:
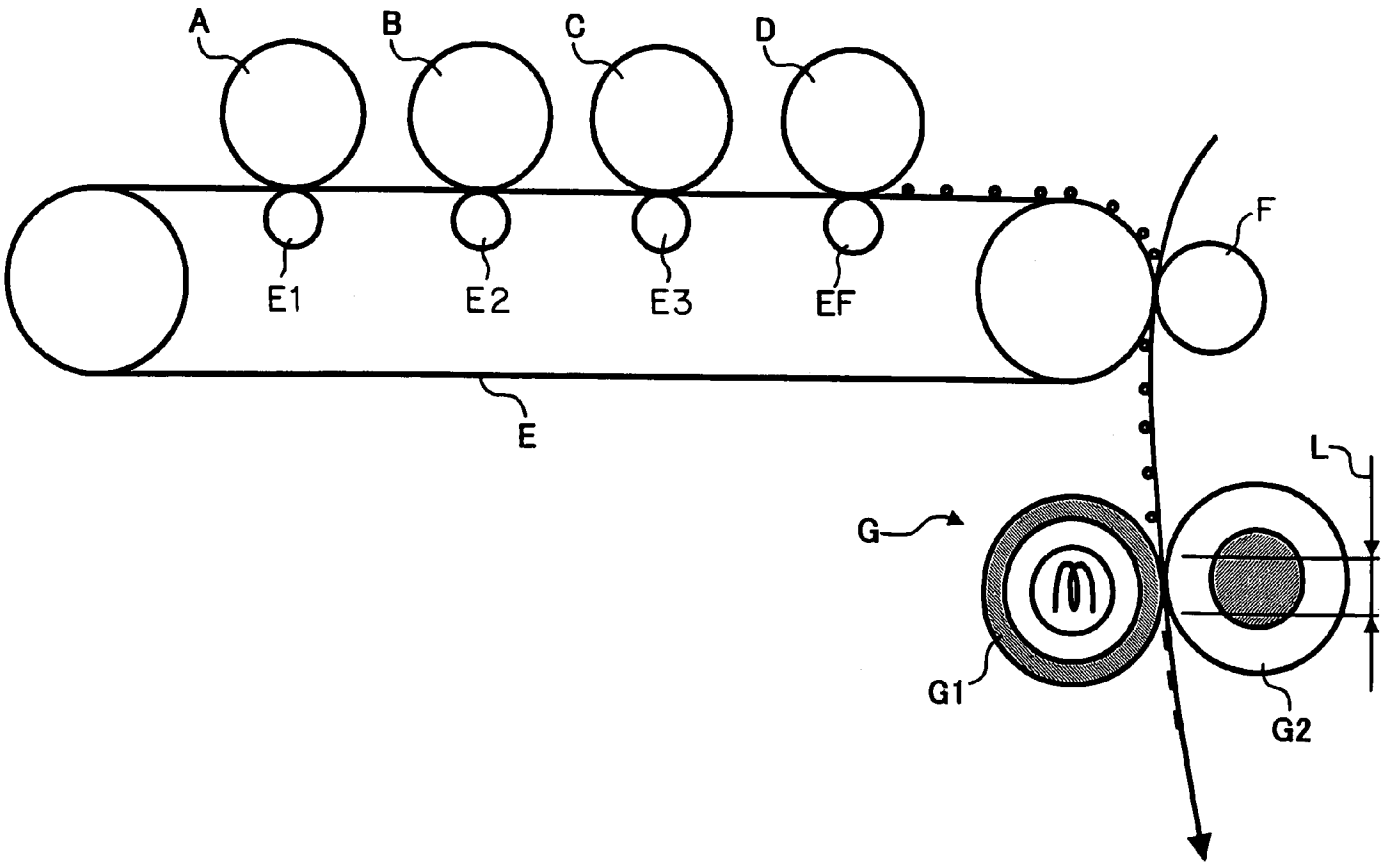
FIG. 56 BACKGROUND ART
FIG. 56 shows the structure in a background image forming apparatus.
Figure 57:
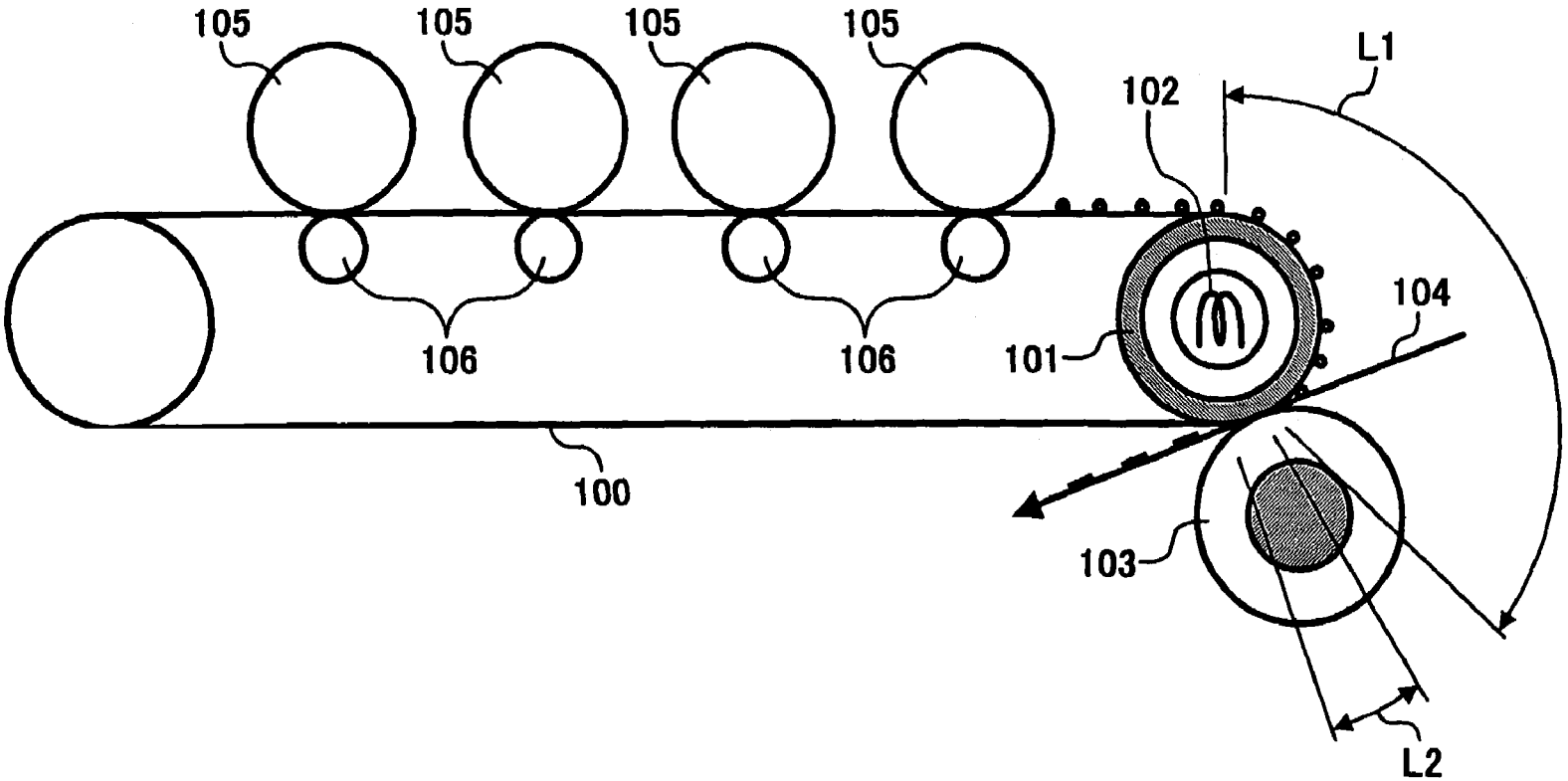
FIG. 57 BACKGROUND ART
FIG. 57 shows the structure published in Japanese Published Unexamined Patent Application No. Hei 10-63121

The following describes a comparison of this embodiment in FIG. 27 with the background art in FIG. 56 and FIG. 57. L in FIG. 56, $L_1$ in FIG. 57, and L4 in FIG. 27 show the time while the toner image is heated. As thereby shown, the toner image in this embodiment is heated longer than the background art in FIG. 56, and as long as the background art in FIG. 57. L in FIG. 56, L2 in FIG. 57, and L5 in FIG. 27 show the time while the record medium is heated. As thereby shown, the record medium in this embodiment is heated as long as the background arts in FIG. 56 and FIG. 57. L1 in FIG. 57 and L3 in FIG. 27 show the time while the intermediate transfer member is heated. As thereby shown, the intermediate transfer member in this embodiment is heated shorter than the background art in FIG. 57.

Figure 28:
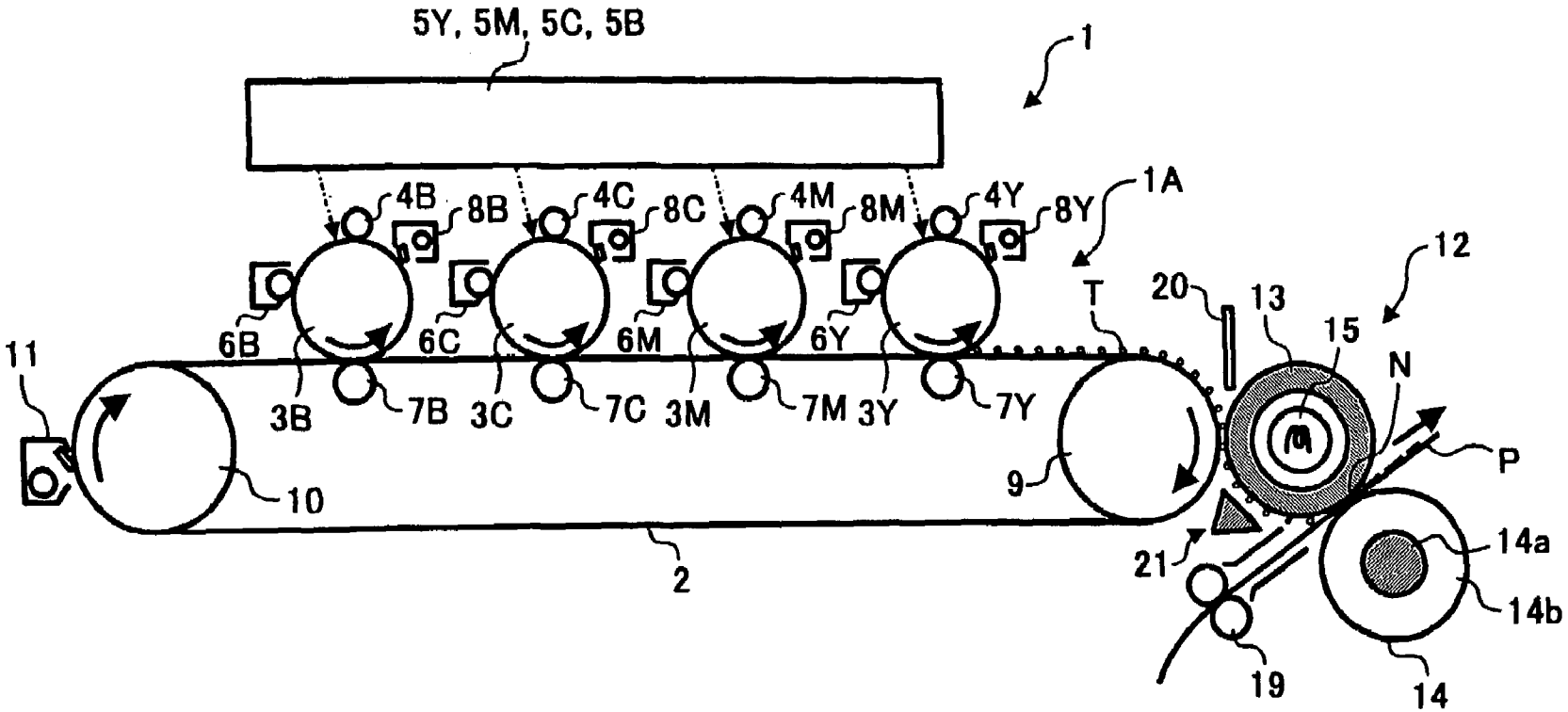
FIG. 28 is a schematic front view showing a modification of the ninth embodiment.

FIG. 28 is a schematic front view showing a modification of this embodiment in which the outer heating member 21 is not a board but a thicker member.

Figure 29:
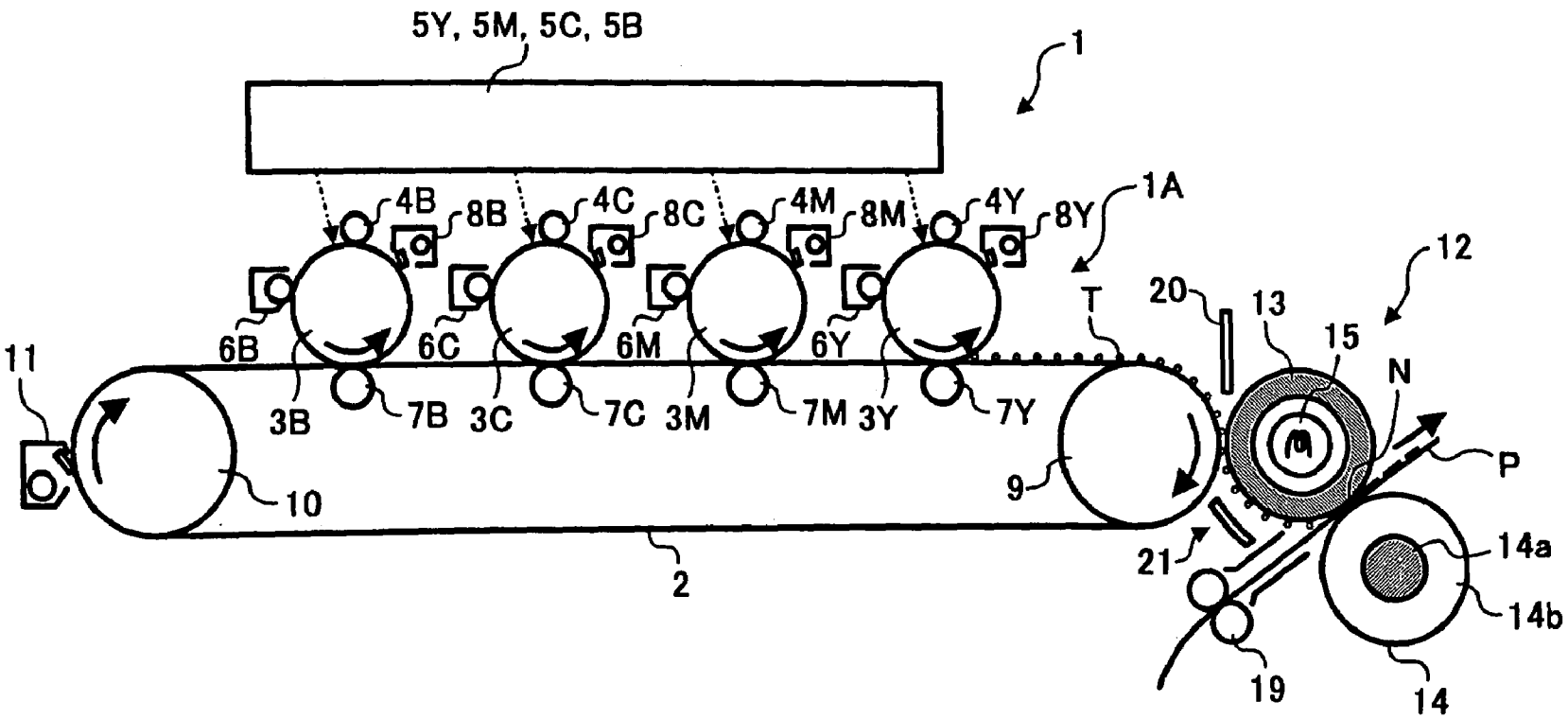
FIG. 29 is a schematic front view showing a second modification of the ninth embodiment.

FIG. 29 is a schematic front view showing a second modification of this embodiment in which the outer heating member 21 is formed as a heating board with a higher radiation rate. The outer heating member 21 generates heat itself by electric power. The outer heating member 21 preferably includes a black coating on the surface facing the transfer fixing roller 13. Thereby, the radiation rate of the outer heating member 21 is further increased.

Further a heating control member (not illustrated) can be provided, which continuously or gradually changes heating values both by the halogen heater 15 and by the outer heating member 21. The heating control member can also change the ratio between the heating value of the halogen heater 15 and of the outer heating member 21. The heating control member can change the heating value based on a kind of the record medium, a thermal capacity of the record medium, an amount of the toner, a thickness of the toner image, a kind of toner image, etc. The heating control member can also change the above mentioned ratio based on a kind of the record medium, a thermal capacity of the record medium, an amount of the toner, a thickness of the toner image, a kind of toner image, etc. The heating control member preferably gives priority to the heat by the outer heating member 21 to improve the toner image fixing on the record medium. Thereby, it is possible to control minutely both the luster and the adhesion degree of the toner image on the record medium.

Figure 30:
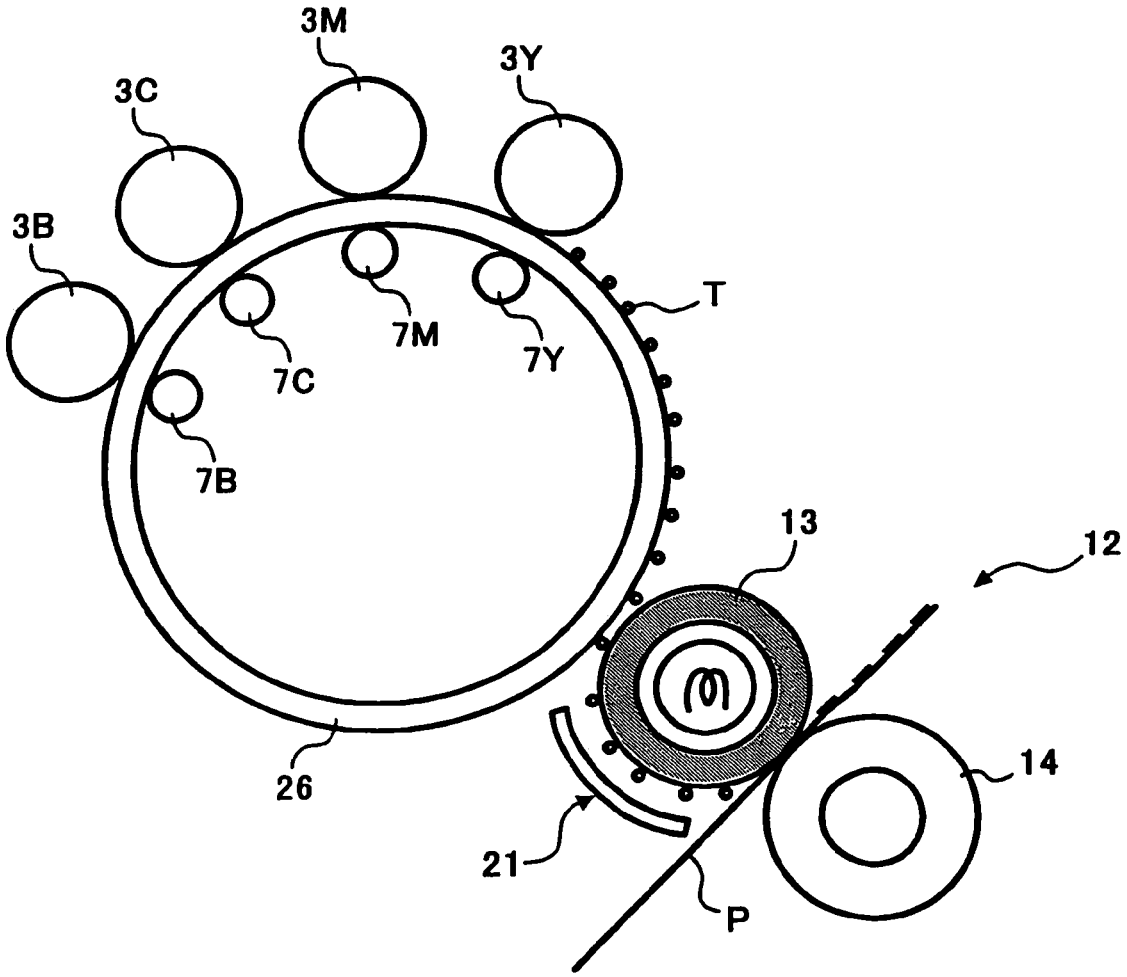
FIG. 30 is a schematic front view showing a third modification of the ninth embodiment.

FIG. 30 is a schematic front view showing a third modification of this embodiment in which the intermediate transfer belt 2 is exchanged for an intermediate transfer member 26 formed of a cylinder as described in the first embodiment.

According to the ninth embodiment, it is possible to control minutely the fixing and adhering conditions of the toner image on the record medium. Further, the luster of the toner image fixed on the record medium is prevented from being damaged by excessive heating. In addition, it is possible to control both the luster and the adhesion degree of the toner image on the record medium, and it is possible to control the temperature gradation along the thickness direction of the toner image.

Figure 31:
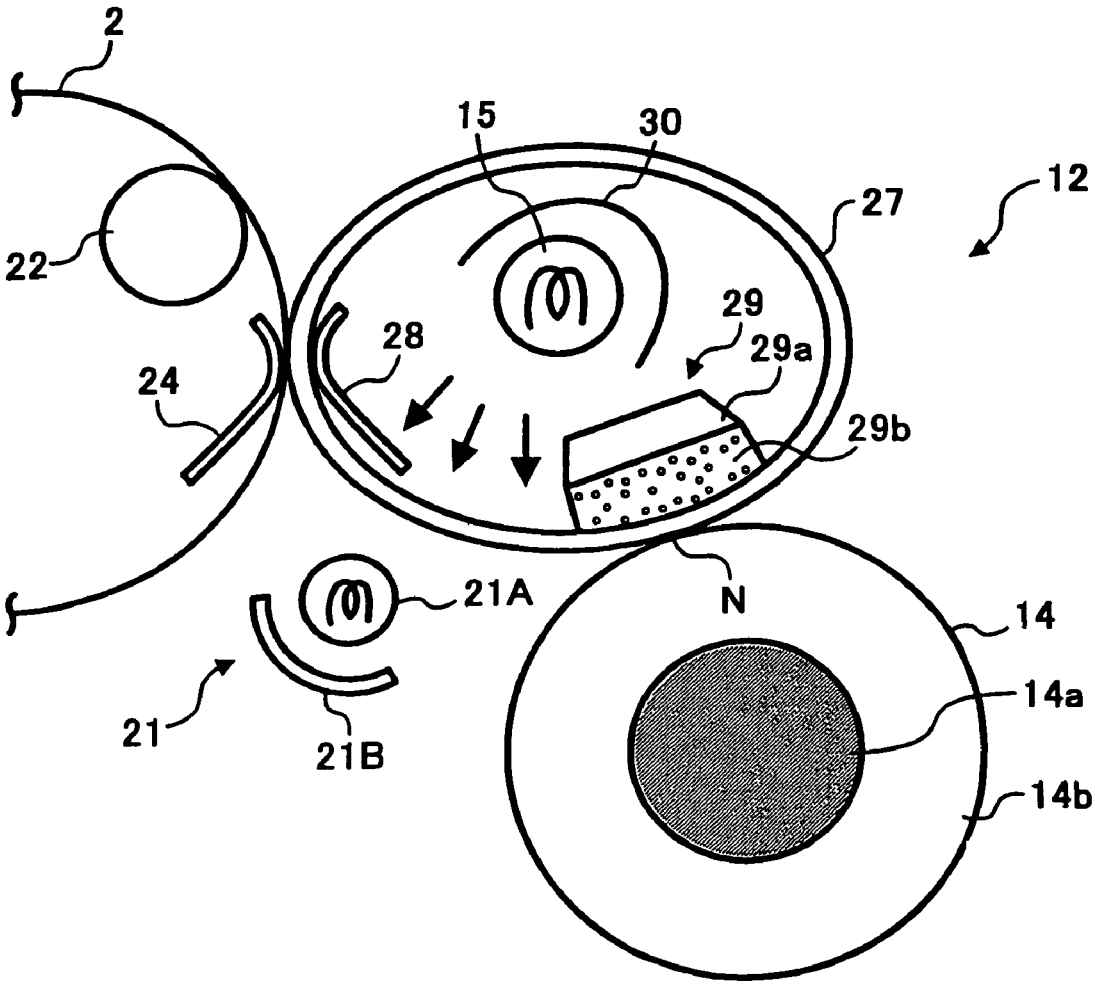
FIG. 31 is a schematic front view showing a tenth embodiment of the present invention.

FIG. 31 is a schematic front view showing a tenth embodiment. In this embodiment the outer heating member 21 includes a radiating heater 21A as a halogen heater and a reflector 21 B that reflects the heat radiated by the radiating heater 21 A to the transfer fixing member 27. Thereby, the outer heating member 21 radiates the toner image on the transfer fixing member 27 from the surface side of the toner image.

In this embodiment, it is easy to concentrate the heat energy on the toner image on the transfer fixing member 27, because the toner image is radiated by the outer heating member 21. Thereby, it is possible to increase heating efficiency to the toner image, and it is possible to control minutely the fixing and adhering conditions of the toner image on the record medium. Further, the surface of the transfer fixing member 27 is preferably formed by a material with a high reflective rate. Thereby, there is nothing to absorb the radiation by the outer heating member 21 except for the toner on the transfer fixing member 27, and then the toner absorbs the radiation even more. The surface of the transfer fixing member 27 may be coated by black, but should not be formed transparent.

Figure 32:
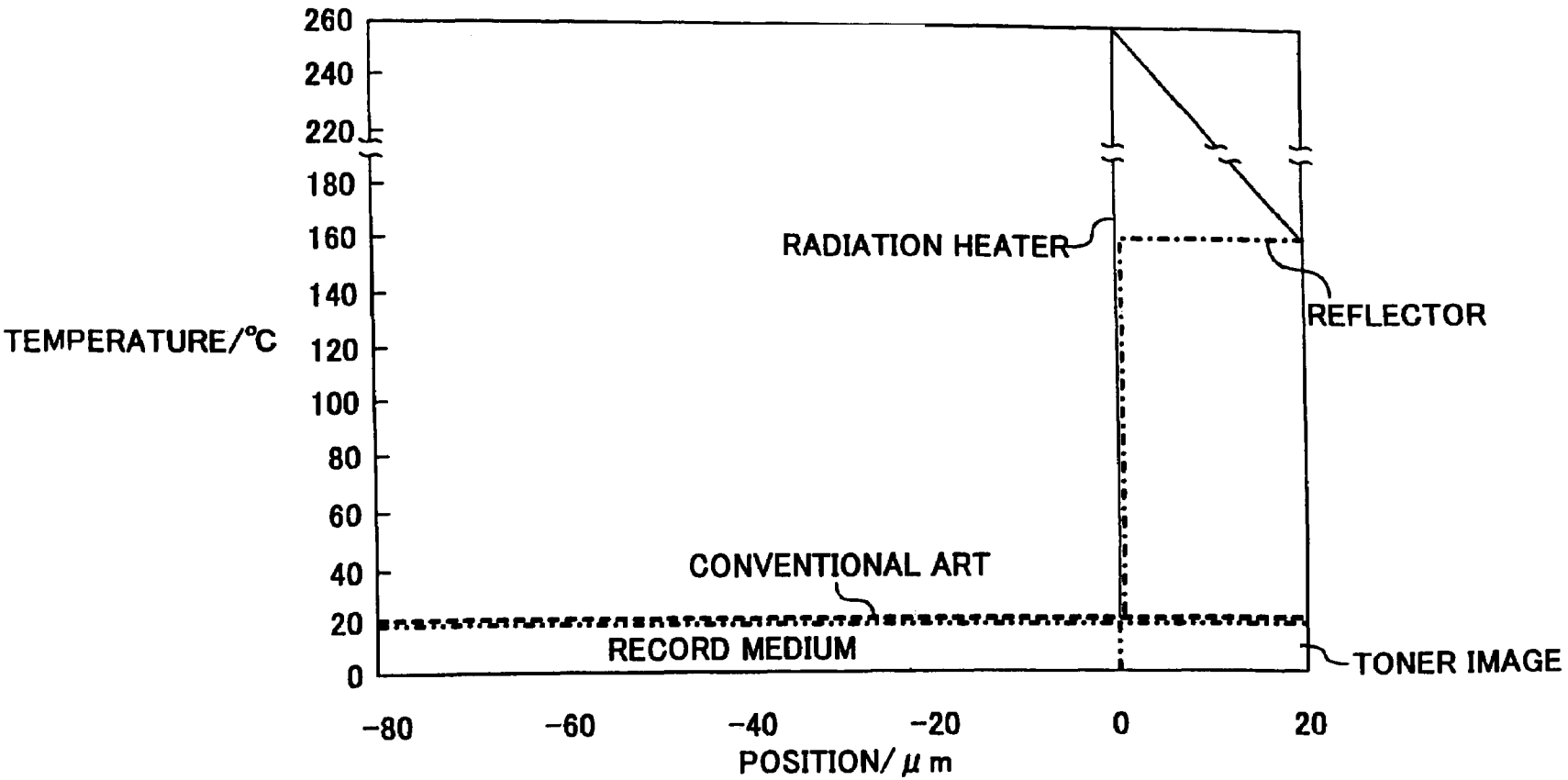
FIG. 32 is a view showing temperature distribution in the toner image and the record medium in a direction of thickness just before the toner image is fixed onto the record medium in the nip in the tenth embodiment.

FIG. 32 is a view showing the temperature distribution in the toner image and the record medium in the direction of the thickness just before the toner image is fixed onto the record medium in the nip. FIG. 32 includes each temperature distribution of the background art in FIG. 56, the tenth embodiment in FIG. 28, and this embodiment in FIG. 31. The "0" side in the toner image means the side of the toner image fixed onto the record medium, and the surface side of the toner image on the transfer fixing member. FIG. 32 shows experimental results carried out in the condition that the transfer fixing or fixing member and the pressing member both include a gum layer and a releasing layer, and the temperature inside the gum layer in the transfer fixing member is 160° C., and the temperature inside the gum layer in the pressing member is 100° C.

According to FIG. 32, the temperature distribution in the direction of the thickness of the toner image in the background art is equally and as high as the record medium. The temperature distribution in the direction of the thickness of the toner image in this embodiment is equally and much higher than the record medium. The temperature distribution in the direction of the thickness of the toner image in this embodiment is that the temperature of the surface side is higher than the opposite side, and much higher than the record medium.

The following describes the temperature distribution in the direction of the thickness of the toner image on the record medium just after the record medium reaches the nip, based on the results in FIG. 32. In this embodiment, the temperature of the fixing side in the toner image becomes lower than the opposite side, because the record medium directly takes the heat from the fixing side, but does not directly take the heat from the opposite side. The fixing side of the toner image does not keep the lower temperature than the opposite side, despite the record medium taking the heat from the fixing side.

Thus, in this embodiment, it is possible to control minutely the fixing and adhering conditions of the toner image on the record medium. In this view, the outer heating member 21 radiates heat to the toner image on the transfer fixing roller 13 without the halogen heater 15. Further it is possible to control both the luster and the adhesion degree of the toner image on the record medium, and it is possible to control the temperature gradation along the thickness direction of the toner image. In this view, the outer heating member 21 preferably radiates heat to the toner image on the transfer fixing roller 13 with the halogen heater 15.

Figure 33:
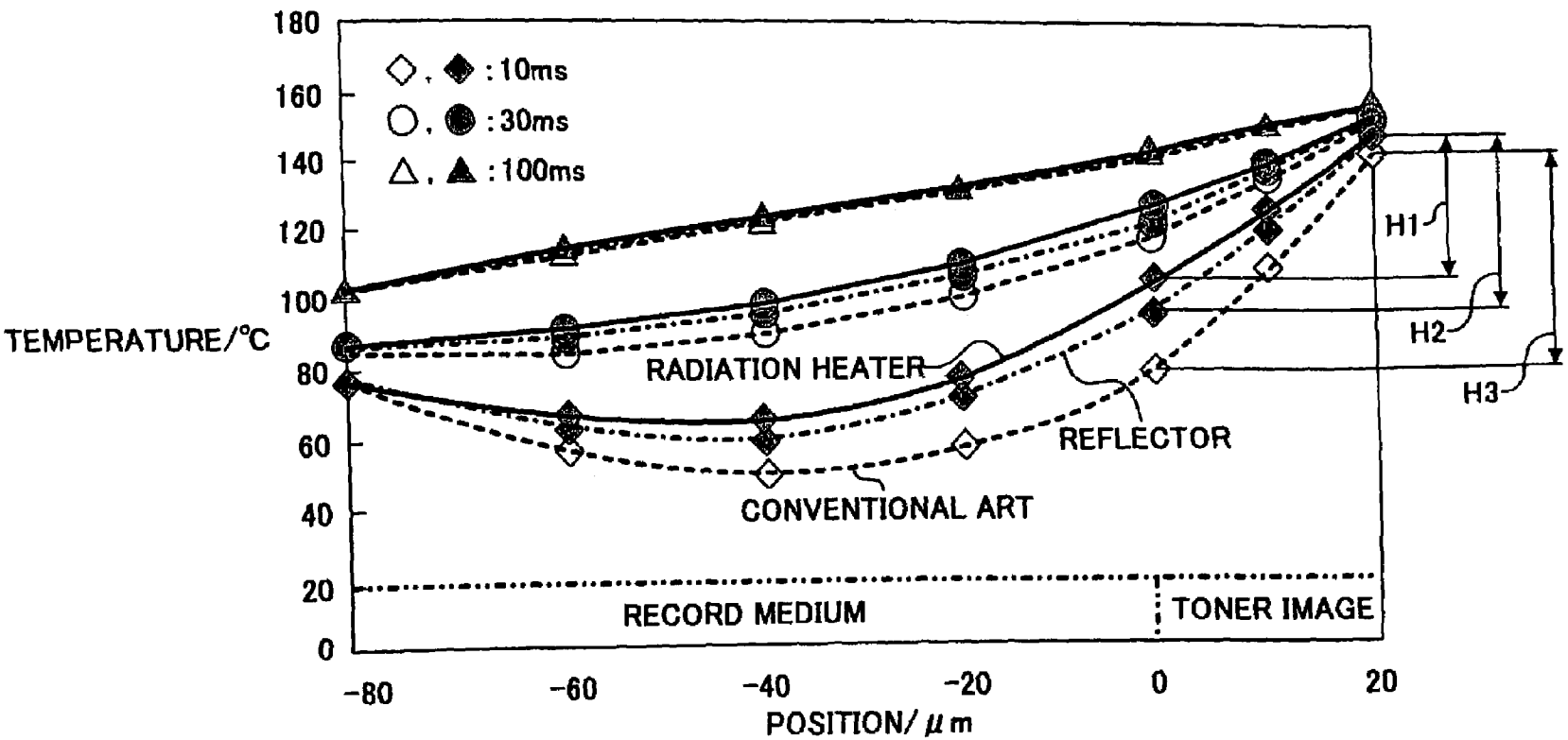
FIG. 33 is a view showing temperature distribution in the toner image and the record medium in a direction of the thickness in the tenth embodiment.
Figure 34:
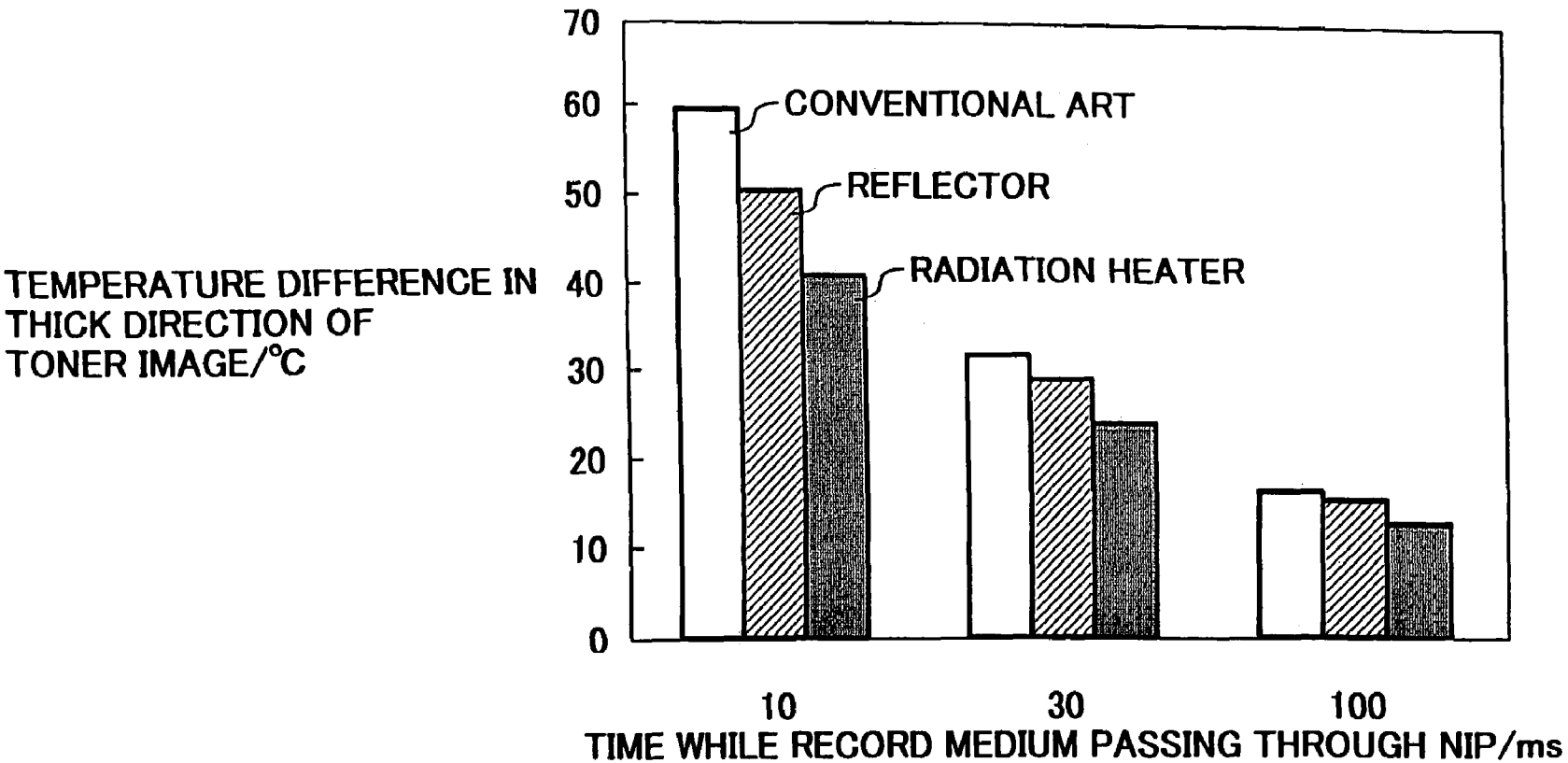
FIG. 34 is a view showing a temperature difference between a surface side and opposite side in the toner image on the record medium, based on FIG. 33 in the tenth embodiment.

FIG. 33 is a view showing the temperature distribution in the toner image and the record medium in the direction of the thickness according to the time 10 ms, 30 ms, 100 ms while the toner image and the record medium is passing through the nip. FIG. 33 includes each temperature distribution of the background art in FIG. 56, the eighth embodiment in FIG. 28, and this embodiment in FIG. 31. FIG. 34 is a view showing the temperature difference between the surface side and the opposite side in the toner image on the record medium, based on FIG. 33.

According to these FIGS. 33-34, the temperature difference in this embodiment is much smaller (H1<H2<H3). Further the temperature gap in this embodiment at 10 ms is almost the same as in the background art at 30~70 ms. Thereby, the toner image is prevented from returning to be transferred onto the fixing member caused by the larger temperature gap.

Further in this embodiment, it is possible to not excessively heat the toner image from the side of the fixing member. Thereby, the outer heating member 21 may radiate heat to dry the object, instead of radiating heat to melt the toner image. In this case, an ink is suitable as the object.

Figure 35:
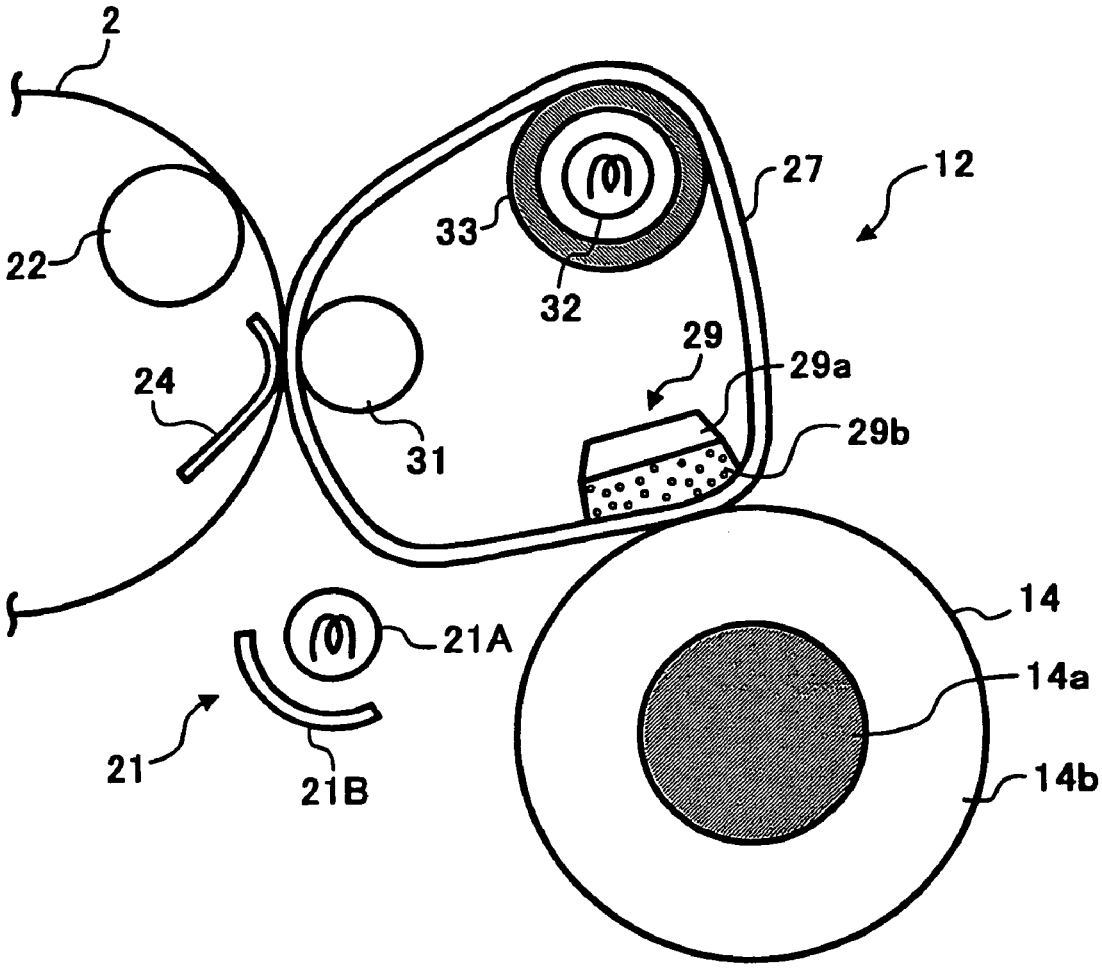
FIG. 35 is a schematic front view showing a modification of the tenth embodiment.

FIG. 35 is a schematic front view showing a modification of this embodiment. In this modification, the halogen heater 15 and the reflector 30 are exchanged for the halogen heater 32 and the heating roller 33, and the board spring 28 is exchanged for the supporting roller 31.

According to the tenth embodiment, it is possible to increase heating efficiency to the toner image, and it is possible to control minutely the fixing and adhering conditions of the toner image on the record medium.

Figure 36:
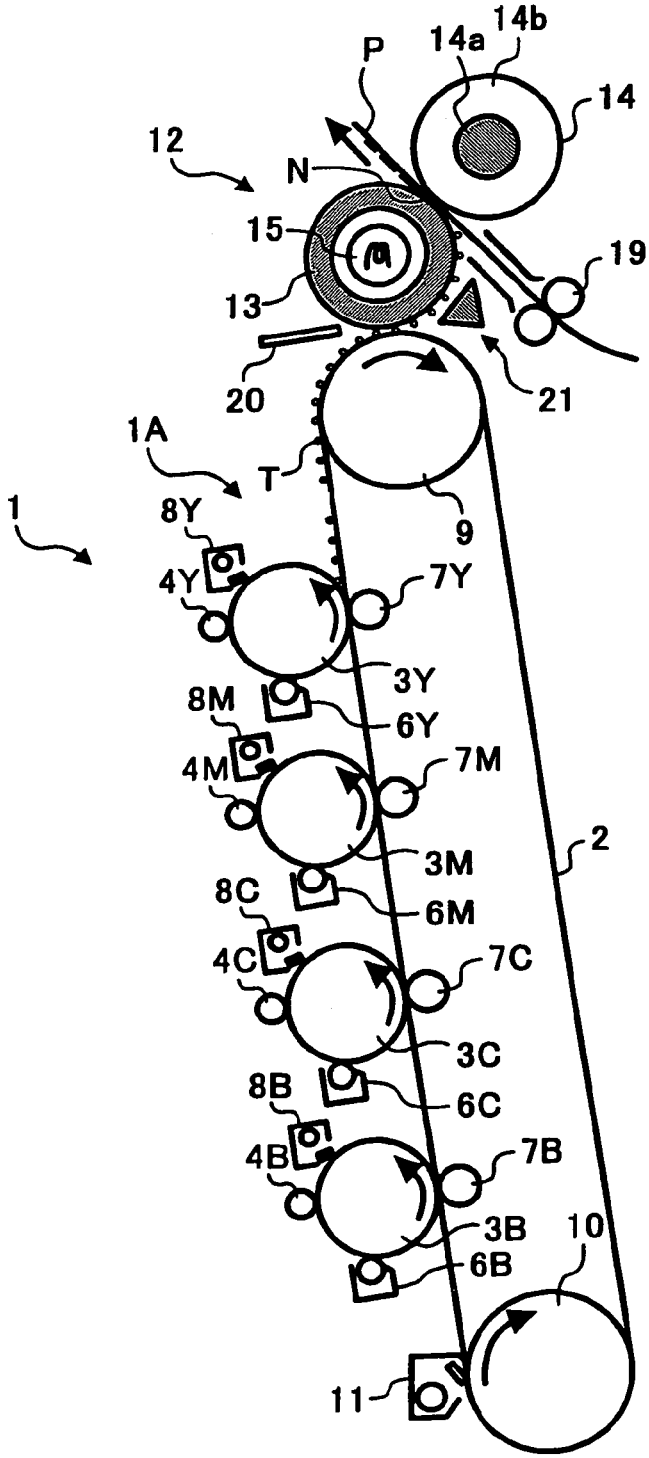
FIG. 36 is a schematic front view showing an eleventh embodiment of the present invention.

FIG. 36 is a schematic front view showing an eleventh embodiment. In this embodiment, the outer heating member 21 as a thick member is located above the intermediate transfer belt 2, and the transfer fixing roller 13 is located above the outer heating member 21. Thereby, heating of the intermediate transfer belt 2 by the transfer fixing roller 13 and the outer heating member 21 is reduced. Further, it is possible to heat the toner image on the transfer fixing roller 13 by heat convection between the transfer fixing roller 13 and the outer heating member 21, to thereby increase heating efficiency to the toner image.

Figure 37:
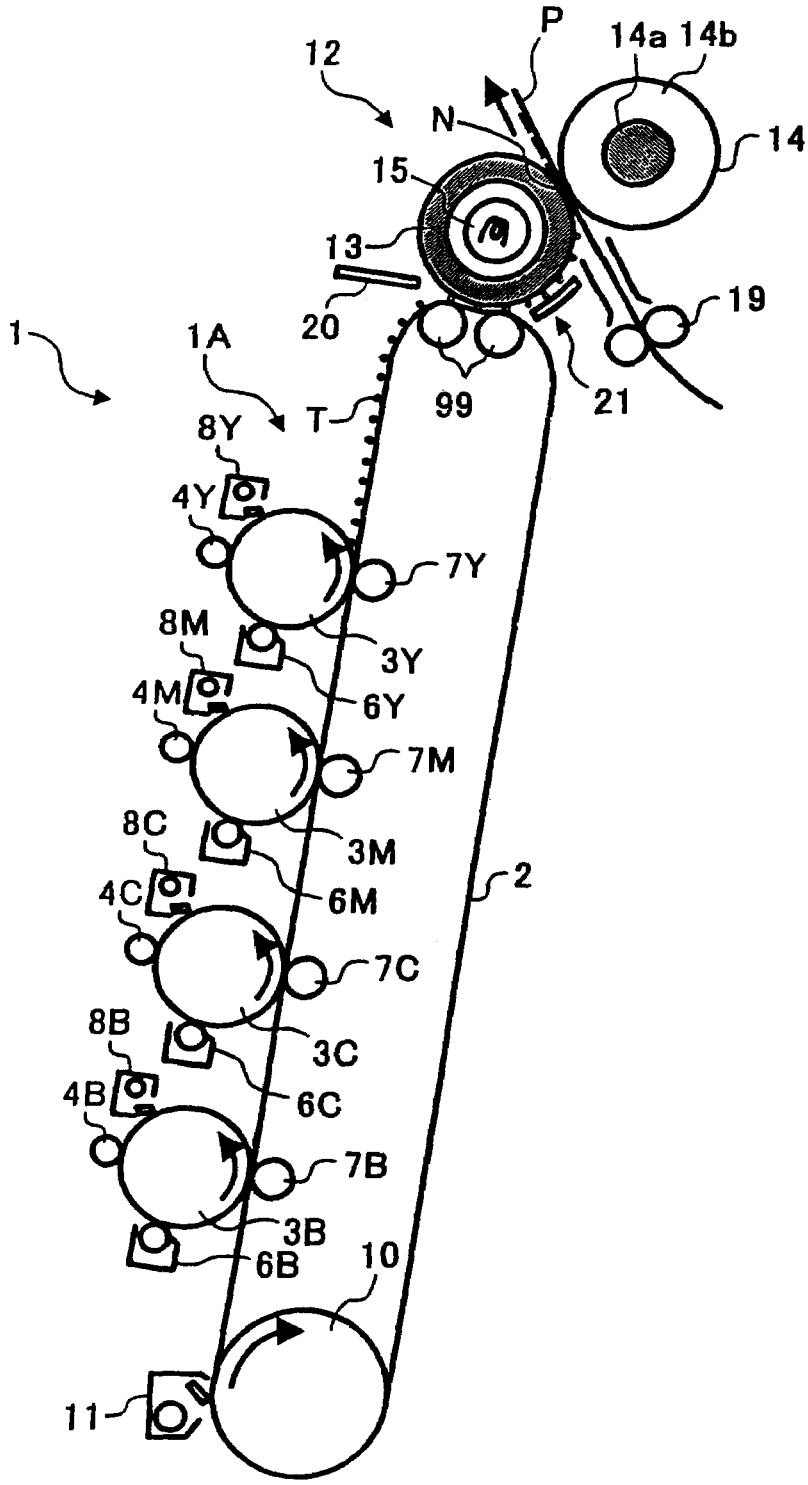
FIG. 37 is a schematic front view showing a modification of the eleventh embodiment.

FIG. 37 is a schematic front view showing a modification of this embodiment. In this embodiment, the outer heating member 21 is formed by a board, and the driving roller 9 is exchanged for a pair of driving rollers 99. The portion of the intermediate transfer belt 2 between the driving rollers 99 is transformed according to the surface of the transfer fixing roller 13. Further, the intermediate transfer belt 2 contacts the transfer fixing roller 13 from the opposite side to the pressing roller 14. Thereby, it is possible to heat the toner image on the transfer fixing roller 13 longer.

According to the eleventh embodiment, it is possible to efficiently heat the toner image, and it is possible to control the fixing and adhering conditions of the toner image on the record medium.

Figure 38:
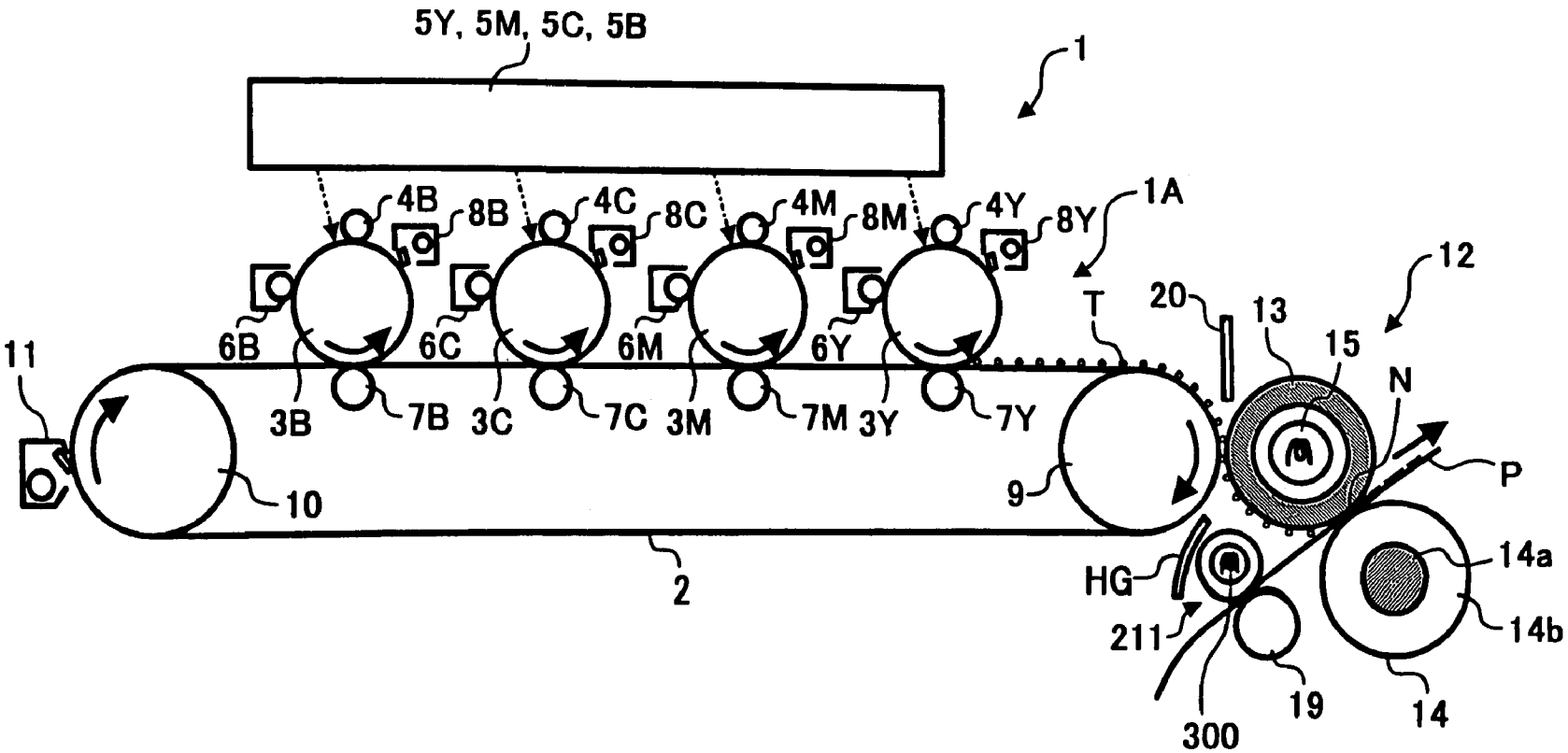
FIG. 38 is a schematic front view showing a twelfth embodiment of the present invention.

FIG. 38 is a schematic front view showing a twelfth embodiment. In this embodiment, the heating roller 211 as a heating member, which is located below the transfer fixing roller 13, heats the toner image on the transfer fixing roller 13 from the surface side of the toner image, and heats the record medium before it reaches the nip N. The heating roller 211 includes a radiant source 300 and a double transparent tube surrounding the radiant source 300. The double transparent tube includes a vacuum or decompression chamber between the outer tube and the inner tube. Further, the heating roller 211 forms a nip, where the record medium passes between itself and a resist roller 19. In addition, between the heating roller 211 and the transfer fixing roller 13 is arranged a heating preventing member, which protects the transfer fixing roller 13 from the heat from the heating roller 211.

In this structure, a toner dropped from the transfer fixing roller 13 is prevented from directly contacting the radiant source 300. That prevents emitting smoke or a burning smell caused by excessive heating of the toner. Further, the radiant source 300 can effectively radiate the toner image on the transfer fixing roller 13. Incidentally, in a case of calling the radiant source 300 a heating member, the double tube is a contact restraining member that transmits the heat radiation by the radiant source 300 and prevents the toner image from contacting the radiant source 300.

Further, the heating roller 211 heats the record medium P before reaching the nip N as a medium heating member. Thereby, it is possible to control the interface between the toner image and the record medium, because the toner image is prevented from taking too much heat by the record medium. Thereby, it is possible to control minutely the fixing and adhering conditions of the toner image on the record medium.

In addition, the radiant source 300 can be electrically turned on while the record medium is being transferred. Thereby, the heating roller 211 heats the toner image on the transfer fixing roller 13 while the record medium is being transferred. That prevents overheating around the heating roller 211 and wasting of energy.

Incidentally, in a case of calling the radiant source 300 a heating member or a medium heating member, the double tube is a movement restraining member that transmits the heat radiation by the radiant source 300 and prevents the record medium before reaching the nip N from moving to contact the radiant source 300. Further, the heating roller 211 and the resist roller 19 may be referred to as a heating member.

The heating roller 211 preferably heats the record medium with a radiation wavelength easily absorbed by cellulose in a short time. Thereby, it is possible to efficiently heat just the interface but not all of the record medium whose thermal capacity is large.

Figure 39:
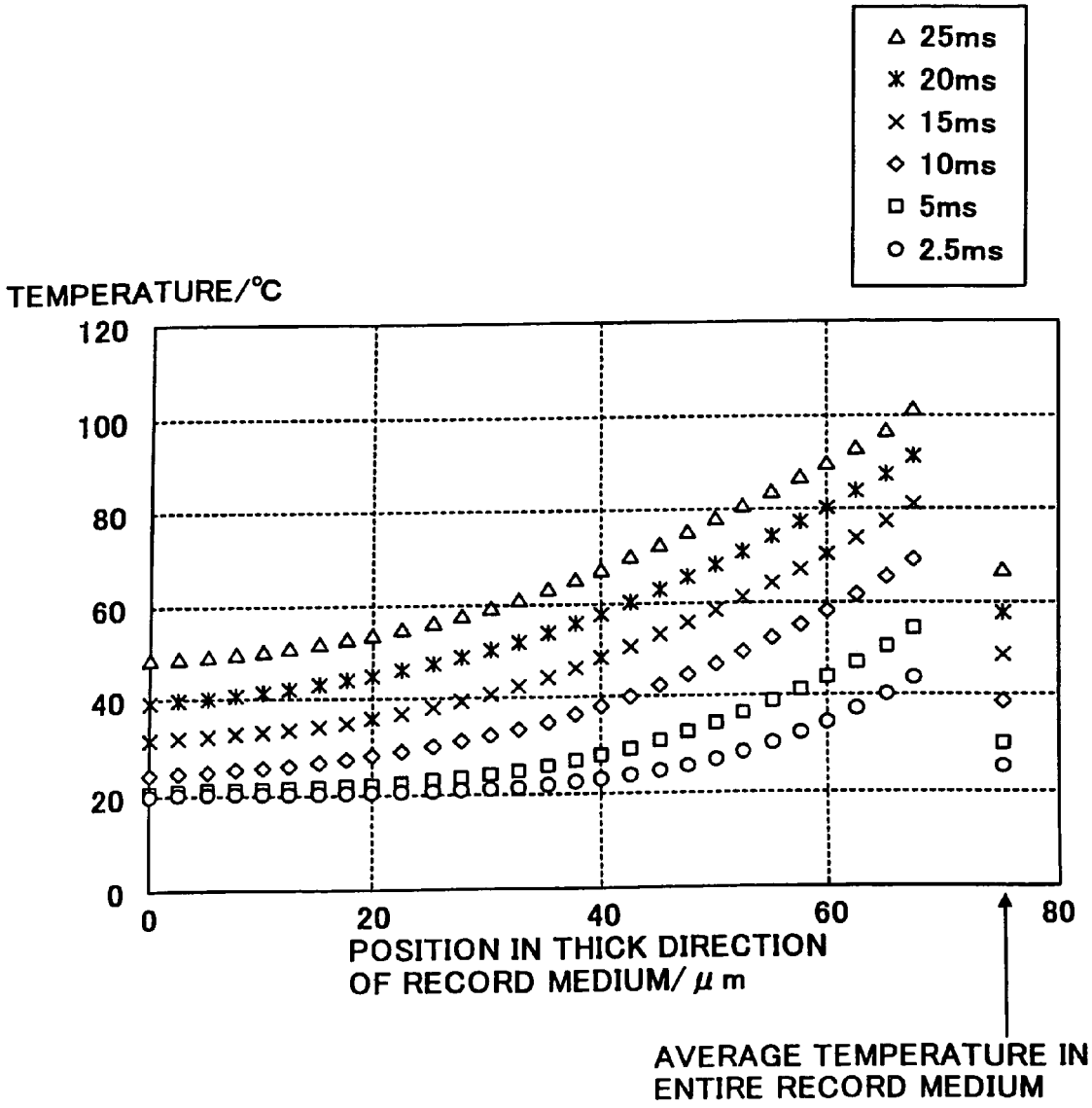
FIG. 39 is a view showing temperature distribution in a direction of thickness in the record medium according to the heating time in the twelfth embodiment.

FIG. 39 is a view showing temperature distribution in the direction of the thickness in the record medium according to the heating time. FIG. 39 shows calculation results in the condition that the electric power irradiated is 48 W, the width of the record medium is 300 mm, and the thickness of the record medium is 70 μm. A difference equation of one-dimensional heat conduction is solved by the explicit method. The calculation unit of the thickness is every 2.5 μm, and the calculation unit of the time is 50 μm. An actual measurement corresponds to the calculation result in a case that the absorbable efficiency of the record medium is 40~60%. According to the results in FIG. 39, it is preferable to heat the record medium for 2.5 ms~10 ms, because the temperature of the opposite side of the record medium does not rise much.

According to the twelfth embodiment, smoke or a burning smell caused by excessive heating of the toner is prevented, and it is possible to control minutely the fixing and adhering conditions of the toner image on the record medium. Further, the record medium is prevented from directly contacting the radiation source. In addition, it is possible to efficiently heat the record image.

Figure 40:
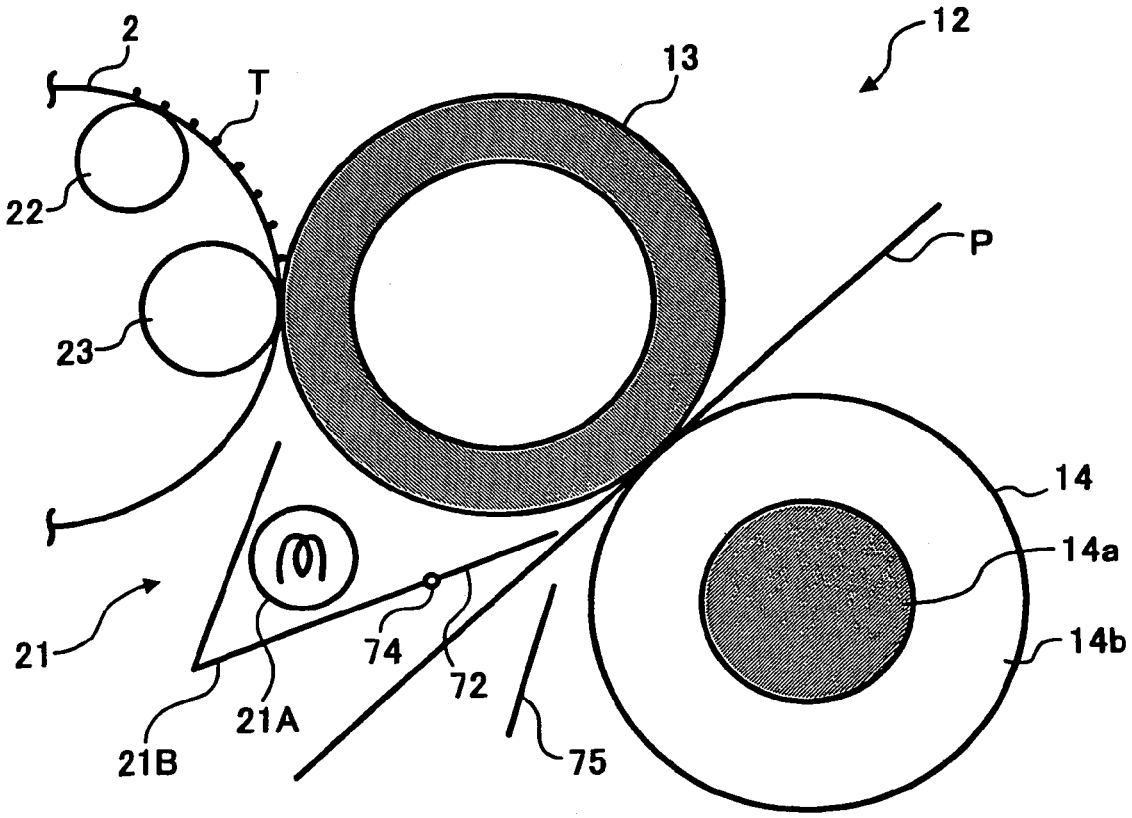
FIG. 40 is a schematic front view showing a thirteenth embodiment of the present invention.

FIG. 40 is a schematic front view showing a thirteenth embodiment. In this embodiment, the transfer fixing roller 13 does not include an inner heating member, and a movement restraining member 72 is connected to the reflector 21B by a hinge 74. The movement restraining member 72, which transmits the heat radiation by the radiating heater 21A as a medium heating member, prevents the record medium P before reaching the nip N from moving into the radiating heater 21A. A guide member 75 guides the record medium P before reaching the nip N together with the movement restraining member 72. Thereby, it is possible for the outer heating member 21 to also heat the record medium P, while preventing the record medium P from directly contacting the outer heating member 21.

Figure 41:
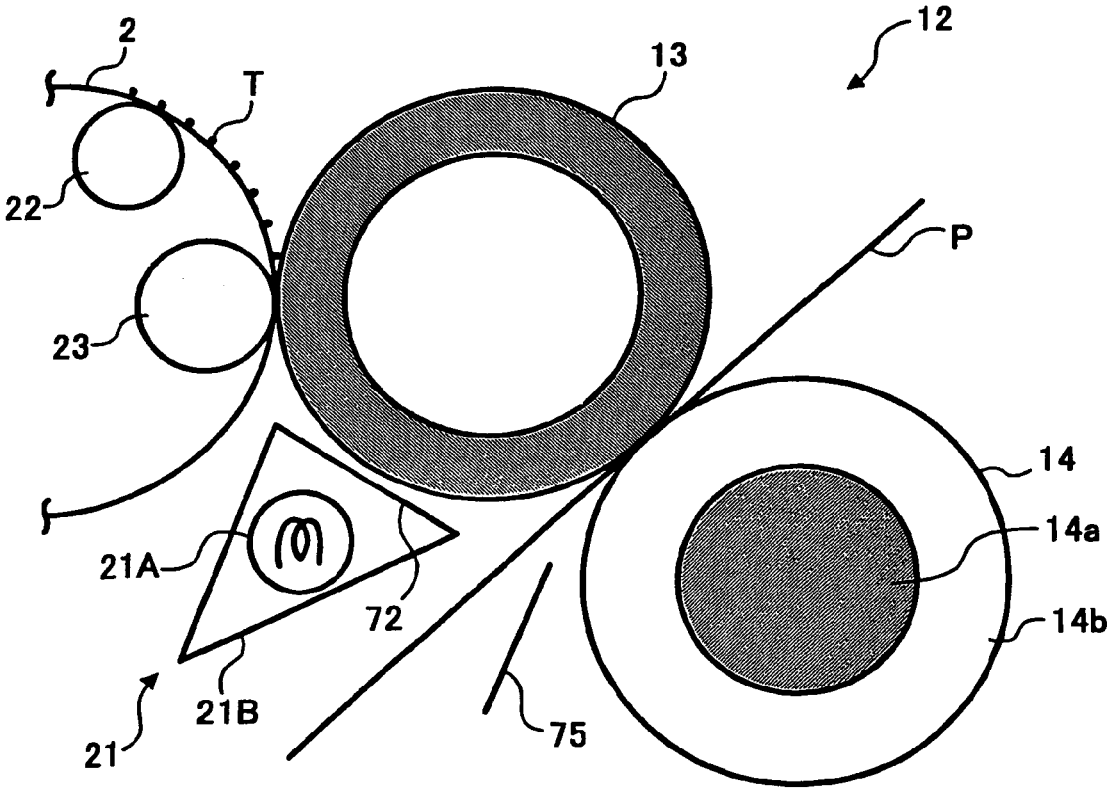
FIG. 41 is a schematic front view showing a modification of the thirteenth embodiment.

FIG. 41 is a schematic front view showing a modification of this embodiment. In this modification, the movement restraining member 72 is connected to the reflector 21B, and is arranged between the transfer fixing roller 13 and the radiating heater 21A. Thereby, the radiating heater 21A is surrounded by the reflector 21B and the movement restraining member 72, and then it is possible for the outer heating member 21 to also heat the record medium P, and prevent the record medium P from directly contacting the radiating heater 21A.

Figure 42:
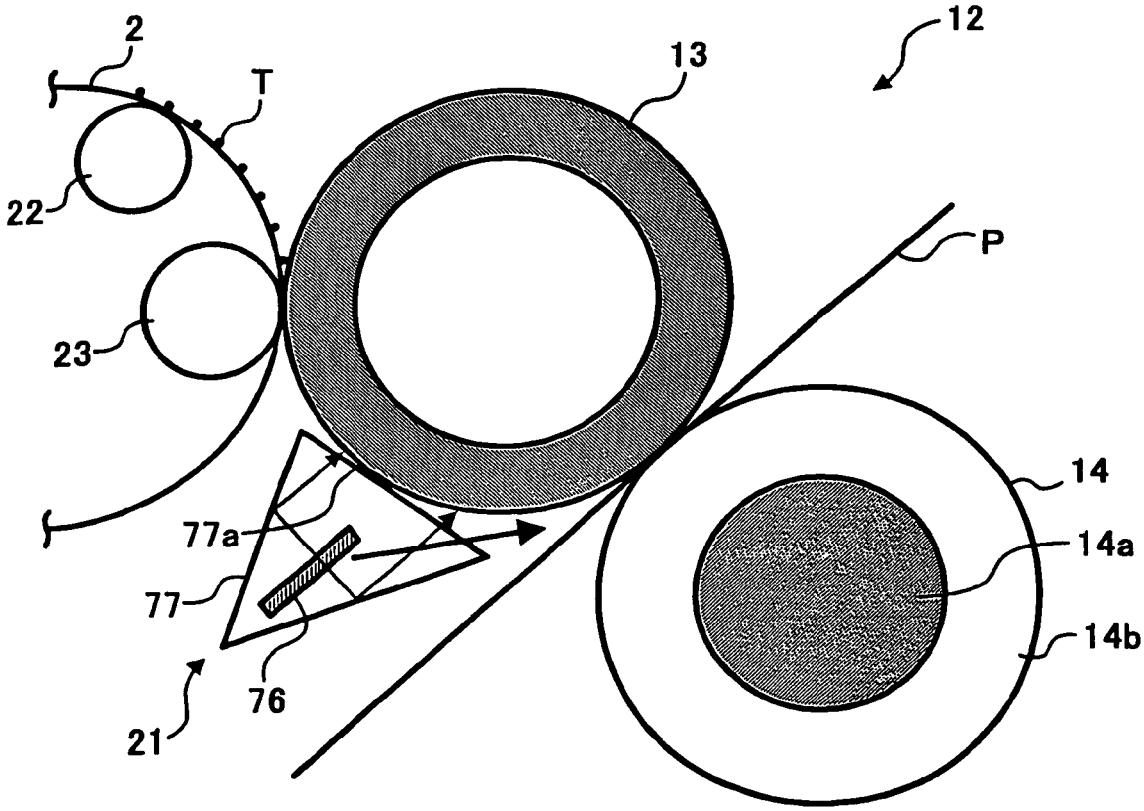
FIG. 42 is a schematic front view showing a fourteenth embodiment of the present invention.

FIG. 42 is a schematic front view showing a fourteenth embodiment. In this embodiment, the outer heating member 21 as a radiation heating member includes a carbon 76 as a radiation source, a reflector 77, and a transparent member 77*a* surrounding the carbon 76. The transparent member 77*a* is arranged between the transfer fixing roller 13 and the carbon 76. The carbon 76, whose shape is like a board or a sheet, makes substantially a right angle to a tangent to the surface of the transfer fixing roller 13. The carbon 76 radiates the heating radiation in the direction of thickness thereof, and the reflector 77 reflects the radiation by the carbon 76 to the transfer fixing roller 13. Thereby, it is easy to make the radiation zone narrow, and then it is easy to make the temperature gradient of the toner image large in the thickness direction of the toner image. Further, part of the heating radiation through the transparent member 77*a* radiates onto the record medium P.

Figure 43:
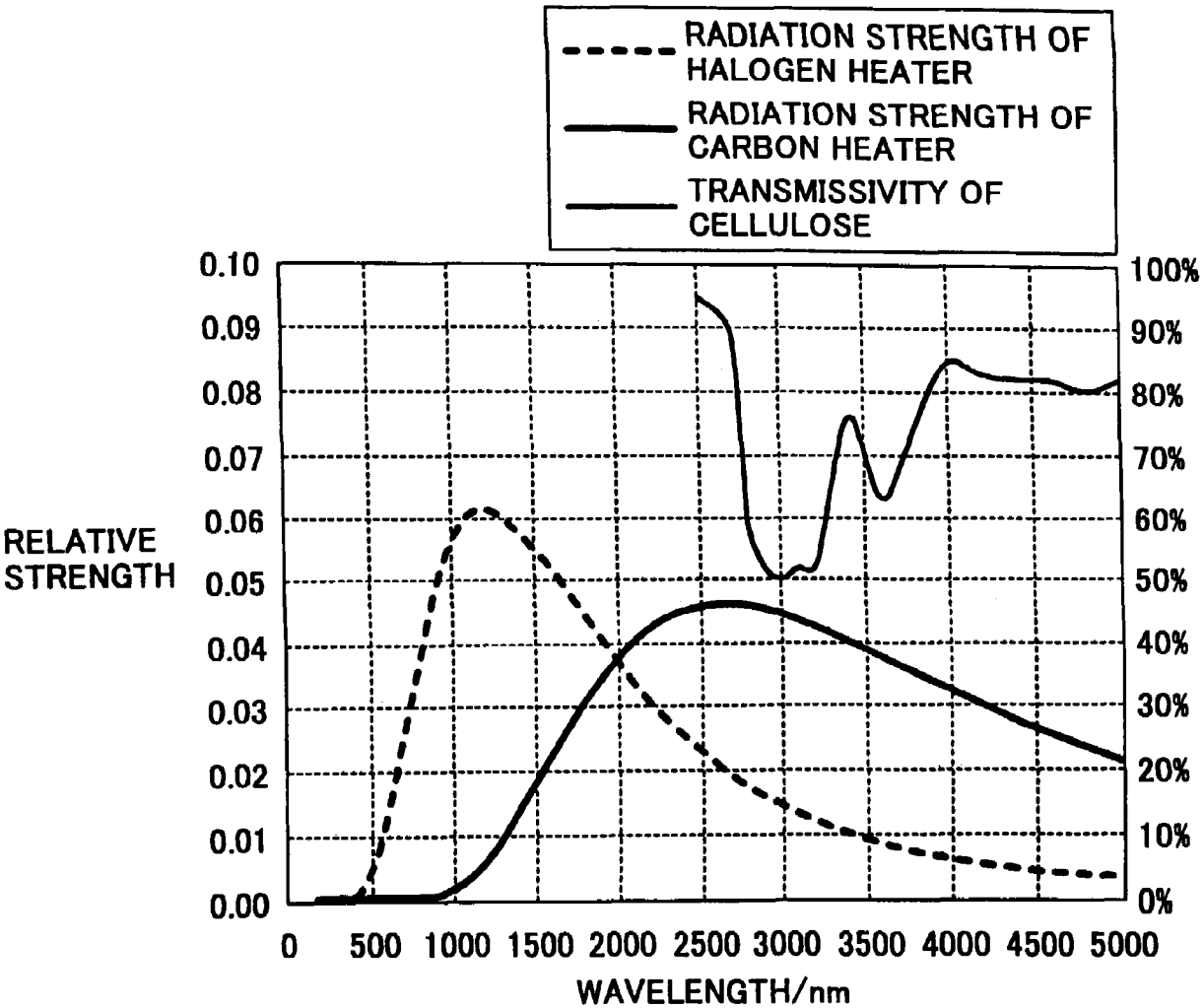
FIG. 43 is a view showing the relation between wavelength and radiation strength of a halogen heater, radiation strength of a carbon heater, and transmissivity of cellulose in the fourteenth embodiment.

FIG. 43 is a view showing relations between the wavelength and the radiation strength of the halogen heater, the radiation strength of the carbon heater, and the transmissivity of cellulose. Cellulose, which is main component of the record medium, has an OH combination and a CH combination. An absorbable zone of the cellulose is around 2.6~3.3 μm by the vibration of the OH expanding and contracting, and about 3.6 μm by the vibration of the CH expanding and contracting according to measuring the infrared rays absorbed. On the other hand, the peak of the halogen heater is about 1.2 μm, and the peak of the carbon heater is about 2.5 μm. Thereby, it is possible to use a halogen heater as a medium heating member, but it is preferable to use a carbon heater as a medium heating member. Further, it is possible to regulate the radiation strength of the carbon heater in a wider zone than the halogen heater. The heating efficiency to the record medium increases when the electric power decreases, because the wavelength shifts to be longer. Further, the toner preferably includes a binder with the OH as a polyol or a polyethylene, or a chemical to absorb the infrared rays.

Figure 44:
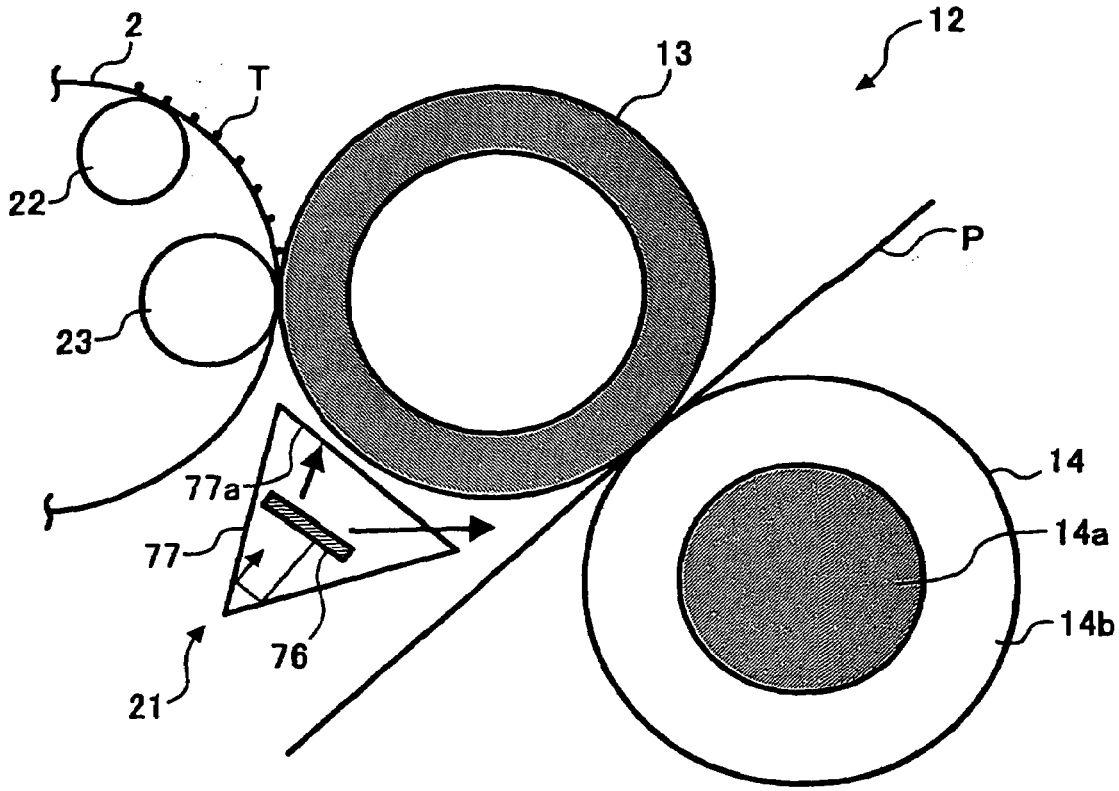
FIG. 44 is a schematic front view showing a modification of the fourteenth embodiment.

FIG. 44 is a schematic front view showing a modification of this embodiment. In this modification, the carbon 76 is substantially parallel to a tangent to the surface of the transfer fixing roller 13. In this case, the part of the radiation reflected by the reflector 77 returns to the carbon 76.

According to the fourteenth embodiment, it is easy to make the radiation zone narrow. Further it is possible to heat the record medium efficiently.

Figure 45:
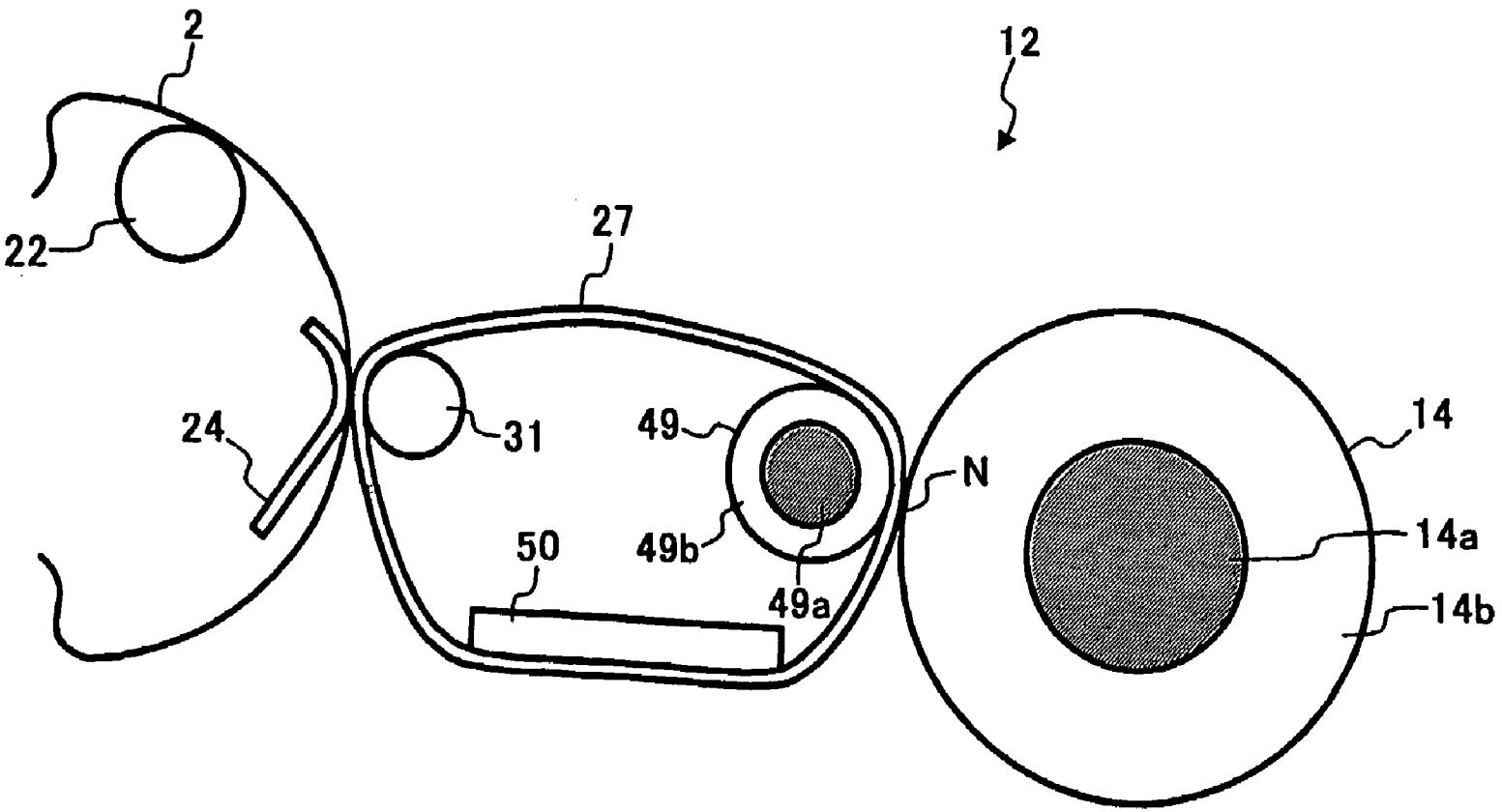
FIG. 45 is a schematic front view showing a fifteenth embodiment of the present invention.

FIG. 45 is a schematic front view showing a fifteenth embodiment. In this embodiment the heating roller 33 is exchanged for a plane heater 50 with PCT characteristics whose electrical resistance rapidly rises.

Figure 46:
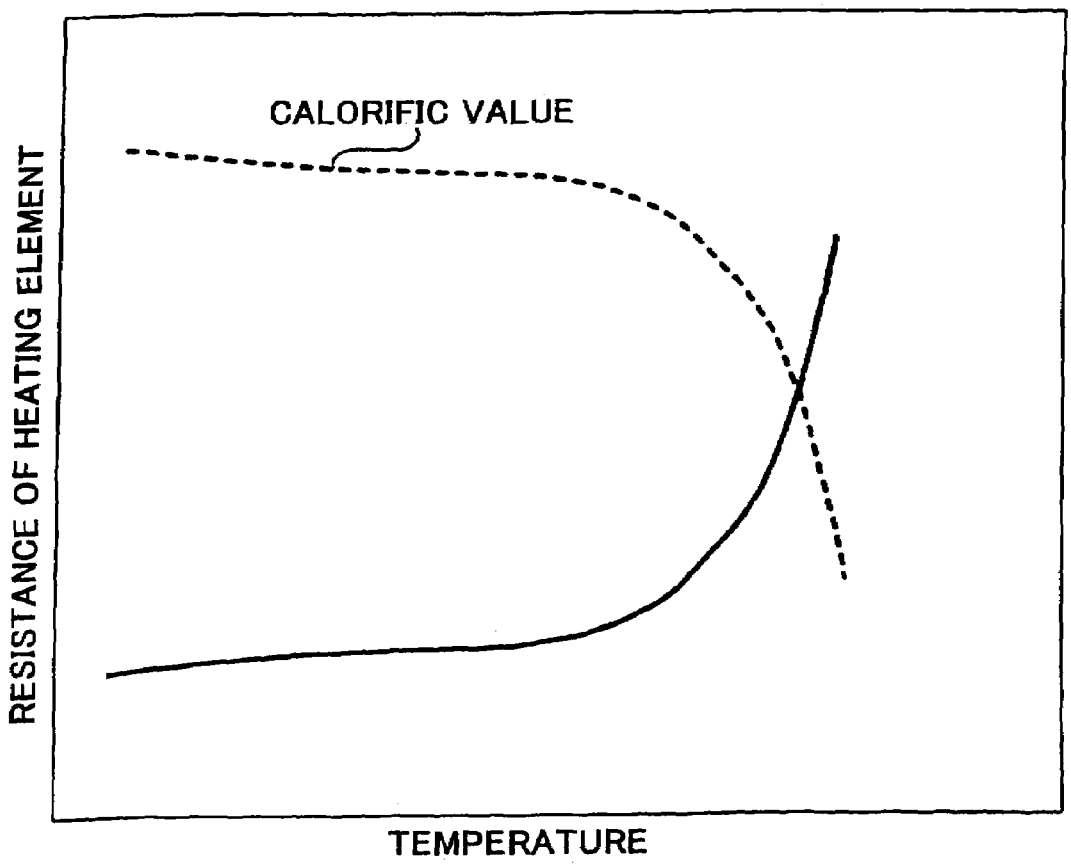
FIG. 46 is a view showing resistance changing and calorific value changing according to a temperature of a plane heater in the fifteenth embodiment.

FIG. 46 is a view showing the resistance changing and the calorific value changing according to the temperature of the plane heater 50. In this embodiment, it is possible to apply the plane heater 50 to the heating member, because it is not necessary to heat higher the toner image on the transfer fixing member 27. Further, the heating member can also serve as a temperature safety device on the transfer fixing member 27.

According to the fifteenth embodiment, it is possible to efficiently heat the toner image.

Figure 47:
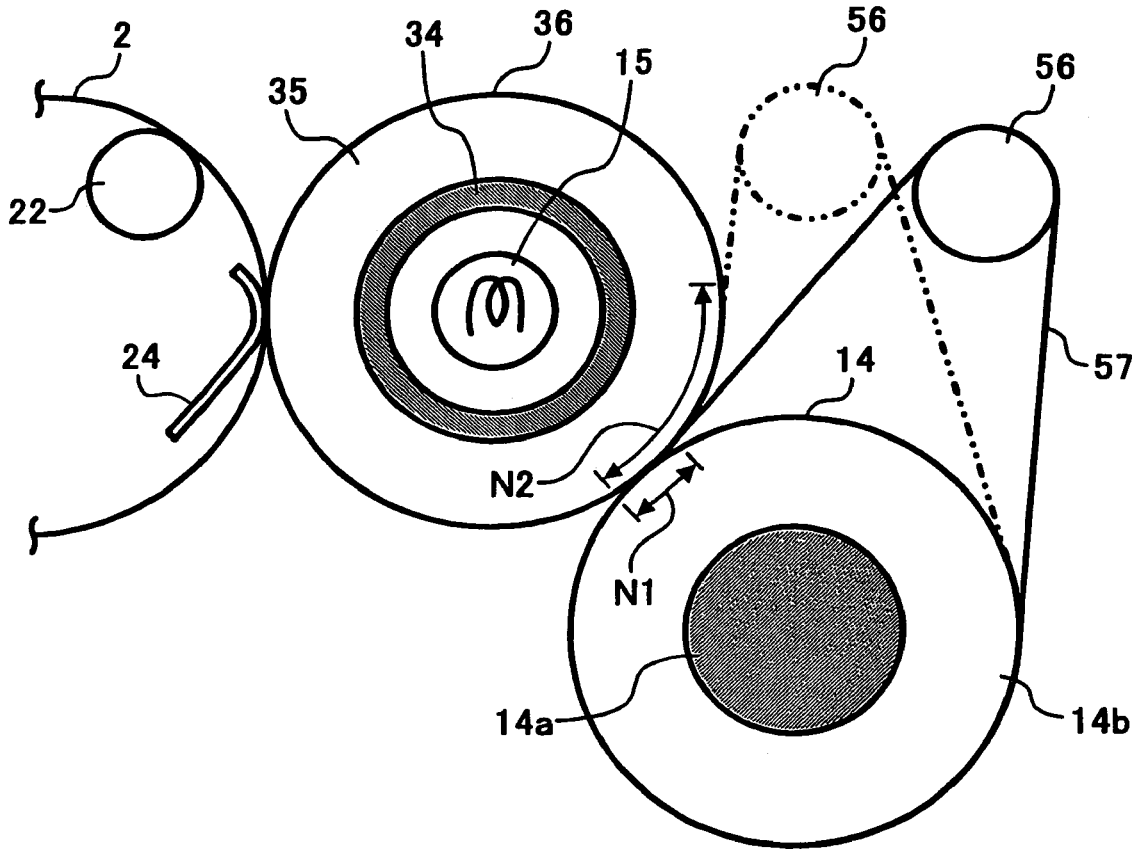
FIG. 47 is a schematic front view showing a sixteenth embodiment of the present invention.

FIG. 47 is a schematic front view showing a sixteenth embodiment. In this embodiment the pressing member includes the pressing roller 14, a supporting roller 56, and a pressing belt 57 supported by the pressing roller 14 and the supporting roller 56. In this embodiment, the width of the nip N changes from N1 to N2, by changing the position of the supporting roller 56 from the solid line position to the two-dot chain line position. Thereby, the toner image is heated longer in the nip N, to prevent an uneven toner image being fixed on the record medium.

FIG. 10 is cited again to describe a seventeenth embodiment. In this embodiment, the transfer fixing member driving motor 55 changes a line speed of the transfer fixing member. The switch 54 is pushed when a record medium with high thermal capacity is used. The controller 52 drives the transfer fixing member driving motor 55 as the line speed of the transfer fixing member slows down. Thereby, the toner image on the transfer fixing member is heated longer, to prevent an uneven toner image being fixed on the record medium.

Further, the transfer fixing member rotates with the line speed less than the intermediate transfer member, because the transfer fixing member driving motor 55 slows down the line speed of the transfer fixing member. Thereby, the toner image is transferred from the intermediate transfer member to the transfer fixing member according to the line speed gap between the intermediate transfer member and the transfer fixing member. That prevents the center part in the toner image area missing in a case that the toner image area is large.

Figure 48A:
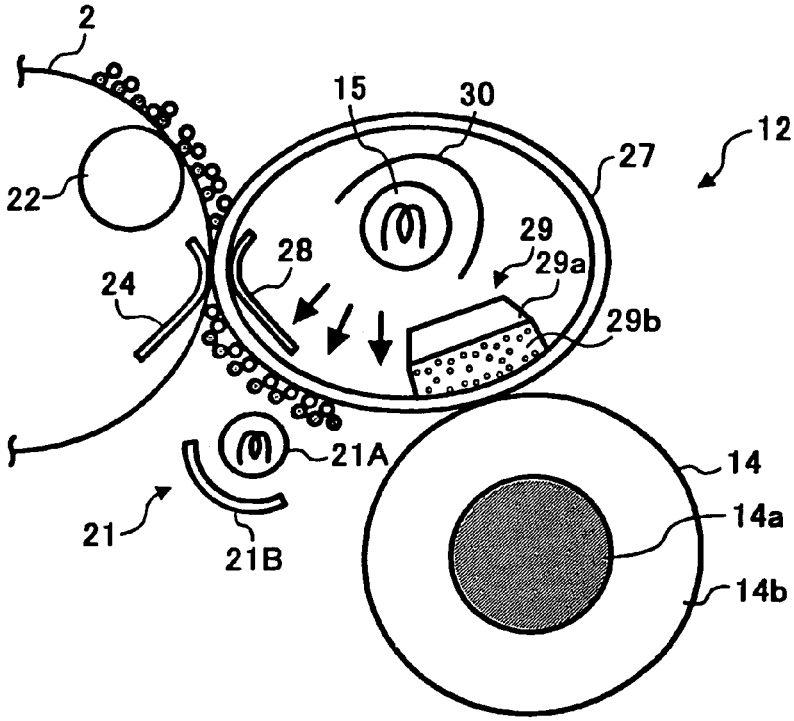
FIG. 48A and FIG. 48B are schematic front views showing an eighteenth embodiment of the present invention.
Figure 48B:
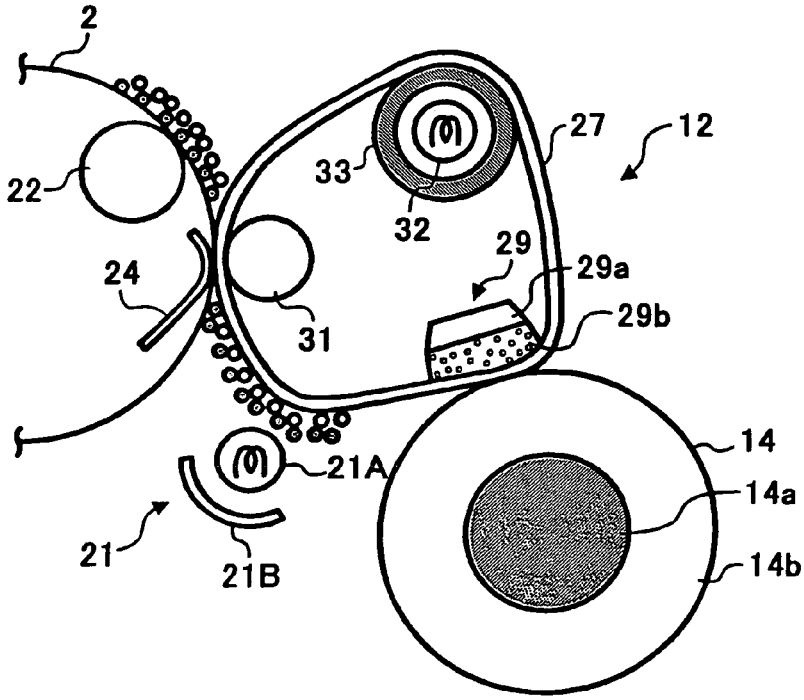

FIG. 48A and FIG. 48B are schematic front views showing an eighteenth embodiment. In this embodiment, the outer heating member 21 radiates heat to the toner image on the transfer fixing member 27. The toner image device holds the toner image of plural colors, yellow, magenta, cyanogen, black on the surface thereof, the color black with the highest radiation rate among the plural colors being formed at the outermost portion of the transfer fixing member 27. The black circles show the black toner image in FIG. 48A and FIG. 48B. Thereby, the toner image including plural colors can efficiently absorb the heat by the radiating heater 21A.

Figure 49A:
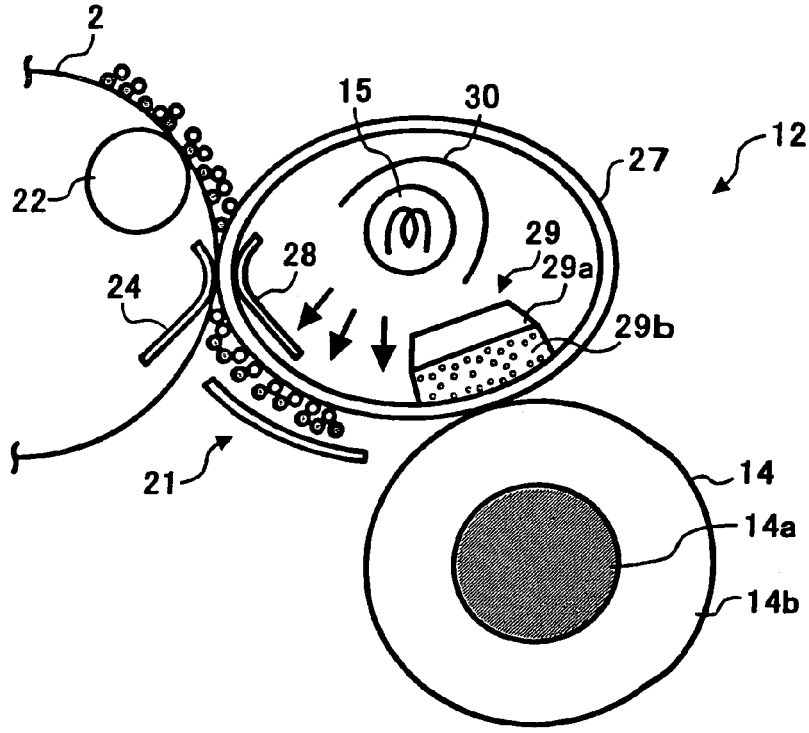
FIG. 49A and FIG. 49B are schematic front views showing a nineteenth embodiment of the present invention.
Figure 49B:
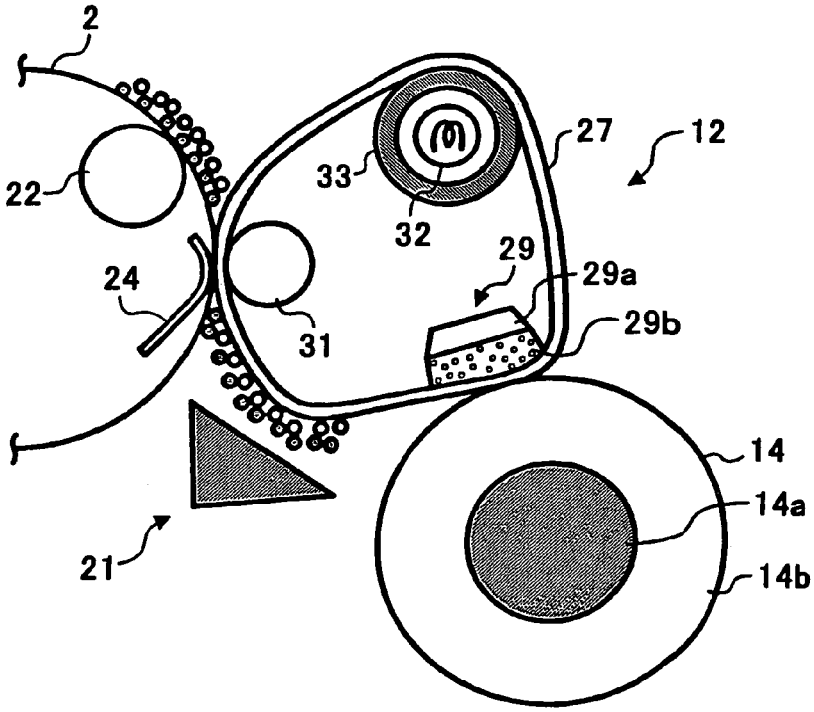

FIG. 49A and FIG. 49B are schematic front views showing a nineteenth embodiment. In this embodiment, the outer heating member 21 heats the toner image on the transfer fixing member 27 by heat convection between the outer heating member 21 and the toner image. The toner image device holds the toner image of plural colors, yellow, magenta, cyanogen, black on the surface thereof, the color with the lowest radiation rate among the plural colors being formed at the outermost position of the transfer fixing member 27. The white circles show the toner image of the color with the lowest radiation rate among the plural colors, the black circle showing the black toner image as in FIG. 48A and FIG. 48B. Thereby, the toner image including plural color is prevented from radiating outside.

Figure 50:
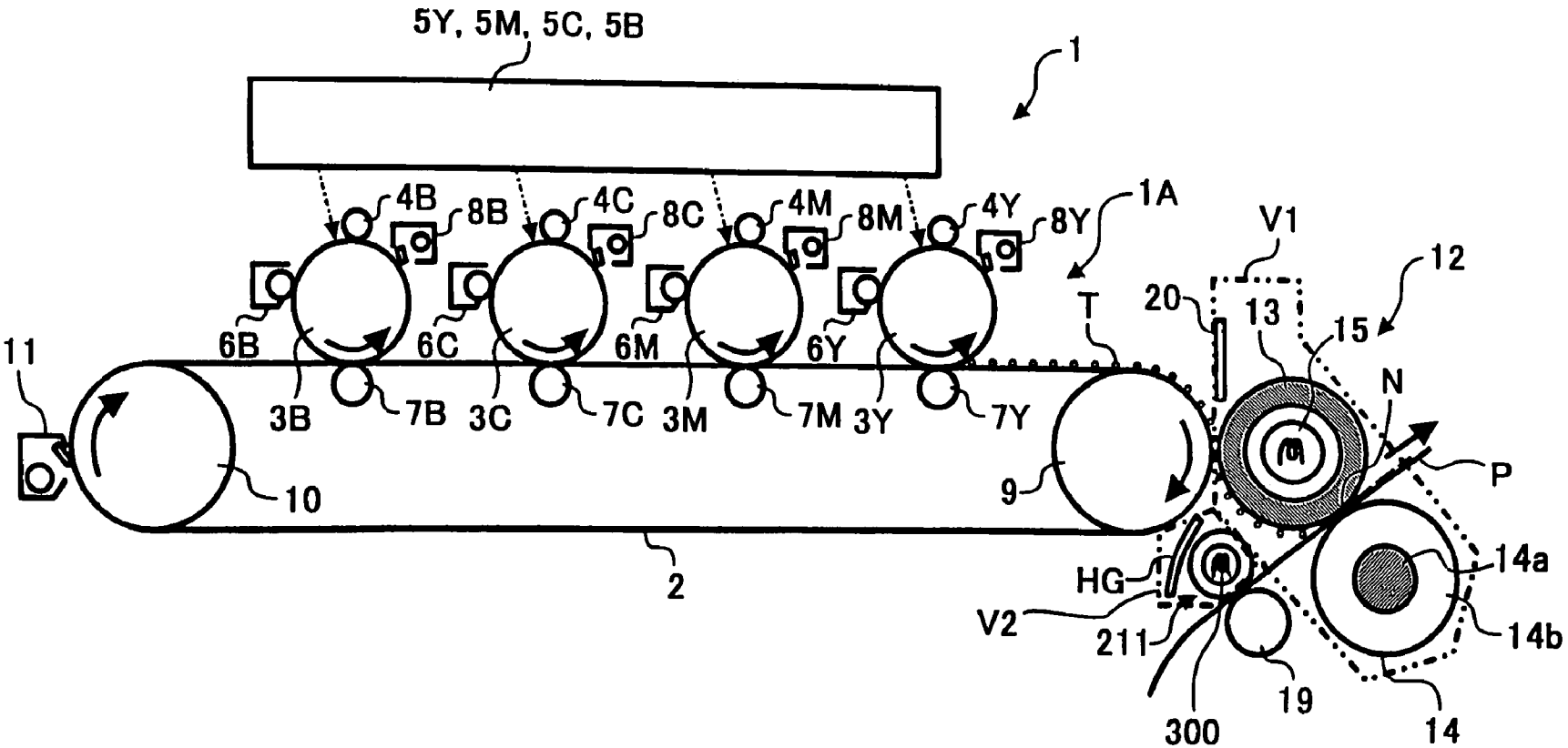
FIG. 50 is a schematic front view showing a twentieth embodiment of the present invention.

FIG. 50 is a schematic front view showing a twentieth embodiment. In this embodiment, each of the transfer fixing roller 13 and the outer heating member 21 is accommodated in each of a unit V1 and a unit V2 that are individually modularized in a casing 1A. Thereby, the transfer fixing roller 13 and the outer heating member 21 as an image heating member or a medium heating member are individually exchangeable, or the halogen heater 15 and the outer heating member 21 are individually exchangeable. Therefore, it is unnecessary to exchange all members if only one member becomes defective.

Figure 51:
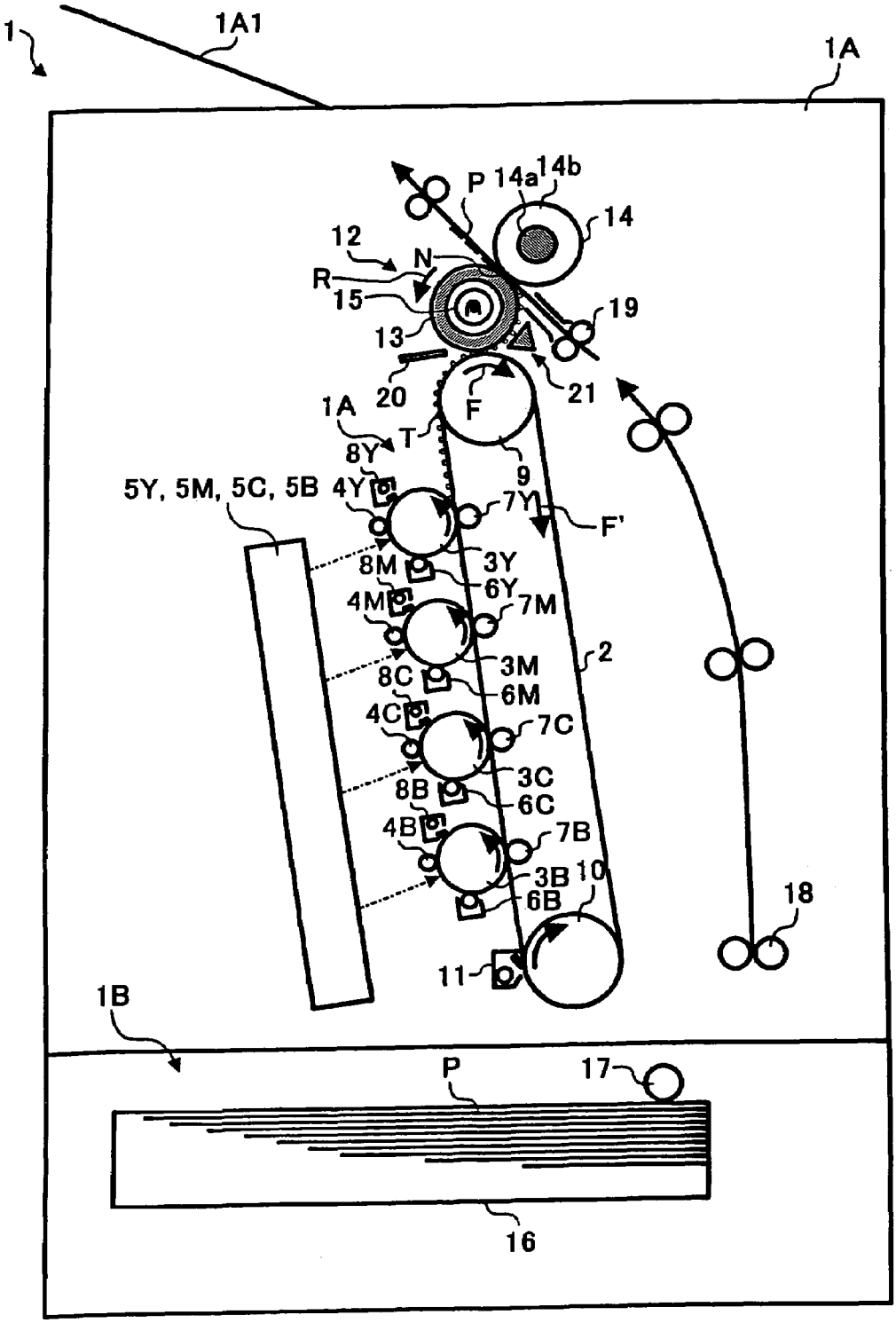
FIG. 51 is a schematic front view showing a twenty first embodiment of the present invention.

FIG. 51 is a schematic front view showing a twenty first embodiment. In this embodiment, the transfer fixing roller 13 is arranged at an upper side in the image forming unit 1A and above the intermediate transfer belt 2. The image forming unit 1A includes an upper surface with an output for the record medium, and the upper surface connects a tray 1A1 arranged above it, which receives the record medium sent from the output. The transfer fixing roller 13 and the upper surface and the tray 1A1 are arranged as the record medium is continuously passed from the transfer fixing roller 13 to the tray 1A1. Thereby, the record medium sent from the transfer fixing roller 13 moves upward. Further, the intermediate transfer belt 2 just after transferring the toner image moves downward.

In this embodiment, heating of the intermediate transfer belt 2 by the transfer fixing roller 13 is reduced, because the transfer fixing roller 13 is arranged above the intermediate transfer belt 2. In addition, it can be realized easily that the direction of the record medium sent from the transfer fixing roller 13 is opposite to the direction of the intermediate transfer belt 2 just after transferring the record medium, because the transfer fixing roller 13 is arranged between the record medium and the intermediate transfer belt 2. Further, it is possible to regulate the direction of the record medium sent from the transfer fixing roller 13 in a small space, because the transfer fixing roller 13 is a roller. Thereby, it is possible that the record medium sent from the transfer fixing roller 13 moves upward, and the intermediate transfer belt 2 just after transferring the toner image moves downward. Therefore, it is possible to use the space above the apparatus efficiently, and it is possible to make the space for the tray 1A1 smaller. Thereby, it is possible to make the space for the entire apparatus smaller.

Further, as the transfer fixing roller 13 transfers and fixes the toner image onto only one surface of the record medium, the transfer fixing roller 13 and the upper surface are arranged so the surface with the toner image of the record medium faces downward on the tray 1A1. Thereby, it is unnecessary to change the turn of plural record mediums.

According to the twenty first embodiment, heating of the intermediate transfer belt 2 by the transfer fixing roller 13 is reduced, and it is possible to make the space for the apparatus smaller.

Figure 52:
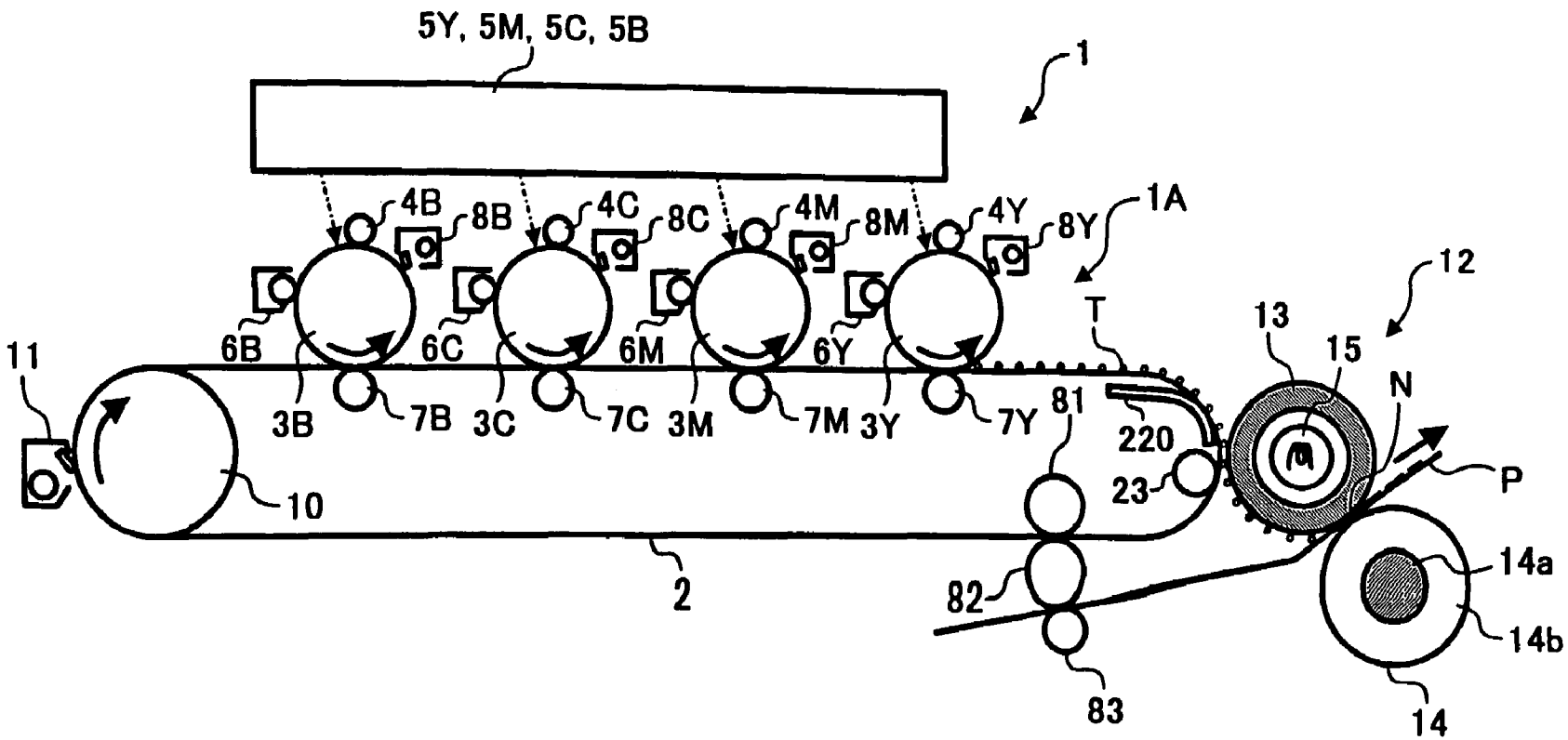
FIG. 52 is a schematic front view showing a twenty second embodiment of the present invention.

FIG. 52 is a schematic front view showing a twenty second embodiment. In this embodiment, a roller 81 is arranged to contact the intermediate transfer belt 2 just after transferring the toner image, a driving roller 82 is provided nipping the intermediate transfer belt 2 between itself and the roller 81, and a roller 83 is provided nipping the record medium between itself and the roller 82. Thereby, changes in the line speed of the intermediate transfer belt 2 caused by the thickness of the toner image changing are reduced. Further, the roller 82 is preferably formed by metal including copper or by a heat pipe. Thereby, it is possible to cool the intermediate transfer belt 2 and to heat the record medium.

Figure 53:
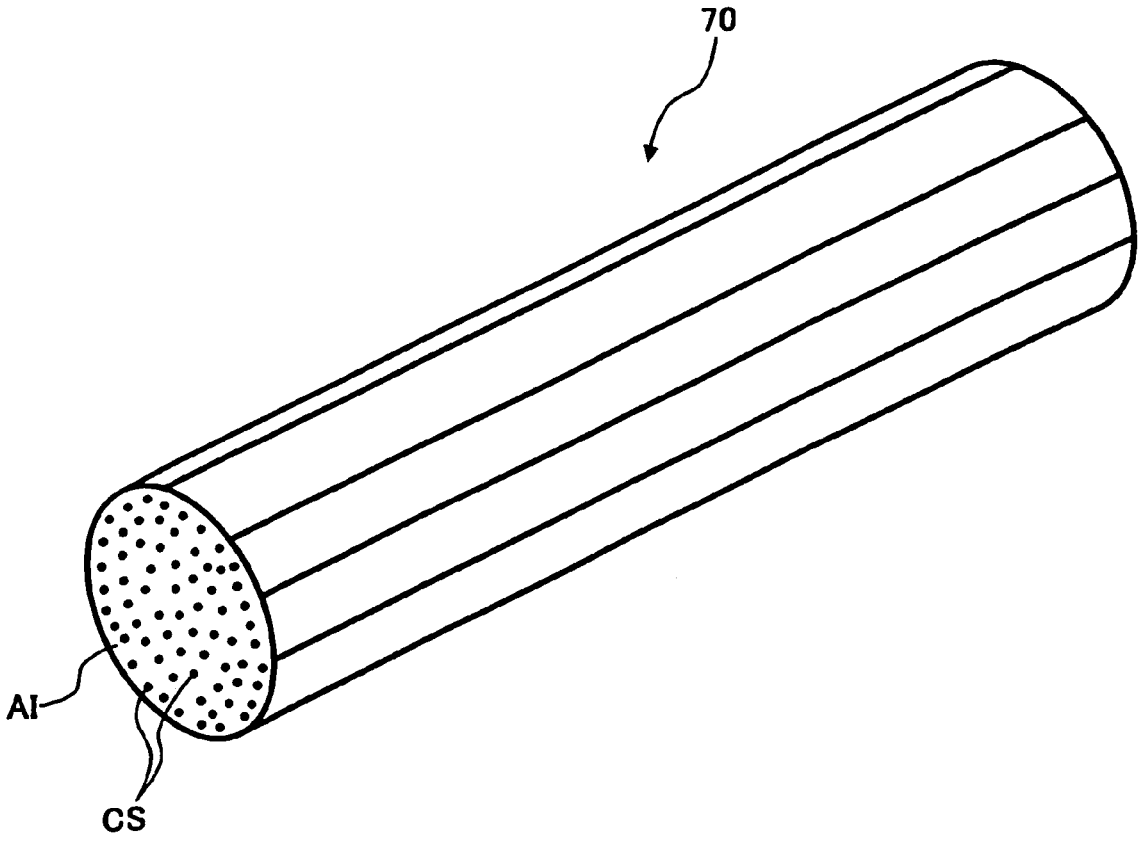
FIG. 53 is a schematic front view showing a twenty third embodiment of the present invention.

FIG. 53 is a schematic front view showing a twenty third embodiment. In this embodiment, a transfer fixing roller 70, which includes mainly A1 and carbon fiber CS to strengthen it, has a modulus of elasticity of three times iron, and a flexibility of a third of iron. Thereby, the transfer fixing roller 70 can equally contact the intermediate transfer member, and then the toner image can be equally transferred from the intermediate transfer member onto the transfer fixing member.

In the embodiments describe above, the heating member may include individual or assorted of various heaters such as an induction heater, except for the embodiment including the characteristic regarding a kind of heating member.

Further, the transfer fixing member and the opposite member or the pressing member may be assorted by a roller and a belt, except for the embodiment including the characteristic regarding a kind of them. In a case that they are both belts, their thermal capacity is the smallest.

In addition, the surface of various members contacting the toner image may include the combination of a releasing layer and an elastic layer. Further, the surface of the transfer fixing member may include a lower radiation rate material as a metal. Thereby, it is possible to reduce the difference of the temperature between the potion with the toner image and the portion without the toner image on the transfer fixing member.

Furthermore, the pressing member may include plural portions whose pressure is individually set up. Thereby, the pressure of the downstream portion may be higher to cope with the melted toner image. It is possible to increase pressure, by combining with other pressing members.

Figure 54:
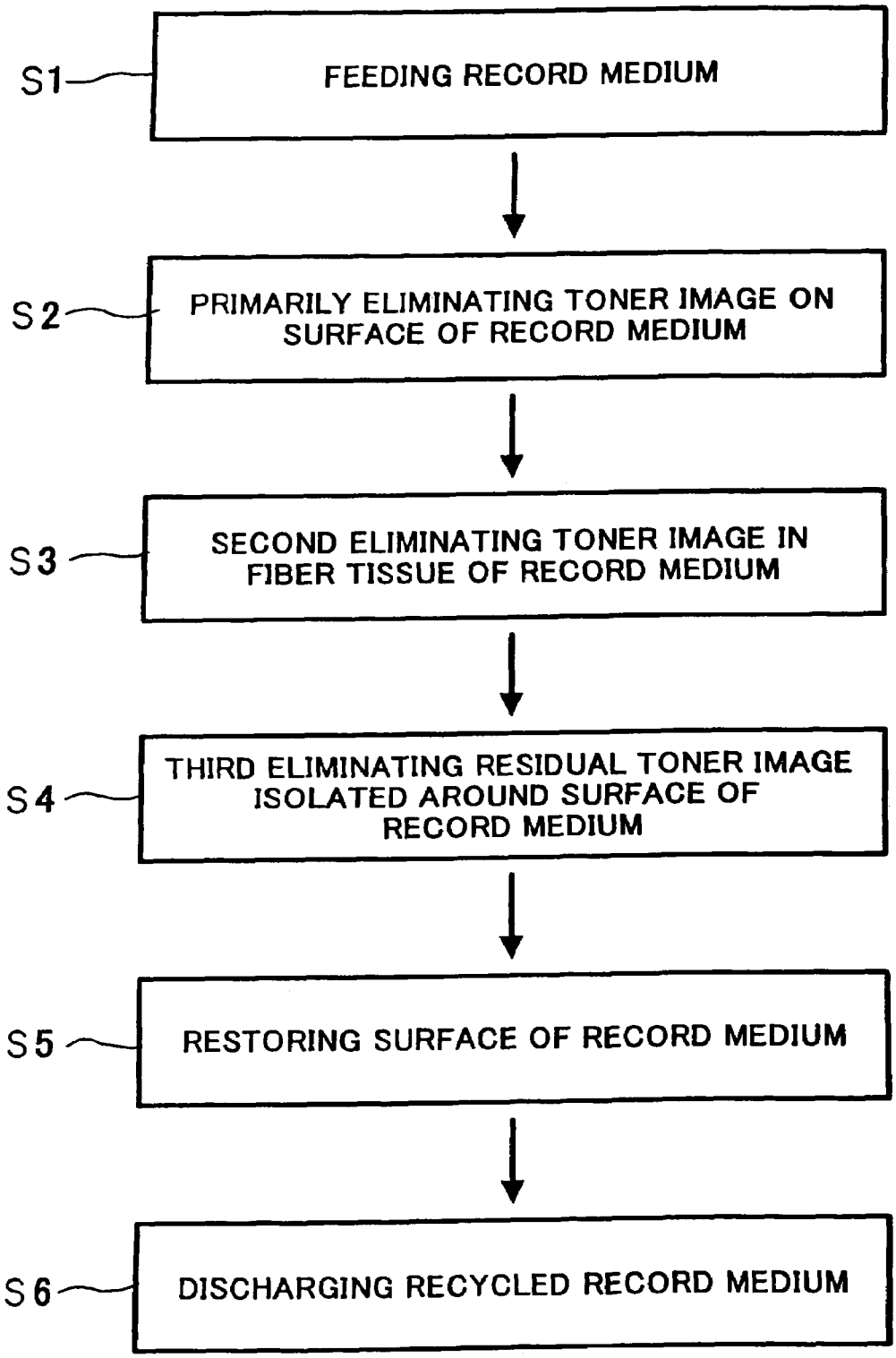
FIG. 54 is a flow chart showing a manufacturing process in a twenty fourth embodiment of the present invention.
Figure 55A:
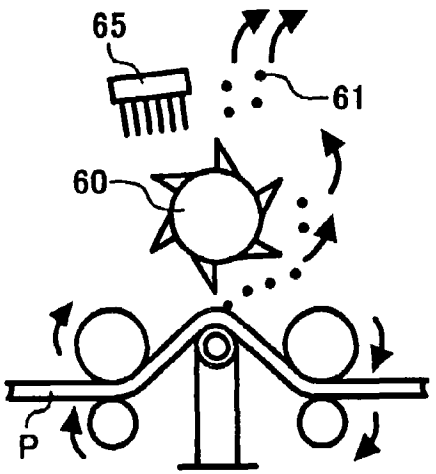
FIGS. 55A, 55B, 55C, and 55D are schematic front view showing the twenty fourth embodiment.
Figure 55B:
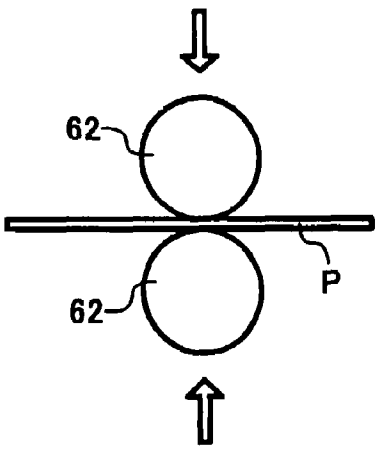
Figure 55C:
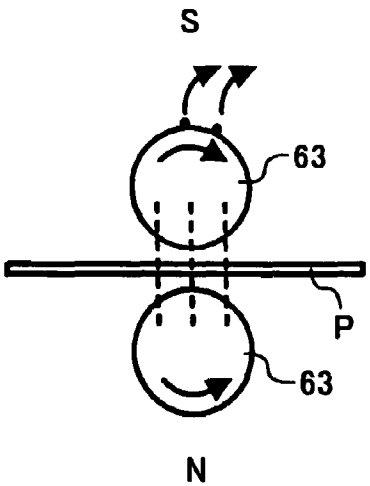
Figure 55D:
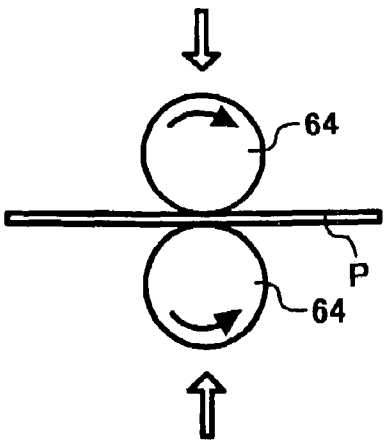

FIG. 54 is a flow chart showing a manufacturing process in a twenty fourth embodiment. In this embodiment a record medium recycling method includes forming a toner image on an toner image carrier, primarily transferring the toner image onto an intermediate transfer member, secondarily transferring the toner image on the intermediate transfer member onto a transfer fixing member, thirdly transferring and fixing the toner member on the transfer fixing member onto a record medium, according to one of all the embodiments described above.

Further, the record medium recycling method includes a heating step of heating the toner image on the transfer fixing member according to one of any of the embodiments described above, and a removing step of removing the toner image from the record medium. The removing step includes feeding the record medium with the toner image (S1), primarily eliminating the toner image on the surface of the record medium (S2), second eliminating the toner image in the fiber tissue of the record medium (S3), third eliminating the residual toner image isolated around the surface of the record medium (S4), restoring the surface of the record medium (S5), and discharging the recycled record medium (S6), as published in Japanese Published Unexamined Patent Application No. Hei 10-63121. Further, a recycling apparatus includes a means corresponding to each step in the removing step.

FIGS. 55A, 55B, 55C, 55D are schematic front view showing this embodiment. In this embodiment, a blade roller 60 as a first eliminating means eliminates a toner image 61 on the surface of a record medium P. A pair of heating pressing rollers 62 as second eliminating means eliminates the toner image in the fiber tissue of the record medium P by the toner image transferred onto the surface of the heating pressing roller 62. A pair of magnetic rollers 63 as third eliminating means eliminates the residual toner image isolated around the surface of the record medium P by magnetism. A pair of elastic rollers 64 as a restoring means presses to restore the surface of the record medium P. A brush 65 is used to clean the blade roller 60.

According to the method and the structure, it is easy to control the interface between the toner image and the record medium, and the toner image and the record medium are prevented from being excessively heated, by heating the toner image on the transfer fixing member. Therefore, it is easy to eliminate the toner image from the record medium.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A fixing apparatus, comprising:

a transfer fixing belt having an outer surface onto which a toner image is transferred;

a heating member configured to heat said toner image on the outer surface of said transfer fixing belt; and a pressing member in contact with said transfer fixing belt is to form a nip between said transfer fixing belt and said pressing member through which nip a recording medium passes;

wherein a part of said transfer fixing belt preceding the nip and a part of said transfer belt following the nip are not tensioned.

2. An image forming apparatus including the fixing apparatus of claim 1.

3. A fixing apparatus according to claim 2, further comprising an intermediate transfer belt in contact with said transfer fixing belt.

4. A fixing apparatus according to claim 1, further comprising a supporting member opposite to the pressing member at the nip, and wherein the heating member includes a supporting roller with a halogen heater.

5. A fixing apparatus according to claim 4, said supporting member includes an elastic layer to absorb vibration of the transfer fixing belt.

6. A fixing apparatus according to claim 4, further comprising a board spring contacting an inner surface of the transfer fixing belt, and wherein the heating member includes a halogen heater and a reflector.

7. A fixing apparatus according to claim 1, further comprising a supporting member opposite to the pressing member at the nip, and wherein the heating member is positioned such that a position of the transfer fixing belt with a highest temperature is away from a portion where the toner image is transferred.

8. A fixing apparatus according to claim 7, wherein said supporting member is a roller.

9. A fixing apparatus according to claim 1, further comprising a supporting member opposite to the pressing member at the nip, and wherein the heating member includes a first heating element facing an inner surface of the transfer fixing belt and a second heating element facing an outer surface of the transfer fixing belt.

10. A fixing apparatus according to claim 9, wherein the first heating element includes a supporting roller with a halogen heater.

11. A fixing apparatus according to claim 10, wherein the toner image is of plural colors.

12. A fixing apparatus according to claim 9, wherein the toner image is of plural colors.

13. A fixing apparatus according to claim 9, wherein the heating member heats by heat convection.

14. A fixing apparatus according to claim 1, wherein the heating member includes a plane heater.

15. A fixing apparatus according to claim 1, wherein said toner image is formed at a resolution of at least one 600 dpi.

* * * * *